US009873256B2

(12) United States Patent
Owaki et al.

(10) Patent No.: US 9,873,256 B2
(45) Date of Patent: Jan. 23, 2018

(54) LIQUID EJECTING HEAD UNIT, LIQUID EJECTING HEAD MODULE, LIQUID EJECTING APPARATUS, AND METHOD OF MANUFACTURING LIQUID EJECTING HEAD UNIT

(71) Applicant: SEIKO EPSON CORPORATION, Tokyo (JP)

(72) Inventors: Hiroshige Owaki, Okaya (JP); Katsuhiro Okubo, Azumino (JP); Takahiro Kanegae, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/206,069

(22) Filed: Jul. 8, 2016

(65) Prior Publication Data

US 2017/0008291 A1 Jan. 12, 2017

(30) Foreign Application Priority Data

Jul. 8, 2015 (JP) ..... 2015-137263
Jul. 8, 2015 (JP) ..... 2015-137265
Jul. 17, 2015 (JP) ..... 2015-142822

(51) Int. Cl.
*B41J 2/165* (2006.01)
*B41J 2/16* (2006.01)
(Continued)

(52) U.S. Cl.
CPC ..... *B41J 2/1632* (2013.01); *B41J 2/145* (2013.01); *B41J 2/161* (2013.01); *B41J 2/16508* (2013.01);
(Continued)

(58) Field of Classification Search
CPC ..... B41J 2202/19; B41J 2202/20; B41J 2002/14362; B41J 2002/14491; B41J 2002/14419
See application file for complete search history.

(56) References Cited

U.S. PATENT DOCUMENTS 6,793,319 B2 * 9/2004 Ikemoto ..... B41J 2/1433 347/12
2002/0122093 A1 * 9/2002 Otsuka ..... B41J 2/15 347/40
(Continued)

FOREIGN PATENT DOCUMENTS

JP 2001-026113 1/2001
JP 2001-347659 12/2001
(Continued)

*Primary Examiner* — Stephen Meier
*Assistant Examiner* — John P Zimmermann
(74) *Attorney, Agent, or Firm* — Workman Nydegger

(57) ABSTRACT

A liquid ejecting head unit includes: a fixing plate provided with a plurality of openings; a plurality of heads, each of which is provided for each of the openings; and a channel holder that is provided with a plurality of channels and that accommodates the plurality of heads in cooperation with the fixing plate. Each of heads has a nozzle plate provided with a nozzle row having a plurality of nozzles. The head is fixed to a first surface of the fixing plate. An ejection surface is defined by a second surface of the fixing plate and the nozzle plate. The fixing plate has a plurality of sets, each of which has the plurality of openings. Only a part of the openings constituting each of the sets are disposed to be overlapped in a second direction, and the openings are disposed not to be overlapped in a first direction.

20 Claims, 46 Drawing Sheets

(51) Int. Cl.
*B41J 2/14* (2006.01)
*B41J 2/145* (2006.01)

(52) U.S. Cl.
CPC ..... *B41J 2/16535* (2013.01); *B41J 2202/19* (2013.01)

(56) References Cited

U.S. PATENT DOCUMENTS

2003/0128254 A1* 7/2003 Ison ..... B41J 2/14209 347/49
2004/0046832 A1* 3/2004 Kuwahara ..... B41J 2/04573 347/43
2005/0001877 A1* 1/2005 Chikanawa ..... B41J 2/1433 347/42
2005/0046668 A1 3/2005 Owaki
2005/0270339 A1* 12/2005 Sugahara ..... B41J 2/14233 347/68
2009/0058935 A1* 3/2009 Owaki ..... B41J 2/14233 347/47
2009/0244179 A1 10/2009 Sugahara
2014/0340445 A1 11/2014 Achatz et al.

FOREIGN PATENT DOCUMENTS

JP 2003-165210 6/2003
JP 2005-067130 3/2005
JP 2005-096419 4/2005
JP 2009-107189 5/2009
JP 2009-241453 10/2009
JP 2010-046875 4/2010
JP 2011-131484 7/2011
JP 2012-111097 6/2012
JP 2013-169749 9/2013
JP 2014-226938 12/2014

* cited by examiner

LIQUID EJECTING HEAD UNIT, LIQUID EJECTING HEAD MODULE, LIQUID EJECTING APPARATUS, AND METHOD OF MANUFACTURING LIQUID EJECTING HEAD UNIT

CROSS-REFERENCES TO RELATED APPLICATIONS

This application claims priority to Japanese Patent Application No. 2015-137263 filed on Jul. 8, 2015, Japanese Patent Application No. 2015-137265 filed on Jul. 8, 2015 and Japanese Patent Application No. 2015-142822 filed on Jul. 17, 2015. The entire disclosures of Japanese Patent Application Nos. 2015-137263, 2015-137265, and 2015-142822 are hereby incorporated herein by reference.

BACKGROUND

1. Technical Field

The present invention relates to a liquid ejecting head unit, a liquid ejecting head module on which the liquid ejecting head unit is mounted, a liquid ejecting apparatus on which the liquid ejecting head unit or the liquid ejecting head module is mounted, and a method of manufacturing the liquid ejecting head unit.

2. Related Art

An ink jet-type recording apparatus such an ink jet-type printer or a plotter includes an ink jet-type recording head unit having an ink jet-type recording head that can eject, as an ink droplet, ink stored in a liquid storage unit such as an ink cartridge or an ink tank.

As an example of the ink jet-type recording head unit, there has been proposed an ink jet-type recording head unit that includes an ink jet-type recording head that ejects ink, a channel member that supplies ink to the ink jet-type recording head, and a fixing plate to which the ink jet-type recording heads are fixed in a state of being arranged in parallel in one direction and being aligned at a position (for example, see JP-A-2005-096419).

In addition, there has also been proposed an ink jet-type recording head unit group including a plurality of such ink jet-type recording head units (for example, see JP-A-2009-107189). In such an ink jet-type recording head unit group, the ink jet-type recording head units are arranged in parallel in one direction and are attached to a common channel member. Thus, in each of the ink jet-type recording head units, a plurality of ink jet-type recording heads are fixed to a common fixing plate in a state of being arranged in parallel in one direction and being aligned at a position.

In such an ink jet-type recording head unit and a head unit group, a plurality of ink jet-type recording heads are fixed to a common fixing plate, thereby making it possible to achieve multiple rows of nozzles and elongation of the nozzle row (for example, see JP-A-2011-131484 and JP-A-2012-111097). Further, it is possible to improve accuracy of position alignment between the ink jet-type recording heads.

However, in the ink jet-type recording head unit according to JP-A-2005-096419, it is possible to have, in one direction (direction in which the heads are arranged in parallel), a wide region in which the ink jet-type recording heads are disposed; however, it is not possible to have a wide region in the other direction (direction intersecting with the one direction). In other words, it is not possible to dispose the plurality of ink jet-type recording heads in the other direction and thus, it is not possible to achieve elongation of the nozzle row in an outward appearance.

In addition, each of the ink jet-type recording heads includes a cover head that protects a nozzle plate which becomes an ejection surface of ink. Since the ink jet-type recording head is fixed to the fixing plate through the cover head, a so-called paper gap between the ejection surface and a medium is likely to be widened by the amount of a thickness of the cover head.

In addition, in the ink jet-type recording head unit group according to JP-A-2009-107189, the ink jet-type recording head units need to be disposed at a certain distance from each other so as to be attached to the common channel member. In addition, in each of the ink jet-type recording head units, the ink jet-type recording heads are fixed to the fixing plate. Therefore, the ink jet-type recording head is not disposed in a region between the ink jet-type recording head units, which is not effectively used, and thus, the ink jet-type recording head unit group is not sufficiently decreased in size in one direction.

In addition, in the ink jet-type recording head unit according to JP-A-2011-131484, a discharge surface, which is formed of a front surface of the fixing plate and a front surface of a nozzle plate, is wiped by a wiping unit such as a wiper for removing attached ink, paper powder, or the like; however, a problem arises in that the wiping unit comes into contact with an edge of the fixing plate and then is scratched, worn away, and damaged, and thereby the service life of the wiper is likely to be shortened. Examples of the wiping unit include various materials such as a blade formed of an elastic material such as rubber, cloth, or a porous material such as a sponge; here, the wiping unit formed of the elastic material is scratched or worn away by the edge of the fixing plate, and the wiping unit formed of the cloth, the porous material, or the like, is likely to be caught on the edge of the fixing plate and be damaged.

In addition, it is conceivable to employ a method in which the entire circumference of the fixing plate is subjected to drawing so as to form a side surface section along the entire circumference, thereby rounding the edge that comes into contact with the wiping unit of the fixing plate so as to reduce occurrence of scratches, wearing away, and damage to the wiping unit; however, problems arise in that flatness of a surface of the fixing plate, to which a liquid ejecting head is fixed, is lowered due to the drawing of the fixing plate, accuracy of positions or angles of the liquid ejecting heads fixed to the common fixing plate is lowered, and accuracy of a landing position of ink is lowered, thereby lowering print quality.

In addition, in the ink jet-type recording head unit according to JP-A-2012-111097, the ink jet-type recording head and a frame body are fixed to each other with a gap formed therebetween. This is because there is a need to have a clearance for positioning the ink jet-type recording head with respect to the frame body such that the ink jet-type recording head is detachably fixed to the frame body.

Lint from a medium, or the like, may be attached and concentrated between the frame body and the ink jet-type recording head of the ink jet-type recording head unit, and mist generated when ink is ejected, or ink when wiping of a nozzle surface is performed, is attached to the concentrated lint, thereby causing the ink to remain. Hence, a problem arises in that the remaining ink falls on a medium at an unexpected timing and contaminates the medium.

Therefore, the gap between the frame body and the ink jet-type recording head is cleaned with a fiber member such as a cotton swab or cloth, thereby removing the lint and the ink attached on the lint. However, a problem arises in that there is a concern that the fiber member will be caught on an end portion of the fixing plate, and the fixing plate will be broken, for example, deformed or peeled off.

Then, the broken ink jet-type recording head is replaced, which results in a cost increase and increased downtime when printing is not performed until replacement. In addition, when the ink jet-type recording head is replaced, the color is likely to be changed from that on a printed material produced before the replacement, and thus a problem arises in that it is difficult to perform the replacement with the ink jet-type recording head which produces the same color.

Such problems do not arise only in a head unit that ejects ink, but also arise in a head unit that ejects other liquids.

SUMMARY

The invention can be realized in the following forms or aspects.

Aspect 1

According to one aspect of the invention, there is provided a liquid ejecting head unit including: a fixing plate provided with a plurality of openings; a plurality of heads, each of which is provided for each of the openings; and a channel holder that is provided with a plurality of channels and that accommodates the plurality of heads in cooperation with the fixing plate. Each of the plurality of heads has a nozzle plate provided with a nozzle row having a plurality of nozzles and a channel substrate provided with a channel through which the channel of the channel holder communicates with the nozzle. The head is fixed to a first surface of the fixing plate. The head has an ejection surface defined by a second surface of the fixing plate and the nozzle plate. The fixing plate has a plurality of sets, each of which has the plurality of openings. The openings constituting each of the sets are disposed to be partly overlapped in a Y direction in which the nozzle rows are arranged, and the openings are disposed not to be overlapped in an X direction orthogonal to the Y direction.

In this configuration, the plurality of heads are aligned at a position on and fixed to the fixing plate by which the ejection surface is defined in cooperation with the nozzle plate, thereby making it possible to increase a range of a region in which the nozzle rows are disposed in distribution, both in the X direction and the Y direction, and making it possible to widen a region which can be covered with ink droplets ejected at once. Since heads are fixed to the one fixing plate, it is possible to decrease the size of the head unit in the X direction and the Y direction even when the nozzle row is elongated in the Y direction and multiple rows are disposed in the X direction. Accordingly, since the size is decreased and it is possible to realize elongation of the nozzle rows and multiple rows, it is possible to dispose the nozzle rows in high density. Further, since the heads are fixed to the one fixing plate and the ejection surface is defined, it is possible to dispose the heads with small variations in the ejection surface and with high accuracy, compared to a configuration in which heads are fixed to a plurality of fixing plates. Further, since the nozzle plate configuring the ejection surface is directly fixed to the fixing plate, it is possible to achieve a small paper gap, compared to a configuration in which heads are fixed to a fixing plate through a cover head or the like, which protects a nozzle plate as in the related art. Accordingly, since it is possible to achieve the small variations in the ejection surface and the small paper gap, the head unit can eject a liquid with high accuracy.

Aspect 2

In the liquid ejecting head unit according to Aspect 1, it is preferable that the channel holder has a guide section that projects in the Y direction, and that guides a cap which covers the nozzles. In this configuration, the cap is positioned by the guide section of the channel holder, thereby making it possible to reduce impact or pressure due to the positioning of the cap, which is applied to the head, and to reduce a positional shift of the head.

Aspect 3

It is preferable that the liquid ejecting head unit according to Aspect 1 or 2, further includes: a circuit board provided with a plurality of wiring openings. It is preferable that each of the plurality of heads is electrically connected to the circuit board via a cable inserted into each of the wiring openings, and the wiring openings corresponding to the set of openings of the fixing plate, of the plurality of wiring openings, are disposed at a distance from each other in the Y direction. In this configuration, it is possible to achieve high flexibility of routing of wiring on the circuit board.

Aspect 4

In the liquid ejecting head unit according to Aspect 3, it is preferable that each of the plurality of cables are fixed to the circuit board on only one of one side and the other side in the X direction with respect to the wiring opening. It is preferable that the plurality of cables includes a first cable group that passes through the wiring openings at the same position in the Y direction, and that is fixed to the circuit board on the one side, and a second cable group that passes through the wiring openings at the same position in the Y direction, and that is fixed to the circuit board on the other side. It is preferable that the first cable group and the second cable group is partly overlapped in the Y direction. In this configuration, since the wiring on the circuit board is collectively grouped on the basis of the first cable group and the second cable group, it is possible to simplify the wiring on the circuit board.

Aspect 5

In the liquid ejecting head unit according to Aspect 3 or 4, it is preferable that a width of the cable on an input side that is connected to the circuit board is narrower than a width of the cable on an output side that is connected to the head. In this configuration, the opening width of the wiring opening into which the cable is inserted can be narrower than the width of the cable on the output side. In this manner, it is possible to widen the space between the wiring openings and it is possible to further improve the flexibility of routing of the wiring on the circuit board.

Aspect 6

It is preferable that the liquid ejecting head unit according to any one of Aspects 1 to 5, further includes: a reinforcement plate that is stacked on the fixing plate, is provided with a plurality of through-holes into which the heads are inserted, and is thicker than the fixing plate. In this configuration, it is possible to reinforce the fixing plate without causing the fixing plate to be thicker. In addition, the reinforcement plate is not interposed between the head and the fixing plate. Hence, it is possible to decrease the size in a stack direction (Z direction intersecting with the X direction and the Y direction) of the fixing plate and the reinforcement plate. In addition, the positional accuracy in the stack direction of the nozzle plates of the respective heads is defined only by the fixing plate without an effect of the reinforcement plate thereon. In this manner, the fixing plate is improved in rigidity due to the reinforcement plate, and it is possible to perform positioning in the stack direction of the ejection surface with high accuracy.

Aspect 7

In the liquid ejecting head unit according to Aspect 6, it is preferable that the through-hole of the reinforcement plate has a first inner circumferential surface with a first space as a space from the head, and a second inner circumferential surface with a second space as a space from the head, which is wider than the first space, and an adhesive is provided to be in contact with the second inner circumferential surface. In this configuration, it is possible to more firmly fix the head. In addition, since it is possible to have the narrow first space, it is possible to have a narrower width of the edge section of the opening in the fixing plate which is not reinforced by the fixing plate. In this manner, there is low concern that the edge section of the opening of the fixing plate will bend, and it is possible to maintain flatness of the fixing plate.

Aspect 8

In the liquid ejecting head unit according to any one of Aspects 1 to 7, it is preferable that the fixing plate has a bottom section formed of the first surface and the second surface, and a rounded section that is rounded from the second surface toward the first surface.

In this configuration, the rounded portion is provided, thereby making it possible to suppress sharpness of the edge of the fixing plate, and to reduce scratching, wearing away, and damage, due to contact with a sharp edge, to a wiping unit that wipes the discharge surface. In addition, the bottom section and the edge section are provided in the fixing plate, and the fixing plate is not formed by drawing. Therefore, it is possible to improve the flatness of the bottom section, and it is possible to reduce the positional variations of the plurality of heads in the discharge direction, which are fixed to the fixing plate, and variations in an angle inclined with respect to the discharge direction.

Aspect 9

In the liquid ejecting head unit according to Aspect 8, it is preferable that the fixing plate has a side surface section extending from the bottom section, and the bottom section is surrounded by the side surface section and the rounded section. In this configuration, it is possible to reduce occurrence of the deformation or peeling off of the fixing plate due to the contact of a medium with the side surface section.

Aspect 10

In the liquid ejecting head unit according to Aspect 9, it is preferable that the channel holder has a recessed section in which the side surface section is accommodated. In this configuration, the side surface section in a counter-moving direction of the wiping unit that wipes the nozzle surface is accommodated at least in the recessed section, and thereby almost the entirety of the edge of the side surface section is accommodated in the recessed section and is not exposed. Therefore, it is possible to reduce scratching, wearing away, and damage, which are produced when the wiping unit comes into contact with the edge of the side surface.

Aspect 11

In the liquid ejecting head unit according to any one of Aspects 8 to 10, it is preferable that the channel holder has a wall section that projects from the first surface to the second surface, and that projects outward from the bottom section of the fixing plate in an in-plane direction of the second surface. In this configuration, it is possible to reduce occurrence of contact of the wiping unit with the end portion of the rounded portion.

Aspect 12

According to another aspect of the invention, there is provided a liquid ejecting head module including: the liquid ejecting head unit according to any one of Aspects 1 to 11; and a frame body provided with an exposure opening through which the ejecting surface is exposed. The fixing plate has a bottom section formed of the first surface and the second surface, and a side surface section extending from the second surface side toward the first surface side of the bottom section. The head is fixed to the first surface of the fixing plate, on the second surface side from the channel substrate. The exposure opening is defined by a facing surface facing the side surface section. The frame body exposes the second surface of the fixing plate in a state in which the facing surface and the fixing plate are separated by a gap therebetween. A height of the side surface section is higher than a height of the facing surface of the frame body.

Otherwise, there is provided a liquid ejecting head module including: a liquid ejecting head unit having a liquid ejecting surface from which a liquid is ejected; and a frame body provided with an exposure opening through which the liquid ejecting surface is exposed. The liquid ejecting head unit includes a fixing plate that has a bottom section having a first surface and a second surface, a side surface section extending from the second surface side toward the first surface side of the bottom section, and that is provided with an opening in the bottom section, a head, and a channel holder that is provided with a channel and that supplies a liquid to the head. The head includes a nozzle plate provided with a nozzle row and a channel substrate that is stacked on the nozzle plate, and is provided with a channel communicating with the channel of the channel holder. The head is fixed to the first surface of the fixing plate, on the second surface side from the channel substrate. The nozzle plate and a second surface of the fixing plate defines an ejection surface The exposure opening is defined by a facing surface facing the side surface section. The frame body exposes the second surface of the fixing plate in a state in which the facing surface and the fixing plate are separated by a gap therebetween. The height of side surface section is the height of higher than the facing surface of the frame body.

In this configuration, the height of the side surface section of the fixing plate is higher than the height of the facing surface of the frame body, thereby making it possible to reduce occurrence of a fiber member being caught on the end section of the side surface section, and to reduce deformation and breaking of the fixing plate when the gap between the side surface section and the frame body is cleaned with the fiber member so as to remove lint accumulated in the gap and a liquid attached on the lint.

Aspect 13

In the liquid ejecting head module according to Aspect 12, it is preferable that the height of the side surface section is higher than a height of a fixing surface between the channel holder and the head. In this configuration, since the side surface section is sufficiently high, it is difficult for the fiber member to be caught on the end section of the side surface section. In addition, even when a boundary as the fixing surface between the channel holder and the head is exposed on a side surface, it is possible to protect the fixing surface by covering the fixing surface with the side surface section. In addition, since the side surface of the head is covered with the side surface section, it is possible to reduce occurrence of direct contact of the medium with the side surface of the head.

Aspect 14

In the liquid ejecting head module according to Aspect 12 or 13, it is preferable that the side surface section of the fixing plate is joined to the channel holder. In this configuration, the fixing plate is improved in strength, and thus it is possible to reduce deformation or peeling off of the fixing plate.

Aspect 15

In the liquid ejecting head module according to any one of Aspects 12 to 14, it is preferable that the bottom section is surrounded on four sides by first side surface sections in the Y direction, and second surface sections in the X direction of the side surface section. It is preferable that a height of the first side surface section is higher than the height of the facing surface, and the second side surface section is higher than a fixing surface between the head and the channel holder.

In this configuration, since the side surface sections are provided on the four sides of the fixing plate, it is possible to reduce occurrence of the contact of the medium with the joined portion between the fixing plate and the head. In addition, a height of the second side surface section of the fixing plate is set to be lower than a height of the fixing surface between the head and the channel holder, thereby making it possible to reduce interference, with the second surface section, of a jig that holds the head when the head is positioned to the fixing plate, and to position the head with high accuracy.

Aspect 16

In the liquid ejecting head module according to Aspect 15, it is preferable that the channel holder has a guide section that projects outward in the Y direction from the second side surface section, and that guides a cap which covers the nozzles. In this configuration, the cap is positioned by the guide section of the channel holder, thereby making it possible to reduce impact or pressure produced due to the positioning of the cap, which is applied to the head, and making it possible to reduce positional shift of the head.

Aspect 17

In the liquid ejecting head module according to any one of Aspects 12 to 16, it is preferable that the liquid ejecting head unit has the liquid ejecting head unit according to any one of Aspects 1 to 10. In this configuration, it is possible to achieve the effects of the liquid ejecting head unit according to any one of Aspects 1 to 10.

Aspect 18

According to still another aspect of the invention, there is provided a liquid ejecting apparatus including: the liquid ejecting head unit according to any one of Aspects 1 to 11; and a carriage that performs a relative reciprocating movement in the X direction between the medium and the liquid ejecting head unit.

In this configuration, it is possible to provide the liquid ejecting apparatus in which the plurality of liquid ejecting head units can be disposed with high accuracy, and the plurality of liquid ejecting head units can be disposed in high density.

Aspect 19

It is preferable that the liquid ejecting apparatus according to Aspect 18, further includes: a cap that seals the same set of openings of the plurality of openings of the fixing plate; and a negative pressure mechanism that causes a pressure in the cap to be changed to a negative pressure. It is preferable that the heads corresponding to the set of openings in the fixing plate, of the plurality of heads, are supplied with a liquid from a common supply source. It is preferable that the plurality of sets of openings in the fixing plate are not overlapped to one another in the X direction. In this configuration, it is possible to reduce the size of the cap.

Aspect 20

According to still another aspect of the invention, there is provided a liquid ejecting apparatus including: the liquid ejecting head module according to any one of Aspects 12 to 19; and a carriage mechanism that allows the medium and the liquid ejecting head module to perform a relative reciprocating movement, in the second direction orthogonal to the first direction in which the nozzle rows are arranged.

In this configuration, it is possible to eject a liquid widely to a medium in the second direction by the carriage mechanism, using a small-sized liquid ejecting head module. In addition, it is possible to realize the liquid ejecting apparatus in which contamination of the medium is reduced and downtime is shortened.

Aspect 21

According to still another aspect of the invention, there is provided a method of manufacturing a liquid ejecting head unit in which the liquid ejecting head includes a fixing plate provided with a plurality of openings, a plurality of heads, each of which is provided for each of the openings, and a channel holder that is provided with a plurality of channels and that accommodates the plurality of heads in cooperation with the fixing plate. The fixing plate has a bottom section formed of a first surface and a second surface, and a rounded section that is rounded from the second surface toward the first surface. Each of the heads has a nozzle plate provided with a nozzle row having a plurality of nozzles from which a liquid is ejected and a channel substrate provided with a channel through which the channel of the channel holder communicates with the nozzle. The head is fixed to the first surface of the bottom section of the fixing plate, and the head has a discharge surface defined by the second surface of the fixing plate and the nozzle plate. The method of manufacturing a liquid ejecting head unit includes: providing the opening in a plate-shaped member; cutting an edge which becomes the side surface section of the fixing plate from the plate-shaped member; cutting an edge which becomes the rounded portion from the plate-shaped member; forming the rounded portion on the plate-shaped member; bending a region of the plate-shaped member, which becomes the side surface section and forming the fixing plate; fixing the plurality of heads to the first surface of the fixing plate; and fixing the fixing plate, to which the plurality of heads are fixed, to the channel holder.

In this configuration, the fixing plate is punched, and then the region which becomes the side surface section is bent, thereby making it possible to improve flatness of the bottom section, compared to the drawing.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

Hereinafter, the invention will be described in detail based on an embodiment. In the present embodiment, an ink jet-type recording head unit (hereinafter, referred to as a head unit) that ejects ink is described as an example of a liquid ejecting head unit. In addition, an ink jet-type recording apparatus, in which the head unit is mounted, is described as an example of a liquid ejecting apparatus.

Figure 1:
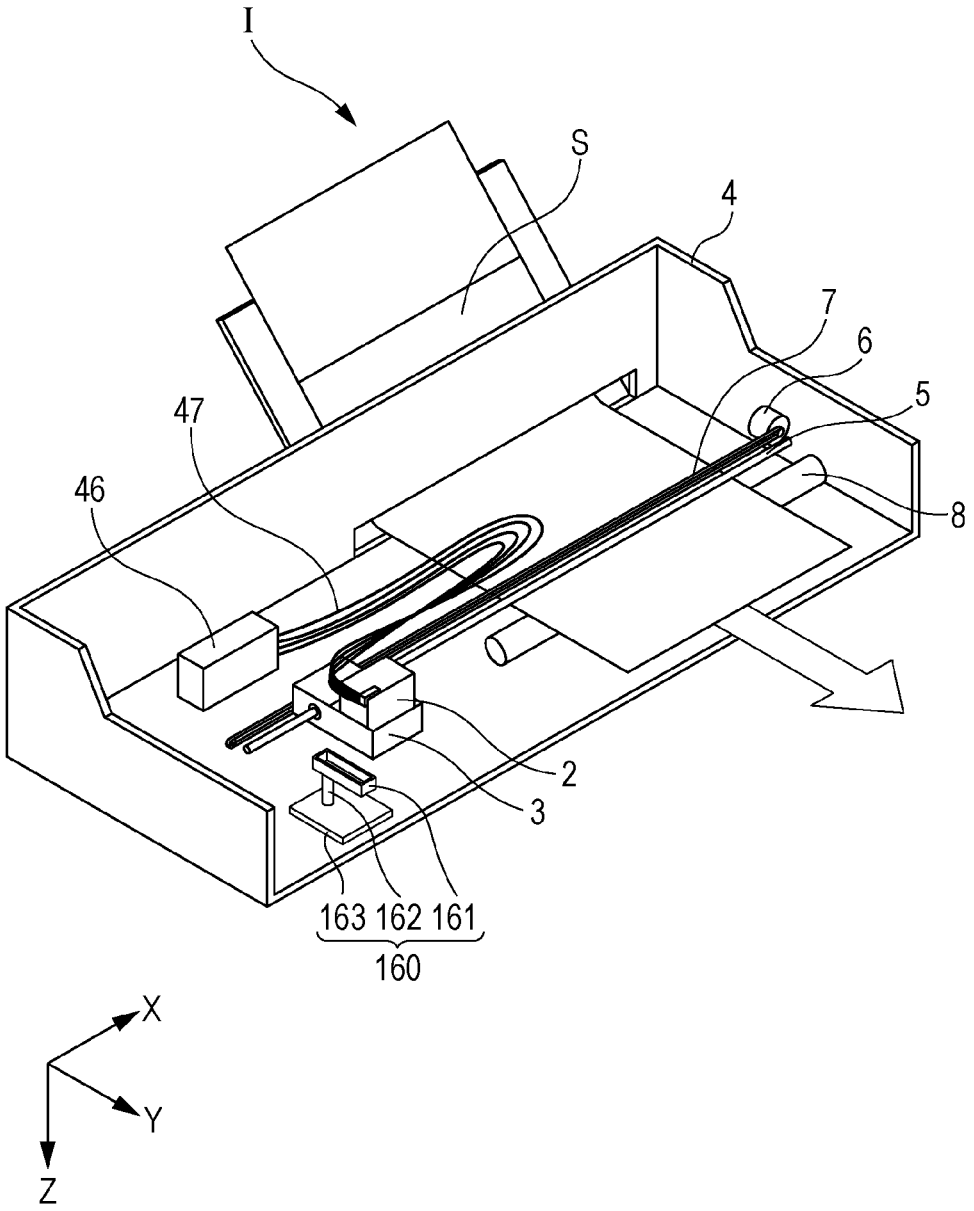
FIG. 1 is a view schematically illustrating an ink jet-type recording apparatus.

FIG. 1 is a view schematically illustrating an ink jet-type recording apparatus according to the present embodiment.

An ink jet-type recording apparatus I includes a head unit 2. The head unit 2 which will be described in detail below includes a plurality of heads having a nozzle from which ink is ejected. The head unit 2 is mounted on a carriage 3. The carriage 3 is a member that performs a relative reciprocating movement in an X direction between a medium S and the head unit 2. In the present embodiment, the carriage 3 is provided to be able to perform the reciprocating movement in an axial direction of a carriage shaft 5 attached to an apparatus main body 4. In the present embodiment, the X direction is a movement direction of the carriage 3 and, hereinafter, is referred to as a first direction X.

A drive force of a drive motor 6 is transmitted to the carriage 3 though a plurality of gears (not illustrated) and a timing belt 7, thereby causing the carriage 3, on which the head unit 2 is mounted, to move along the carriage shaft 5. On the one hand, a transport roller 8 is provided as a transport unit in the apparatus main body 4 such that the medium S such as paper is transported by the transport roller 8. In the present embodiment, the medium S is transported by the transport roller 8 in a second direction Y (Y direction in claims) orthogonal to the first direction X. The transport unit that transports the medium S is not limited to the transport roller, but may be a belt, a drum, or the like.

In addition, in the present embodiment, a direction orthogonal to both the first direction X and the second direction Y is referred to as a third direction Z. Further, in the present embodiment, the respective directions (X, Y, and Z) are orthogonal to each other, but the respective directions may not be necessarily orthogonal to each other. In the drawings, a direction from the origin of each direction to the tip of a depicted arrow is referred to as a positive direction and a direction opposite thereto is referred to as a negative direction. In addition, the tip side of a depicted arrow is referred to as a positive direction in each direction and a direction opposite thereto is referred to as a negative direction. In the present embodiment, the negative direction side in the first direction X is a home position side on which the carriage 3 is disposed when printing is not performed or the like, and the positive direction is the opposite side thereto. The negative direction side in the second direction Y is a side on which the medium S is fed, and the positive direction side is a side on which the medium S is discharged. The positive direction side in the third direction Z is an ejection surface side on which the head unit 2 ejects ink, and the negative direction side is a side opposite thereto.

A liquid supply unit 46 (an example of a supply source in claims) such as an ink tank, in which ink as a liquid is stored, is connected to the head unit 2 in which the carriage 3 is mounted, via a supply tube 47 such as a tube. Further, in the present embodiment, the liquid supply unit 46 is connected to the head unit 2 through the supply tube 47; however, the configuration is not limited thereto, and the liquid supply unit 46 such as an ink cartridge may be mounted on the carriage 3 together with the head unit 2.

In addition, in a non-printing region which is an end portion of the carriage in the movement direction of the carriage 3, there is provided a negative pressure mechanism 160 that suctions ink, bubbles, or the like, in a channel of the head unit 2 from a nozzle that is provided in the head unit 2 and that discharges ink. The negative pressure mechanism 160 is a device that causes a pressure in a cap 161, which covers the nozzles provided in each head of the head unit 2, to become negative pressure. More specifically, the negative pressure mechanism includes the cap 161, and a suction member 163 such as a vacuum pump connected to the cap 161 via a suction tube 162. In addition, the cap 161 is provided so as to be movable in the third direction Z. Specifically, the movement of the cap 161 can be performed by a movement unit such as a drive motor or an electromagnet (not illustrated). Such a movement unit enables the cap 161 to abut on the ejection surface in which the nozzles are opened.

By the movement unit described above, the negative pressure mechanism 160 having such a configuration causes the cap 161 to abut on the ejection surface, in which the nozzles of the head unit 2 are opened, and causes the suction member 163 to perform the suction operation. When the suction member 163 performs the suction operation, the pressure in the cap 161 is changed to a negative pressure, and the ink in the channel of the head is suctioned along with the bubbles from the nozzles of the head of the head unit 2. Through such a suction operation, sediment produced in each head of the head unit 2, or the like, can be discharged from the nozzles. In addition, without performing the suction operation, drying of the nozzle may be suppressed by sealing the nozzles with the cap 161 during non-printing time.

In the ink jet-type recording apparatus I, a control device (not illustrated), which controls an operation of the ink jet-type recording apparatus I, is provided. The control device is a device that controls an operation of the head unit 2, or an operation of the negative pressure mechanism 160 or the like.

Figure 2:
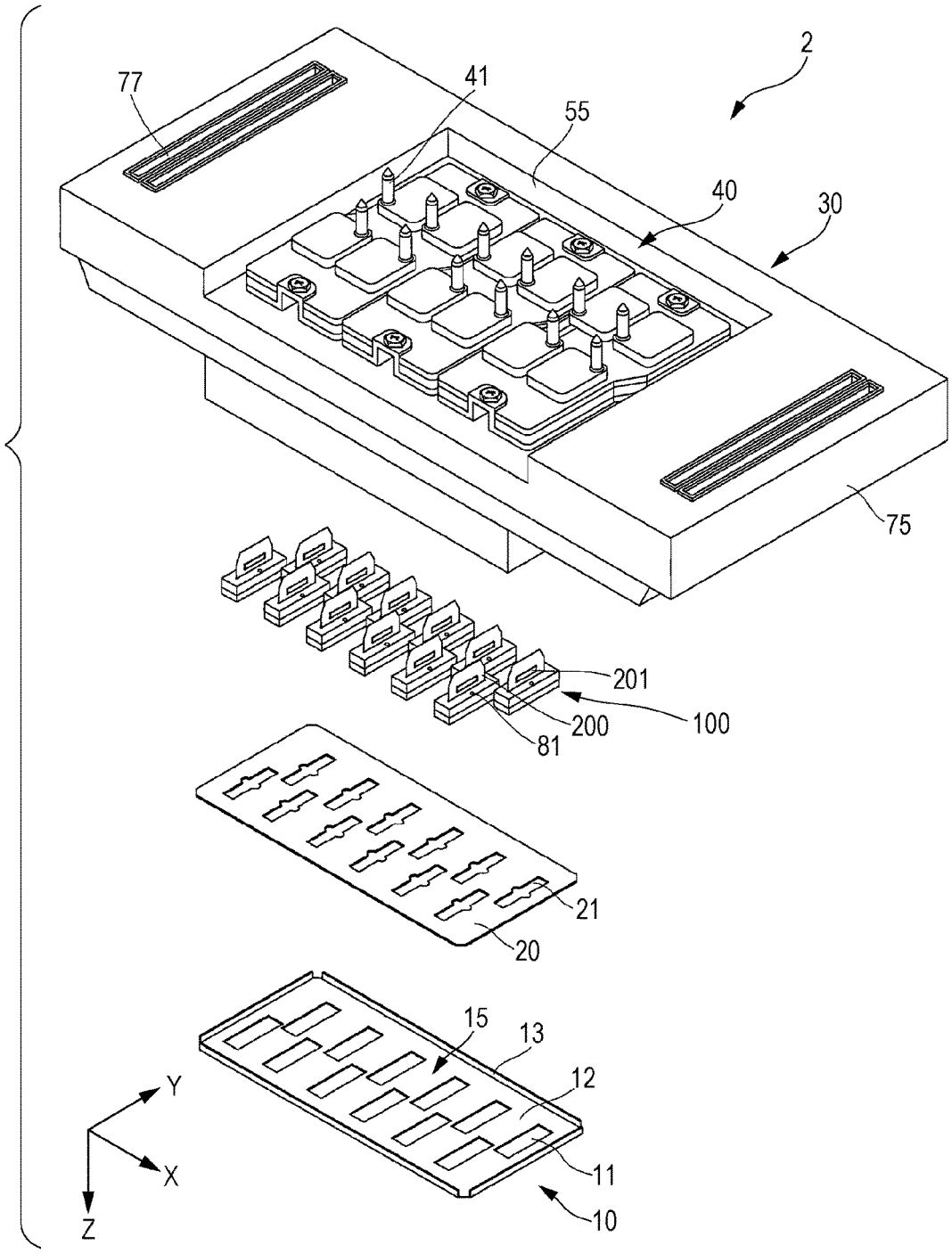
FIG. 2 is an exploded perspective view illustrating a head unit.
Figure 3:
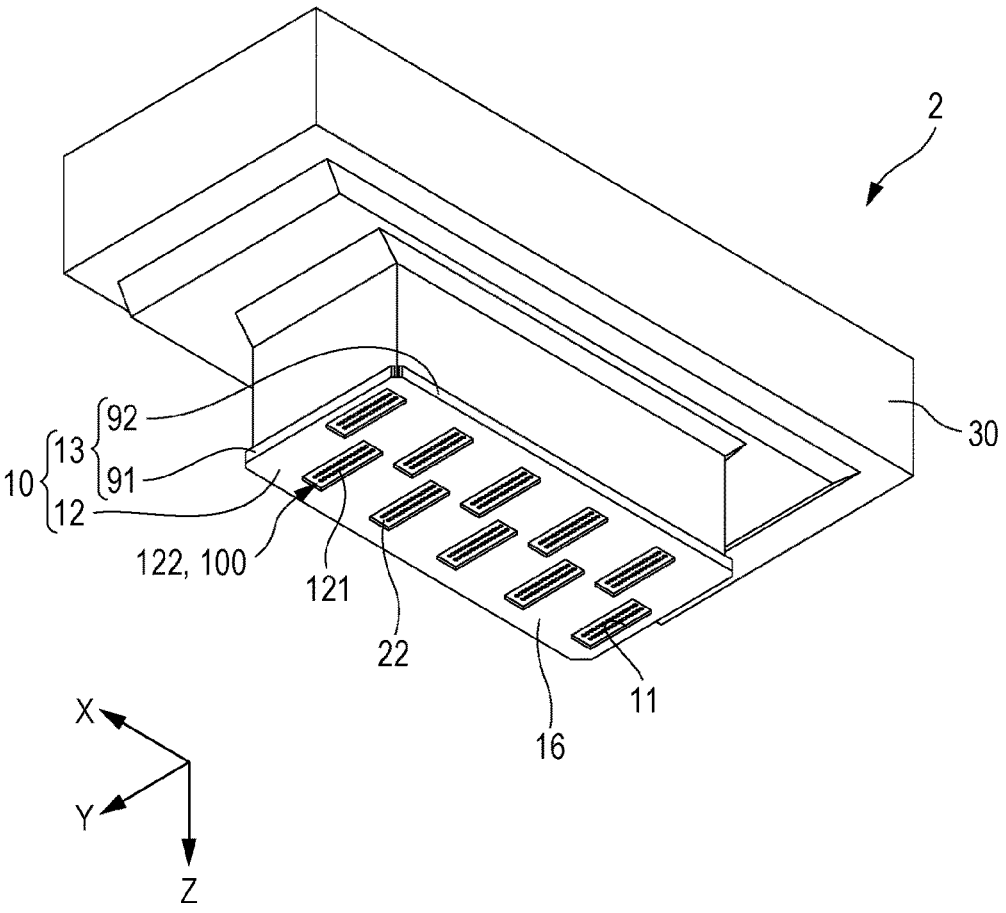
FIG. 3 is a perspective view of the head unit.
Figure 4:
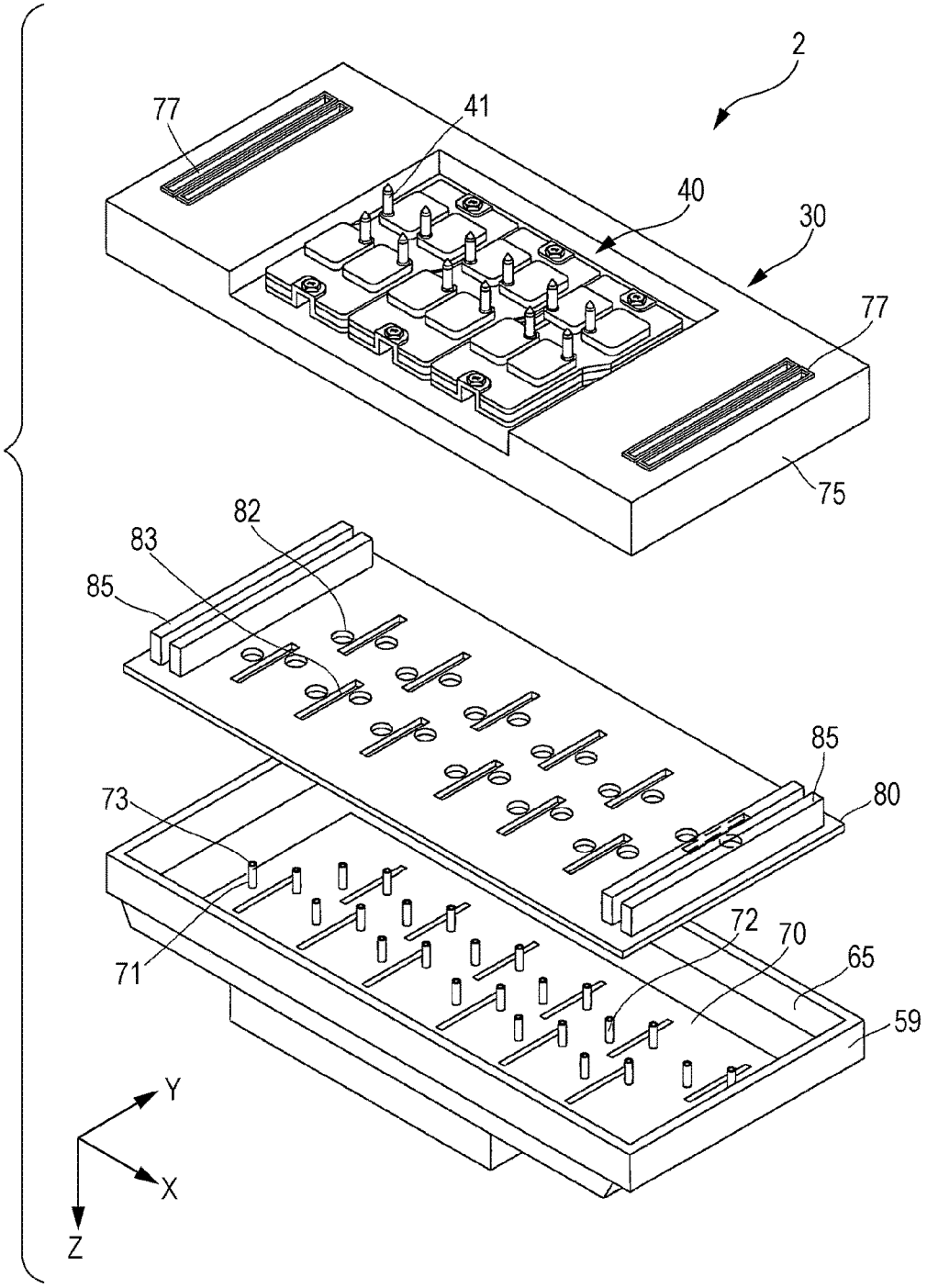
FIG. 4 is an exploded perspective view illustrating a channel holder.
Figure 5:
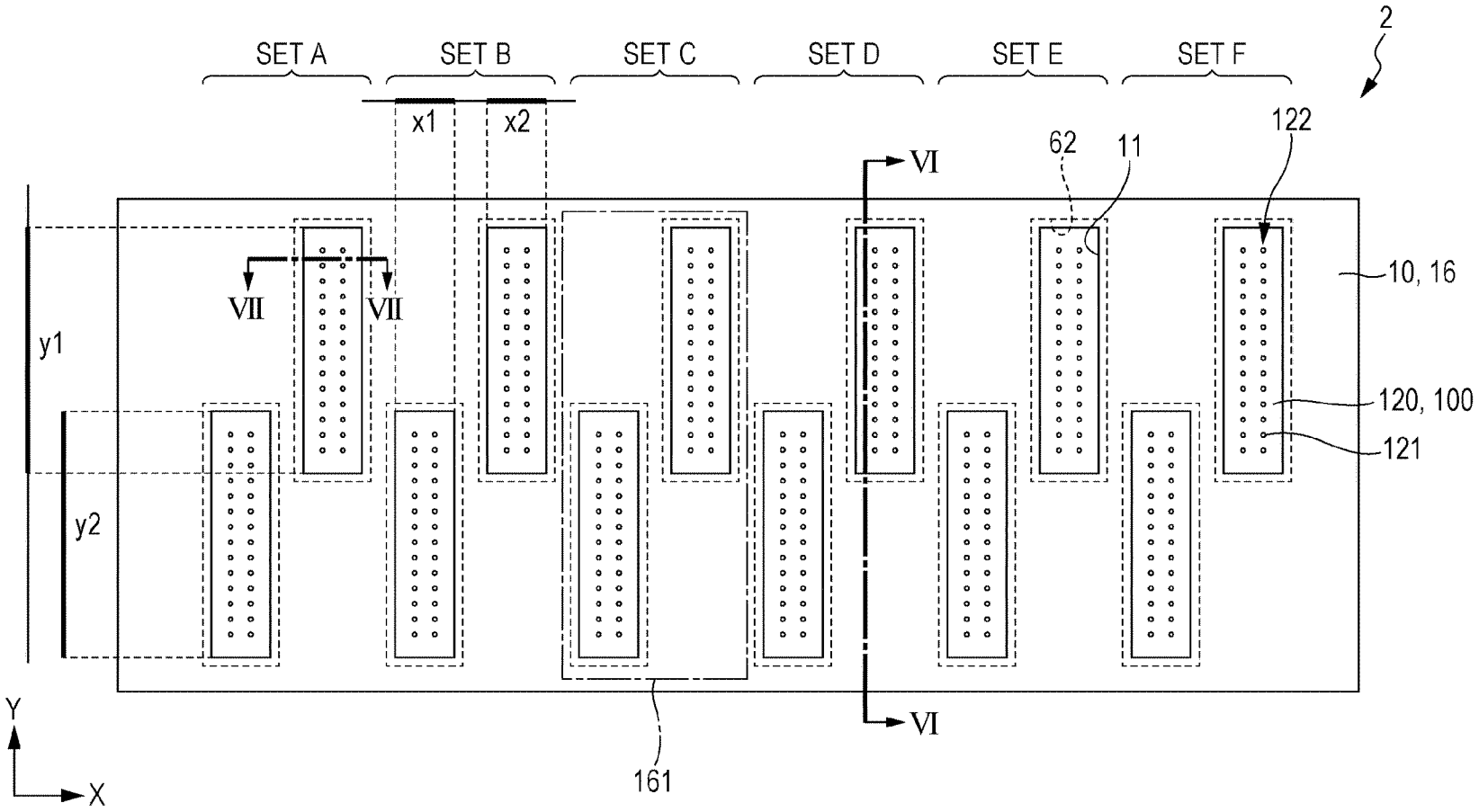
FIG. 5 is a bottom view of the head unit.
Figure 6:
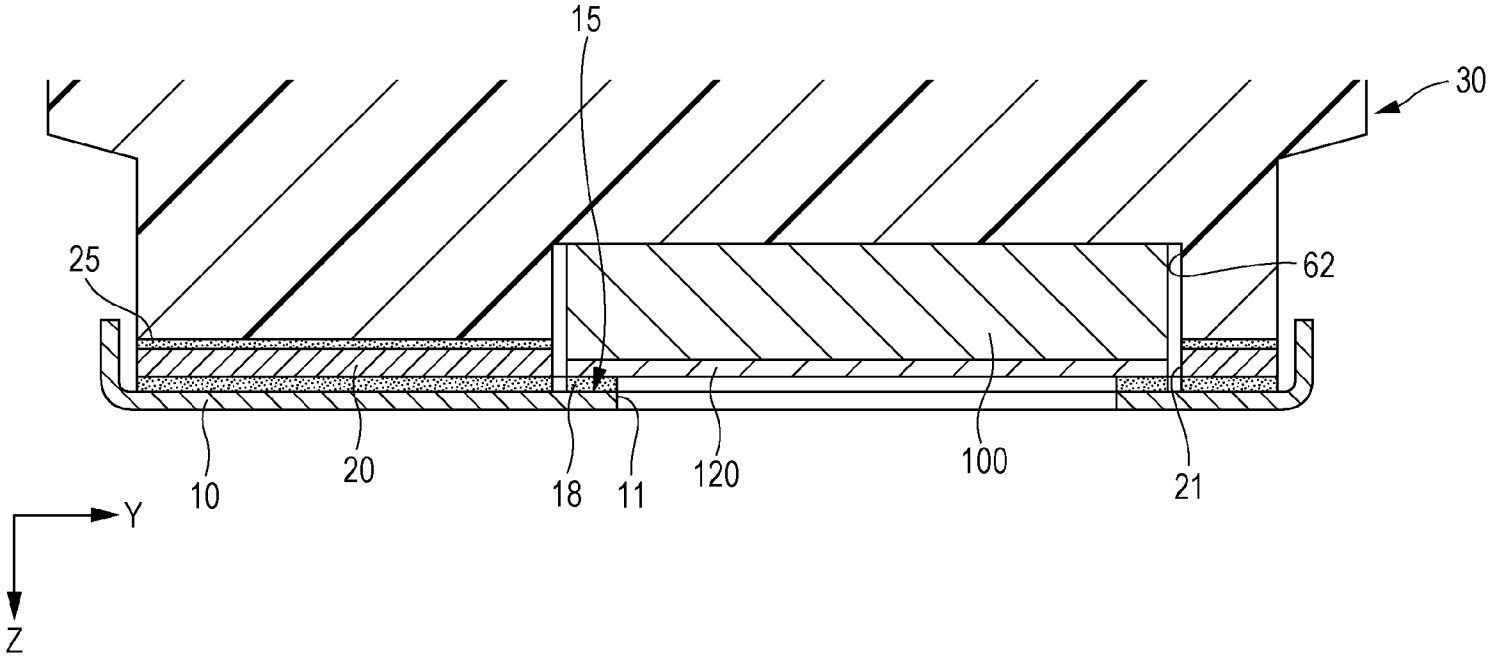
FIG. 6 is a sectional view taken along line VI-VI in FIG. 5.
Figure 7:
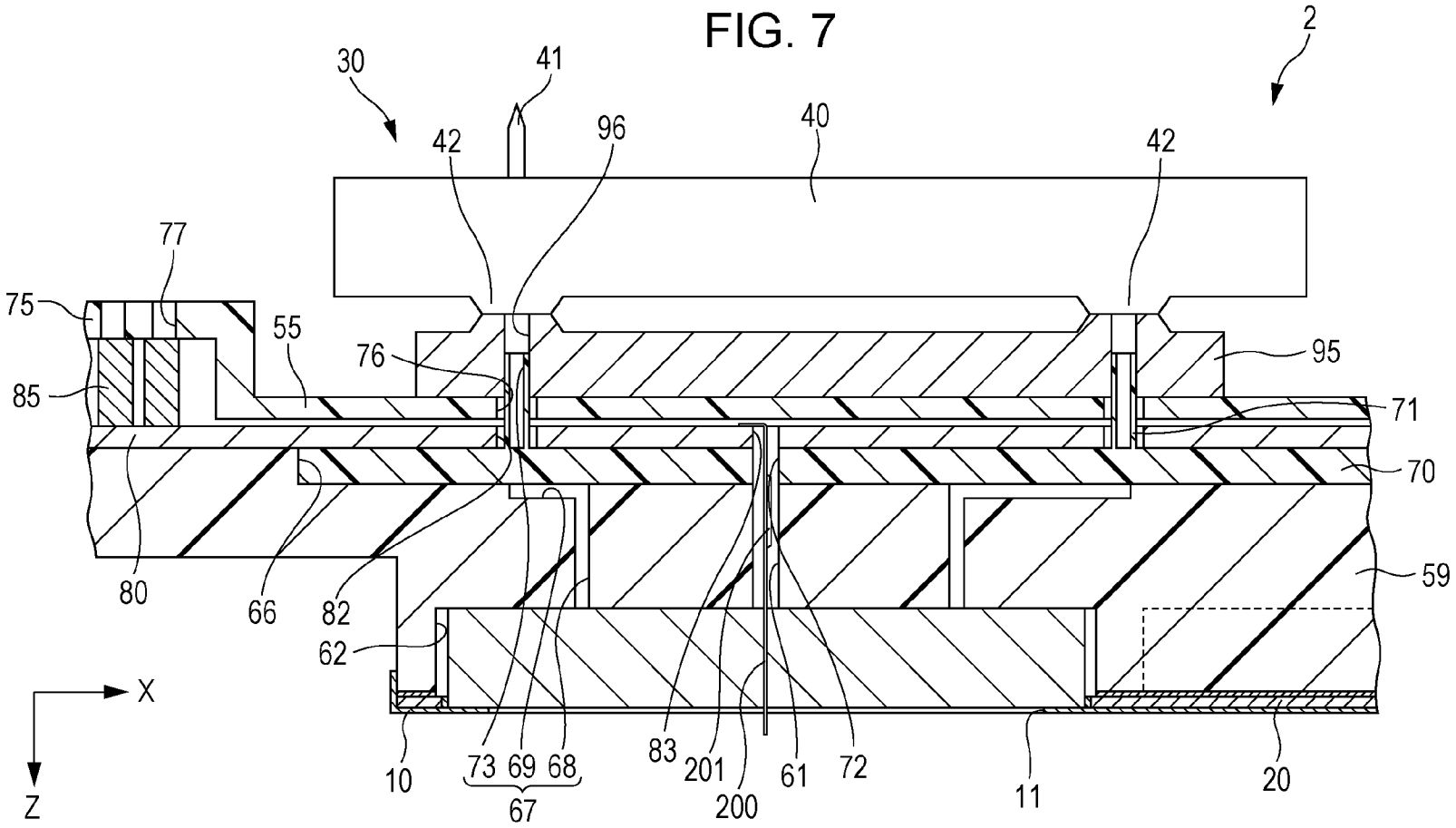
FIG. 7 is a sectional view taken along line VII-VII in FIG. 5.
Figure 8:
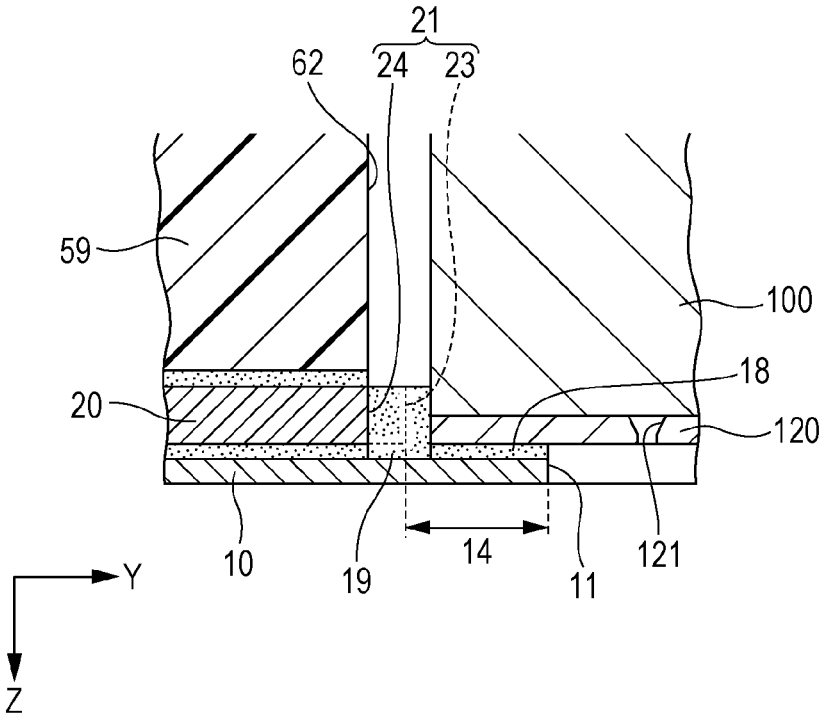
FIG. 8 is an enlarged sectional view of a part in FIG. 7.
Figure 9:
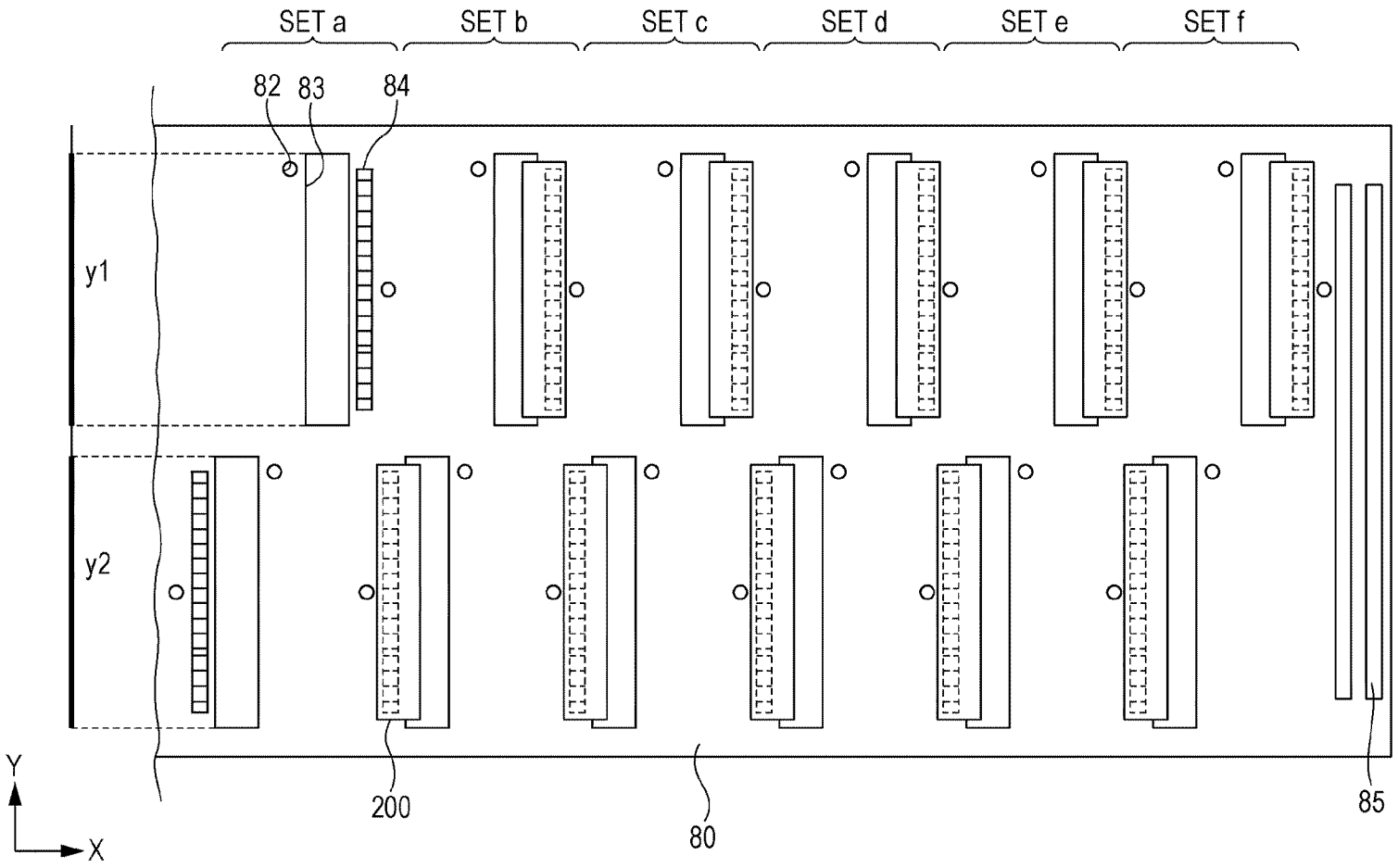
FIG. 9 is a plan view of a circuit board.
Figure 10:
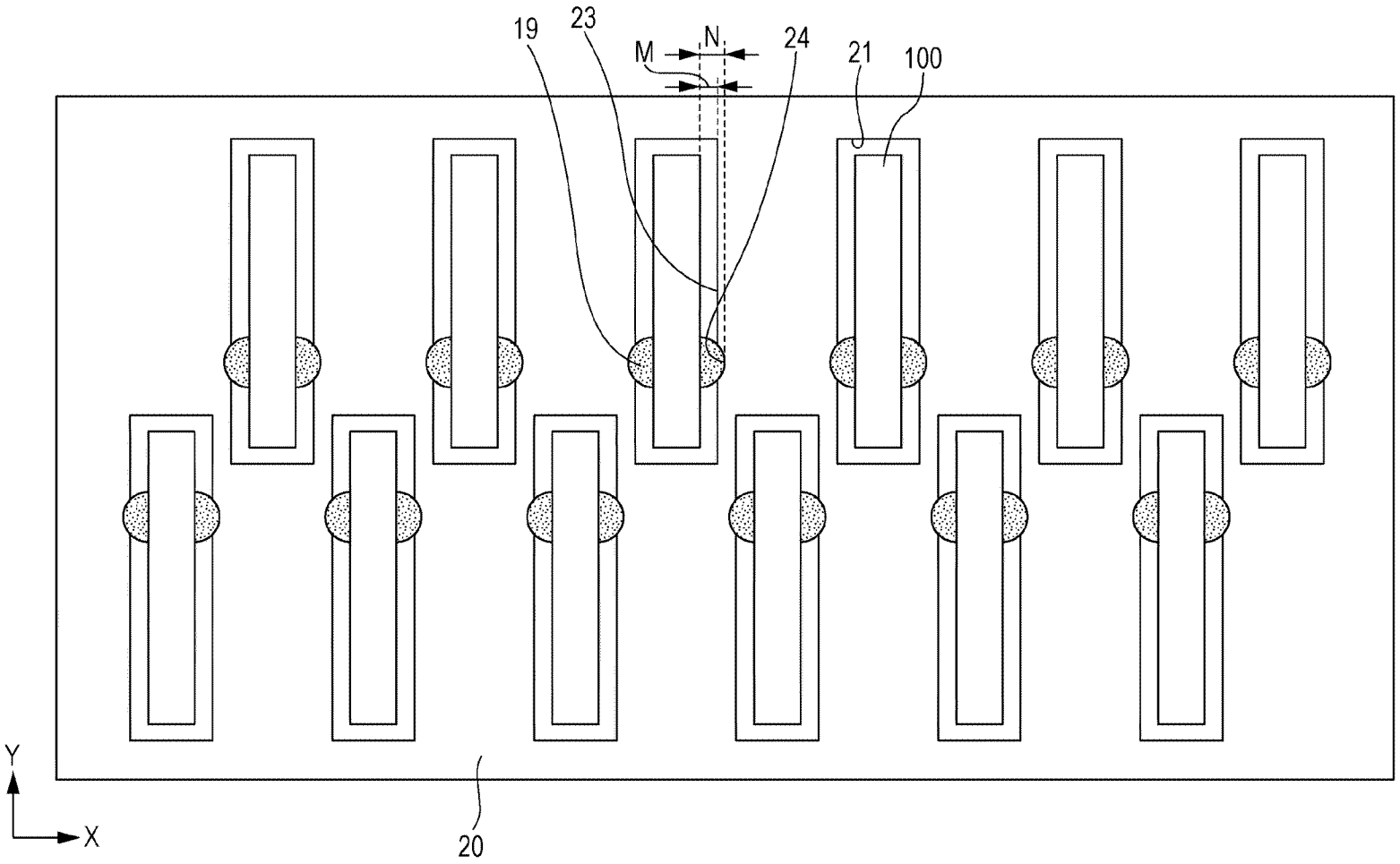
FIG. 10 is a plan view of a reinforcement plate.

Here, an example of the head unit 2 is described with reference to FIGS. 2 to 10. FIG. 2 is an exploded perspective view illustrating the head unit according to the present embodiment. FIG. 3 is a perspective view of the head unit. FIG. 4 is an exploded perspective view illustrating a channel holder. FIG. 5 is a bottom view of the head unit. FIG. 6 is a sectional view taken along line VI-VI in FIG. 5. FIG. 7 is a sectional view taken along line VII-VII in FIG. 5. FIG. 8 is an enlarged sectional view of a part in FIG. 7. FIG. 9 is a plan view of a circuit board 80. FIG. 10 is a plan view of a reinforcement plate 20. FIG. 5 illustrates a fixing plate 10 and a nozzle plate 120 and a channel holder 30 is omitted in the drawing.

Further, in the present embodiment, the respective directions of the head unit 2 are described based on directions defined when the head unit is mounted in the ink jet-type recording apparatus I, that is, the first direction X, the second direction Y, and the third direction Z. It is needless to mention that the disposition of the head unit 2 in the ink jet-type recording apparatus I is not limited to the following example.

The head unit 2 of the present embodiment includes the fixing plate 10 provided with a plurality of openings 11, a plurality of heads 100, each of which is provided for each openings 11, the channel holder 30 in which a channel though which the ink is supplied to the respective heads 100, and which accommodates the plurality of heads 100 in cooperation with the fixing plate 10, the reinforcement plate 20 which is stacked on the fixing plate 10, and the circuit board 80.

Figure 12:
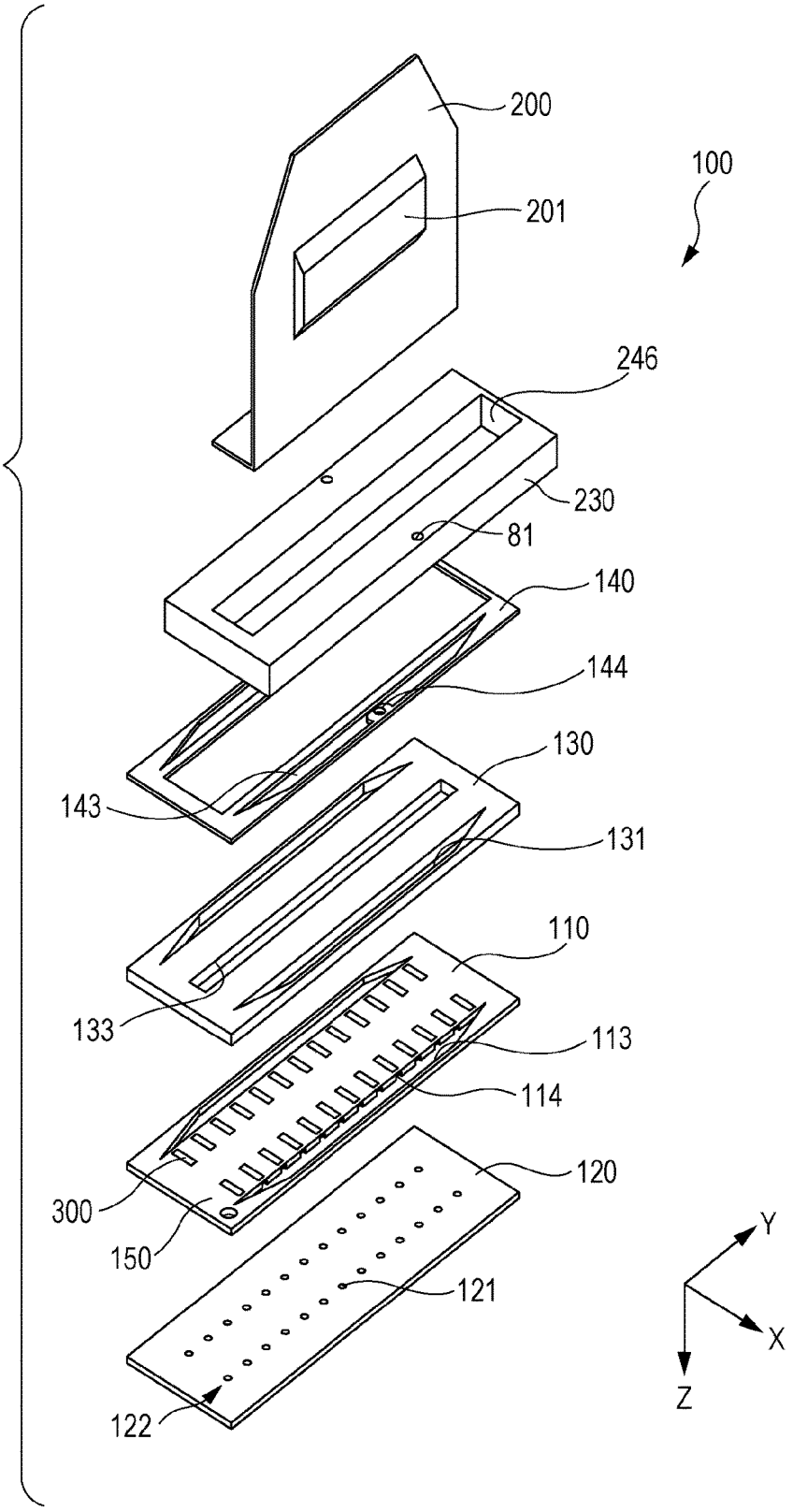
FIG. 12 is an exploded perspective view of a head.
Figure 13:
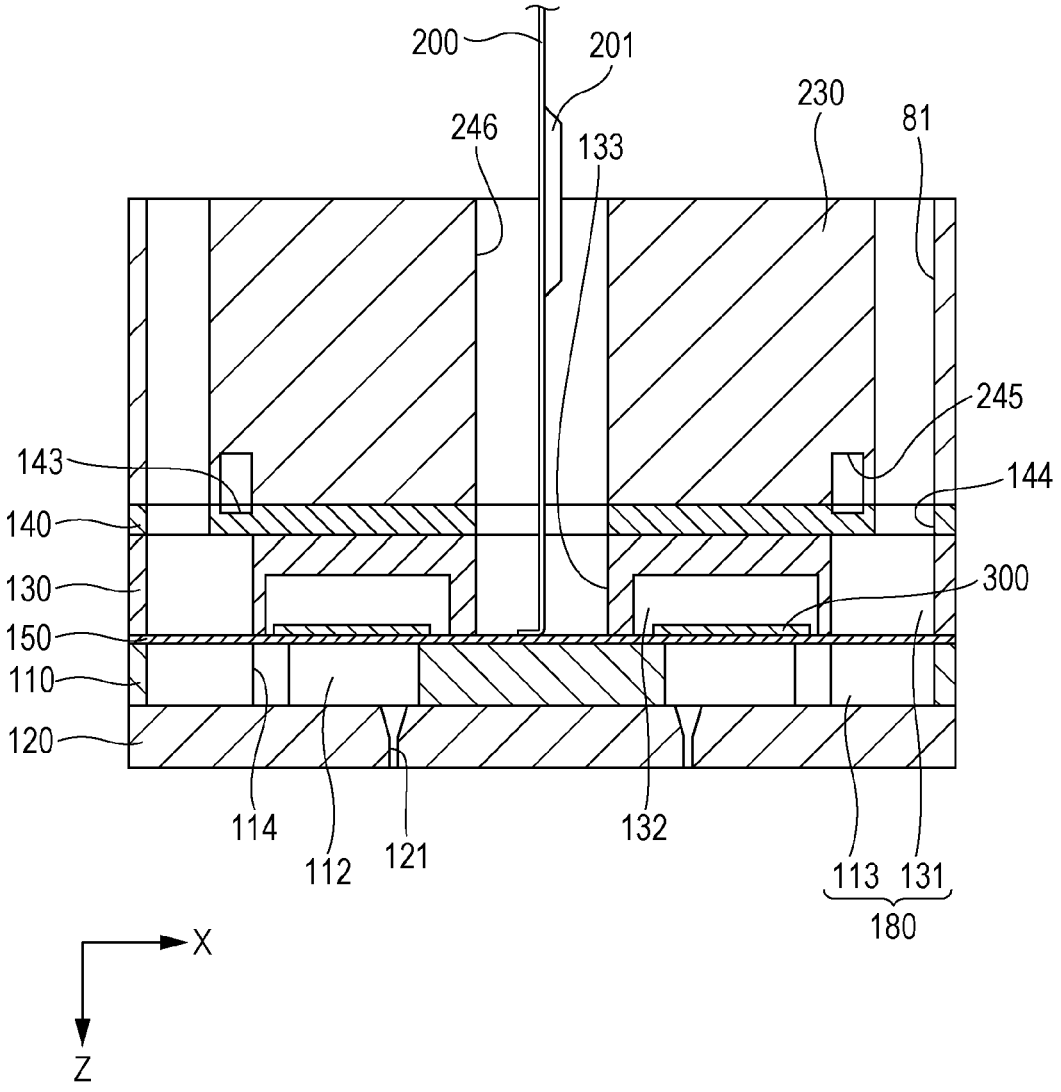
FIG. 13 is a sectional view of the head.

Here, the head 100 of the present embodiment is described with reference to FIGS. 12 and 13. FIG. 12 is an exploded perspective view of the head. FIG. 13 is a sectional view of the head.

The head 100 includes a channel substrate 110. A vibration plate 150 is formed on a surface of the channel substrate 110 on the negative direction side in the third direction Z. In the present embodiment, the channel substrate 110 is formed of a silicon single crystal substrate, and pressure generating chambers 112 divided by a plurality of partition walls are formed in the second direction Y by anisotropic etching performed on a surface on the positive direction side in the third direction Z. Two rows of the plurality of pressure generating chambers 112 in the second direction Y are formed in the first direction X. In addition, a communication section 113 is formed on an outer side of each row of the pressure generating chambers 112 in the first direction X. The communication section communicates with a manifold section 131 provided in a protection substrate 130 to be described below, and configures a manifold 180 which forms a common ink chamber of each of the pressure generating chambers 112. In addition, the communication section 113 communicates with one end portion of each of the pressure generating chambers 112 in the first direction X through an ink supply path 114.

A nozzle plate 120 adheres to the channel substrate 110 on the positive direction side in the third direction Z through an adhesive or a heat sealing film, and a nozzle 121 communicating with the ink supply path 114 of each of the pressure generating chamber 112 on the opposite side is drilled through the nozzle plate. In other words, two nozzle rows 122, in which the nozzles 121 are arranged in parallel in the second direction Y, are arranged in the first direction X in the one head 100.

A piezoelectric actuator 300 is formed on the channel substrate 110 on the negative direction side in the third direction Z, and the actuator is formed by stacking the first electrode formed of a conductive material, a piezoelectric layer formed of a piezoelectric material, and a second electrode formed of a conductive material on the vibration plate 150, in this order. The protection substrate 130 having the manifold section 131, which configures at least a part of the manifold 180, is joined on the channel substrate 110 in which such piezoelectric actuator 300 is formed. In the present embodiment, the manifold section 131 is formed to penetrate the protection substrate 130 in the third direction Z and to be continuous through the plurality of pressure generating chambers 112 in the second direction Y. Then, the manifold section communicates with the communication section 113 of the channel substrate 110 as described above so as to configure the manifold 180 which becomes the common ink chamber of the respective pressure generating chambers 112.

A piezoelectric actuator holding section 132 is provided in a region facing the piezoelectric actuator 300 of the protection substrate 130 so as to have a space formed to the extent that the piezoelectric actuator holding section does not interfere with motion of the piezoelectric actuator 300. Examples of a material of the protection substrate 130 include glass, ceramic, metal, plastics or the like and it is preferable that a material having substantially the same coefficient of thermal expansion as the channel substrate 110. In the present embodiment, the protection substrate 130 is formed of the same material of the silicon single crystal substrate as the channel substrate 110.

In addition, a first through-hole 133 that penetrates the protection substrate in the third direction Z is provided in the protection substrate 130. A lead electrode (not illustrated), which is drawn out from an individual electrode of the piezoelectric actuator 300 toward the first through-hole 133, is provided on the vibration plate 150. The end portion of the lead electrode is exposed in the first through-hole 133. A cable 200, on which a driver circuit 201 such as a driver IC is attached, is electrically connected to the lead electrode in the first through-hole 133.

A compliance substrate 140 is joined on such a protection substrate 130. An ink guiding port 144 for supplying ink to the manifold 180 is formed to penetrate the compliance plate in a thickness direction thereof, in a region of the compliance substrate 140, which faces the manifold 180. In addition, a region except for the ink guiding port 144 of the region of the compliance substrate 140, which faces the manifold 180, becomes a flexible section 143 formed to be thin in the thickness direction, and the manifold 180 is sealed by the flexible section 143. Compliance is applied in the manifold 180 by the flexible section 143.

A head case 230 is provided on the compliance substrate 140 and the head case is provided with an ink supply communication path 81 communicating with the ink guiding port 144. The ink supply communication path 81, which will be described in detail below, communicates with the channel provided in the channel holder 30, and supplies the ink from the channel holder 30 to the ink guiding port 144. In addition, a recessed section 245 is formed in a region of the head case 230, which faces the flexible section 143, and bending deformation of the flexible section 143 is appropriately performed.

In addition, a second through-hole 246 is formed in the head case 230 so as to penetrate through the head case in the thickness direction. The second through-hole 246 communicates with the first through-hole 133 of the protection substrate 130 and the cable 200 is inserted into the second through-hole.

The cable 200, for example, is formed of a flexible cable or the like having flexibility. The input side opposite to the output side connected to the head 100 of the cable 200, which will be described in detail below, is electrically connected to the circuit board 80 (refer to FIGS. 7 and 9), and various signals such as a print signal are supplied form an external device through the circuit board 80 to the input side. The driver circuit 201 is attached to the cable 200 as a semiconductor element; however, it is needless to mention that the cable 200 may not be provided with the driver circuit 201.

Moreover, the cable 200 of the present embodiment has the narrower width on the input side which is connected to the circuit board 80 to be described below, than the width on the output side which is connected to the head 100. The shape of the cable 200 or a mode of being connected to the circuit board 80 will be described below.

The surface of such a head 100, on which the ink supply communication path 81 is opened, is fixed to the channel holder 30 and the ink is supplied form the liquid supply unit 46 through the channel holder 30.

As illustrated in FIGS. 2 and 3, two rows of the plurality heads 100, that is, in the present embodiment, six heads in the first direction X as a row-set direction of the nozzle row 122, are arranged in the channel holder 30, in the second direction Y. In other words, in one head unit 2, a total of 24 nozzle rows 122 are arranged in parallel in the first direction X. In other words, there is no particular limitation to a method of fixing the head 100 to the channel holder 30; however, the fixing is performed by adhesion by an adhesive, a screw, or the like.

The channel holder 30 that configures the head unit 2 is described with reference to FIGS. 2 to 7.

The channel holder 30 is a member that is provided with a plurality of channels through which the ink circulates, and that accommodates the plurality of heads 100 in cooperation with the fixing plate 10. In the present embodiment, the channel holder 30 includes a channel member 40, a first holder 75, a second holder 59, and a horizontal channel forming plate 70.

Further, the channel member 40, the first holder 75, the second holder 59, and the horizontal channel forming plate 70, which configure the channel holder 30, are molded with a resin material, thereby making it possible to reduce costs. It is needless to mention that the material is not limited to the resin material, and may include a metal material or the like. In addition, the method of manufacturing is not limited to the molding. The channel holder 30 is not limited to the case of being configured of the plurality of members described above, but may be configured of a single member.

As illustrated in FIGS. 2 and 7, the channel member 40 is a member which has a channel, though which the ink circulates, and to which the ink is supplied from the liquid supply unit 46. Specifically, a connection section 41 that is connected to the supply tube 47 (refer to FIG. 1) is provided on the negative direction side of the channel member 40 in the third direction Z. The connection section 41 of the present embodiment projects to the negative direction in the third direction Z and is formed to have a needle shape which can be inserted into an opening of the supply tube 47.

A channel is opened on the tip of the connection section 41, which is not particularly illustrated, and the ink is supplied from the supply tube 47 through the opening to the channel. Further, the connection section 41 is not limited to the mode. Two channels diverge from The channel opened on the tip of the connection section 41, inside the channel member 40. Two outlets 42 are provided to one channel on the positive direction side of the channel member 40 in the third direction Z. The outlets of two diverging channels are opened, respectively, in the outlet 42, which is not particularly illustrated. The ink supplied to the connection section 41 is divided into two parts inside the channel member 40, and is sent out from each of two outlets 42.

In the present embodiment, a total of the four connection sections 41, which are disposed by two in each of the first direction X and the second direction Y, are provided in one channel member 40. As described above, two manifolds 180 are provided in one head 100. In addition, The outlets 42 communicate with the manifolds 180 of the heads 100, respectively, which will be described in detail below. Hence, the ink supplied from the four connection sections 41 of one channel member 40 is sent out from the outlet 42 and is supplied to the eight manifolds 180.

The three channel members 40 are arranged in parallel in the first direction X. Hence, the entirety of the channel members 40 can supply the ink supplied from twelve connection sections 41 to 24 manifolds 180 of twelve heads 100.

Further, there is no particular limitation to the shape and the number of the channels which are provided in the channel member 40. In addition, a filter for removing bubbles or a foreign substance contained in the ink in the channel may be provided inside the channel member 40. Moreover, three or more channels may diverge from the channel, in the channel member 40, or no channel may diverge from the channel.

In addition, there is no particular limitation to a mode in which the ink supplied to the connection section 41 is supplied to the respective manifolds 180 of the respective heads 100. In the present embodiment, the same ink is to be supplied to the nozzle rows 122 on at least one side of the two heads 100 which are adjacent in the first direction X. The two heads 100, which eject the same ink, are positioned to be shifted in the second direction Y from each other, thereby forming a long nozzle row with the two heads 100 in the second direction Y.

As illustrated in FIGS. 2 to 7, the first holder 75 and the second holder 59 are stacked in the third direction Z.

The first holder 75 is a member that holds the channel member 40 described above, and that holds the circuit board 80 in cooperation with the second holder 59.

A mounting section 55 is formed on a surface of the first holder 75 on the negative direction side in the third direction Z, and channel member 40 is mounted on the mounting section 55. The mounting section 55 of the present embodiment has a recessed shape formed by a part of the first holder 75 recessed in the third direction Z. A first insertion hole 76 is formed to penetrate though the mounting section 55 in the third direction Z. The first insertion holes 76 are formed at positions facing the outlets 42 of the channel members 40, respectively, and 24 first insertion holes are provided in the present embodiment. An ink supply tube 71 to be described below is inserted into the first insertion hole 76.

In addition, connector inserting holes 77 penetrating through the first holder in the third direction Z are formed in a region of the first holder 75 except the region of the mounting section 55, on both end sides of the first holder in the first direction X. Wiring which is electrically connected to a connector 85 of the circuit board 80 is inserted into the connector inserting hole 77. The circuit board 80 is connected to an external control device or the like though the wiring, and a print signal form the control device is transmitted to the circuit board 80 through the wiring.

As illustrated in FIGS. 4 to 7, the second holder 59 includes a channel 67 which communicates with the channel of the channel member 40 and through which the ink is supplied to the head 100. The second holder is a member that accommodates the heads 100 in cooperation with the fixing plate 10. In addition, in the present embodiment, the second holder 59 holds the circuit board 80 in cooperation with the first holder 75.

An accommodation section 65 is formed on a surface of the second holder 59 on the negative direction side in the third direction Z and the circuit board 80 is accommodated in the accommodation section 65. The accommodation section 65 of the present embodiment has a recessed shape formed by a part of the second holder 59 recessed in the third direction Z. The accommodation section 65 is formed to have a size and a shape to the extent that the circuit board 80 is accommodated. The first holder 75 and the second holder 59 are stacked, and thereby the circuit board 80 is accommodated in the accommodation section 65 in a state of being covered with the first holder 75.

In addition, the second holder 59 includes the channel 67. In the present embodiment, the channel 67 is formed to include a first channel 68 and a second channel 69 formed in the second holder 59, and a third channel 73 formed in the horizontal channel forming plate 70.

The horizontal channel forming plate 70 is a plate-shaped member for forming the second channel 69 as a horizontal channel in a joined surface to the second holder 59. In the present embodiment, a recessed section 66 is formed by a part of the accommodation section 65 of the second holder 59 recessed in the third direction Z. The horizontal channel forming plate 70 is joined to the second holder 59 in the recessed section 66. Further, the recessed section 66 is formed in a size and a shape in which the horizontal channel forming plate 70 can be accommodated.

The first channel 68 is a channel formed by penetrating through the second holder 59 in the third direction Z. The first channel 68 is opened to the recessed section 66 and is opened to a head accommodating section 62 to be described below. The first channel 68 is provided at a position facing the ink supply communication path 81 (refer to FIGS. 12 and 13) of the head 100 accommodated in the head accommodating section 62.

The second channel 69 is a channel formed by sealing, with the horizontal channel forming plate 70, a groove formed in the recessed section 66. One end of the second channel 69 is connected to the first channel 68 and the other end of the second channel 69 is disposed to face the outlet 42 of the channel member 40.

The ink supply tube 71 projecting on the first holder 75 side is formed in a surface of the horizontal channel forming plate 70 on the negative direction side in the third direction Z. The ink supply tube 71 is disposed to face the outlet 42 of the channel member 40. In the present embodiment, since a total of the 24 outlets 42 of the channel member 40 is formed, 24 ink supply tubes 71 corresponding to the outlets are provided.

The third channel 73 is formed to pass though the inside of the ink supply tube 71 and to penetrate the horizontal channel forming plate 70 in the third direction Z. The third channel 73 faces the outlet 42 of the channel member 40 and is disposed to communicate with one end of the second channel 69.

Accordingly, the horizontal channel forming plate 70 is joined to the second holder 59, thereby forming the channel 67 formed to include the first channel 68, the second channel 69, and the third channel 73.

As in the present embodiment, the channel 67 includes the second channel 69 as a horizontal channel, thereby making it possible to guide the ink in any direction in an XY plane. Hence, the ink is appropriately guided in the XY plane, thereby making it possible to supply the ink corresponding to the disposition of the heads 100 accommodated in the head accommodating section 62. Further, the channel 67 may not include such a horizontal second channel 69. For example, a channel inclined with respect to the third direction Z is provided in the second holder 59, and thereby the ink may be supplied from the outlet 42 of the channel member 40 to the respective heads 100.

The ink supply tube 71 that forms a part of such a channel 67 is inserted into a second insertion hole 82 that is provided to penetrate the circuit board 80 in the third direction Z, and into the first insertion hole 76 formed in the first holder 75. In the present embodiment, a total of the 24 second insertion holes 82 are formed at a position of the circuit board 80, which faces the ink supply tube 71. Further, the details of the circuit board 80 will be described below.

The ink supply tube 71 is inserted into the first insertion hole 76 and the second insertion hole 82, and is exposed to the mounting section 55. The ink supply tube 71 exposed to the mounting section 55 is connected to the outlet 42 of the channel member 40 through a seal member 95.

A communication path 96 is formed to penetrate through the seal member 95 in the third direction Z. The ink supply tube 71 is inserted into the communication path 96. In the present embodiment, a total of the 24 communication paths 96 are formed at a position of the seal member 95, which faces the ink supply tube 71. Then, the communication path 96 communicates with the channel of the channel member 40 opened to the outlet 42.

Accordingly, the ink supply tube 71 is inserted into the communication path 96 of the seal member 95, and the channel of the channel member 40 communicates with the communication path 96 at the outlet 42, and thereby the channel of the channel member 40 communicates with the channel 67 opened to the ink supply tube 71.

As described above, the channel member 40 has a total of the 24 outlets 42, and the 24 channels 67 are formed corresponding to the outlets 42, respectively.

The head accommodating section 62 that accommodates the heads 100 is formed in the second holder 59 on the positive direction side in the third direction Z. In the present embodiment, the head accommodating section 62 is formed to have a recessed shape by a part of the second holder 59 recessed in the third direction Z. As will be described below, the head 100 is fixed to the fixing plate 10. A depth of the head accommodating section 62 in the third direction Z means a depth by which the head 100 adheres to the bottom (surface facing the positive direction in the third direction Z) of the head accommodating section 62 when the fixing plate 10, to which the head 100 is fixed, is fixed to the second holder 59.

In addition, the head accommodating sections 62 are separately formed corresponding to the disposition of the plurality of heads 100. In the present embodiment, twelve head accommodating sections are provided corresponding to the twelve heads 100. Further, the head accommodating section 62 does not need to be formed for each head 100, and the plurality of heads 100 may be accommodated in the common head accommodating section 62.

A first communication hole 61 is opened to such a head accommodating section 62. The first communication hole 61 is a through-hole penetrating through the second holder 59 in the third direction Z. In the present embodiment, the first communication holes 61 are formed such that one first communication hole 61 corresponds to each of the 12 head accommodating section 62.

In addition, a second communication hole 72 is provided in the horizontal channel forming plate 70. The second communication hole 72 is a through-hole penetrating through the horizontal channel forming plate 70 in the third direction Z. In the present embodiment, the 12 second communication holes 72 are formed at positions facing 12 first communication holes 61. The first communication hole 61 and the second communication hole 72 communicate with each other, and further communicate with a wiring opening 83 of the circuit board 80 to be described below. The details of the circuit board 80 will be described below.

Here, the fixing plate 10 is described with reference to FIGS. 2, 3, 5, and 6. The fixing plate 10 is provided with the plurality of openings 11 and is a member to which the head 100 aligned at a position with the fixing plate is fixed. The fixing plate 10 of the present embodiment includes a bottom section 12 and a side surface section 13 which is continuous to the bottom section 12 and is bent with respect to the bottom section 12.

The bottom section 12 has a plate shape and has a shape of which the four corners are chamfered based on a rectangular shape when viewed in a plan view in the third direction Z.

The side surface section 13 extends from the bottom section 12 toward the first surface 15 side. In other words, the side surface section 13 is formed to have a portion continuous to the bottom section 12, which is bent to the negative direction side, as the first surface 15 side, in the third direction Z. In the present embodiment, two side surface sections 13 are formed in the first direction X and two side surface sections 13 are formed in the second direction Y.

The bottom section 12 has the first surface 15 (surface on the negative direction side in the third direction Z) to which the head 100 is fixed, and a second surface 16 on the side opposite to the first surface 15. The plurality of openings 11 are provided by penetrating though the first surface 15 and the second surface 16 in the bottom section 12. The openings 11 are provided such that each of the nozzle rows 122 of the heads 100 is individually exposed. In the present example, a total of the twelve openings 11 are provided for twelve heads 100, respectively.

For example, such fixing plate is formed by cutting out the shape of the fixing plate 10 from a plate-shaped member formed of a metal material such as stainless steel, then bending the side surface section 13. Therefore, it is possible to achieve high flatness of the bottom section 12, compared to a case where the side surface section 13 is formed by drawing.

As illustrated in FIG. 5, a plurality of sets having the plurality of openings 11 described above are included in the fixing plate 10. In the present embodiment, two adjacent openings 11 are included in one set, and a total of six sets are provided in the fixing plate 10. The respective sets in order from the negative direction side to the positive direction side in the first direction X are referred to as a set A, a set B, a set C, a set D, a set E, and a set F.

Only a part of the openings 11 constituting the respective sets A to F are overlapped in the second direction Y in which the nozzle row 122 is formed, and the openings 11 are disposed not to be overlapped in the first direction X.

Only a part of the openings 11 constituting the set A are overlapped in the second direction Y, which means that only a part of projection y1 and projection y2 of the two openings 11 constituting the set A in the second direction Y is overlapped. In other words, the present embodiment does not include a case where the projection y1 and the projection y2 are completely overlapped and a case where the projections are not overlapped at all. The same is true of a case where the three or more openings 11 are included in one set, and the same is true of the sets B to F.

The openings 11 constituting the set A are not overlapped in the first direction X, which means that the projection x1 and the projection x2 of the two openings 11 constituting the set A in the first direction X do not overlapped. The same is true of a case where the three or more openings 11 are included in one set, and the same is true of the sets B to F.

As illustrated in FIGS. 5 and 6, the openings 11 are formed to be slightly smaller than the nozzle plate 120 of the head 100, and the nozzle plate 120 is fixed to the first surface 15 of the bottom section 12 on an opening edge portion of the opening 11. Further, the bottom section 12 and the nozzle plate 120 are fixed, for example, by an adhesive 18.

Accordingly, the heads 100 are fixed to the first surface 15, thereby defining an ejection surface by the second surface 16 of the fixing plate 10 and the nozzle plate 120. The ejection surface means a surface at a position facing the medium to which the ink is ejected. The ejection surface of the present embodiment is configured of the second surface 16 and the nozzle plate 120 exposed through the opening 11. The defining of the ejection surface by fixing the heads 100 to the first surface 15 means that the ejection surfaces of the heads 100 are defined in a state in which the disposition of the heads 100 in the third direction Z is aligned at a position by the first surface 15 of the fixing plate 10.

As illustrated in FIG. 7, the head 100 is accommodated in the head accommodating section 62, and the negative direction side of each of the heads 100 in the third direction Z, which faces the head accommodating section 62 adheres to the head accommodating section 62 through an adhesive or the like (not illustrated in the drawings). Accordingly, the head 100 is fixed to the fixing plate 10 on the positive direction side, in the head accommodating section 62 on the negative direction side in the third direction Z.

As described above, the respective heads 100 are fixed to the first surface 15 and the ejection surfaces thereof are defined. In other words, the respective heads 100 are disposed such that the ejection surfaces are flush with the second surface 16 as a reference, that is, the nozzle plates 120 are flush with each other. Hence, variations in a space between the heads 100 and the fixing plate 10 in the third direction Z are further decreased than variations in a space between the heads 100 and the head accommodating sections 62 in the third direction Z.

Accordingly, since the positions of the heads 100 in the third direction Z are positioned on the ejection surface side close to the medium S, it is possible to decrease the variations in the positions of the ejection surfaces in the third direction Z with high accuracy. Further, in a case where the heads 100 are fixed to the head accommodating section 62 on the side opposite to the ejection surface, the variations in the positions of the ejection surfaces in the third direction Z are likely to be increased.

In addition, the sets, each of which is formed of the plurality of openings 11, are positioned at the predetermined disposition described above in the first direction X and the second direction Y. Hence, the heads 100 are fixed to the openings 11 constituting the sets, and thereby the heads 100 are not overlapped in the first direction X, but only a part of the heads are disposed to be overlapped in the second direction Y.

In other words, only a part of the heads 100 fixed to two openings 11 constituting each of the sets A to F are overlapped in the second direction Y. Specifically, only a part of the heads 100 are overlapped such that a part of the nozzles 121 of the heads 100 are positioned at the same positions in the second direction Y. Accordingly, since only a part of the heads 100 are overlapped in the second direction Y, a longer nozzle row is formed in the second direction Y by the two heads 100 than the nozzle row 122 of the one head 100.

In addition, as described above, in the present embodiment, the same ink is supplied to at least one nozzle row 122 of two heads 100 adjacent in the first direction X which constitute each of the sets A to F. Hence, the same ink is ejected from the nozzle rows formed by the two heads 100. In other words, the heads 100 are fixed to the respective sets of the openings 11, thereby making it possible to eject ink droplets in a wide range in the second direction similar to a case where a nozzle row is elongated.

In the present embodiment, since the plurality of sets are disposed in the first direction X, the heads 100 are fixed to the respective sets of openings 11, thereby making it possible to form multiple nozzle rows in the first direction X, which are elongated in the second direction Y.

As illustrated in FIGS. 2, 7, 8, and 10, the fixing plate 10, to which the heads 100 described above are fixed, is fixed to the second holder 59 though the reinforcement plate 20.

The reinforcement plate 20 is a member that is stacked on the fixing plate 10, has a plurality of through-holes 21 into which the heads 100 are inserted, and is thicker than the fixing plate 10.

The reinforcement plate 20 is stacked on the first surface 15 side of the fixing plate 10. In the present embodiment, the reinforcement plate adheres to the first surface 15 side of the fixing plate 10 by the same adhesive 18 as for the head 100. It is needless to mention that the reinforcement plate 20 may be fixed to the fixing plate 10 by a different adhesive from the adhesive 18 used for adhesion of the heads 100 to the fixing plate 10.

The reinforcement plate 20 has the plurality of through-holes 21 penetrating the reinforcement plate in the third direction Z. The through-hole 21 has a size and a shape in which the head 100 can be inserted, and the through-hole is formed for each head 100. In the present embodiment, the through-holes 21 are formed at positions facing the openings 11 of the fixing plate 10. Since six sets of twelve openings 11 are provided in the fixing plate 10, twelve through-holes 21 are provided in the reinforcement plate 20 by matching the openings 11.

The reinforcement plate 20 is formed to be thicker than the fixing plate 10. The reinforcement plate 20 thicker than the fixing plate 10 is stacked on the fixing plate 10, thereby making it possible to reinforce the fixing plate 10, and to improve rigidity against an external force such as a force due to folding.

Further, it is also possible to improve rigidity by forming the fixing plate 10 to be thicker. However, as illustrated in FIG. 6, the nozzle plate 120 of the head 100 adheres on the first surface 15 of the fixing plate 10. Therefore, a so-called paper gap between the nozzle plate 120 and the medium S is widened by the amount of the increased thickness of the fixing plate 10. Meanwhile, the reinforcement plate 20 is stacked on the fixing plate 10, thereby the fixing plate 10 becomes thin such that the paper gap is decreased, and it is possible to improve the rigidity of the fixing plate 10.

As illustrated in FIGS. 8 and 10, the through-hole 21 has a first inner circumferential surface 23 with a space from the head 100 as a first space M, and a second inner circumferential surface 24 with a space from the head 100 as a second space N that is wider than the first space M. In the present embodiment, the through-hole 21 is formed to have a rectangular shape in which the head 100 can be inserted, and a part of the through-hole is notched to form a semicircular shape. The inner circumferential surface of the rectangular shape of the through-hole 21 is the first inner circumferential surface 23 and the inner circumferential surface cut in the semi-circular shape is the second inner circumferential surface 24. It is needless to mention that the shapes of the first inner circumferential surface 23 and the second inner circumferential surface 24 are not limited to the aspect. In other words, the through-hole 21 may be formed such that the second space N between the second inner circumferential surface 24 and the head 100 is wider than the first space M between the first inner circumferential surface 23 and the head 100.

Such a through-hole 21 is provided with an adhesive 19 that is in contact with the second inner circumferential surface 24. The adhesive 19 is provided between the second inner circumferential surface 24 and a side surface of the head 100 which faces the second inner circumferential surface 24, and the head 100 adheres to the second inner circumferential surface 24 by the adhesive. The adhesive 19 provided to such a second inner circumferential surface 24 can reduce a positional shift of the head 100 in the first direction X and the second direction Y.

Accordingly, the first inner circumferential surface 23 has a narrower space from the head 100 than the second inner circumferential surface 24. Hence, it is difficult to fill the narrow space between the first inner circumferential surface 23 and the head. By comparison, it is easy to fill the second space N from the second inner circumferential surface 24, which is wider than that of the first inner circumferential surface 23. In this manner, since the head 100 is fixed to the first surface 15 by the adhesive 18 and to the reinforcement plate 20 by the adhesive 19, it is possible to firmly fix the head 100, compared to a case where the nozzle plate 120 of the head 100 is fixed to the first surface 15 only by the adhesive 18. Hence, it is possible to reduce a shift of the positions of the heads 100 which are aligned at positions by the predetermined disposition.

In addition, the first space M of the first inner circumferential surface 23 is narrower than the second space N. In other words, since the second inner circumferential surface 24 is provided at a part as a portion which is filled with the adhesive 19, there is no need to provide a region of the first inner circumferential surface 23 other than the second inner circumferential surface 24, which is filled with the adhesive 19, and the first space M can become narrow from the head 100.

As illustrated in FIG. 8, the portion of the fixing plate 10, which is exposed in the through-hole 21 of the reinforcement plate 20, is referred to as an opening edge portion 14. The opening edge portion 14 is a part of the sides of the opening 11 of the fixing plate 10, and is a portion of the fixing plate 10, which is not reinforced by the reinforcement plate 20. Meanwhile, the first space M of the first inner circumferential surface 23 can become narrow as described above. Accordingly, when the first space M becomes narrow, the opening edge portion 14 becomes narrow in width, and thus, the opening edge portion 14, which is not reinforced by the reinforcement plate 20, can become narrow in width. In this manner, there is a low concern that the opening edge portion 14 of the fixing plate 10 will be bent, and it is possible to maintain the flatness of the fixing plate 10.

As illustrated in FIGS. 6 and 7, the first surface 15 of the fixing plate 10, on which such a reinforcement plate 20 is stacked, is joined to a surface of the second holder 59 on the positive direction side in the third direction Z. Specifically, in a state in which the heads 100 fixed to the fixing plate 10 are accommodated in the head accommodating sections 62 of the second holder 59, respectively, the fixing plate 10 is fixed to the second holder 59 on the positive direction side in the third direction Z though the reinforcement plate 20. Further, the reinforcement plate 20 and the second holder 59 adhere to each other, for example, by an adhesive 25.

In this manner, the plurality of heads 100 are accommodated between the second holder 59 of the channel holder 30 and the fixing plate 10 to which the reinforcement plate 20 is joined; however, in a case where the reinforcement plate 20 is not used, the fixing plate 10 may be directly joined to the second holder 59.

The head 100 fixed to the fixing plate 10 is accommodated in the head accommodating section 62 and adheres thereto on the negative direction side in the third direction Z by an adhesive (not illustrated) or the like, and the ink supply communication path 81 (refer to FIG. 13) of the head 100 is connected to the channel 67. Then, the second through-hole 246 (refer to FIG. 13) of the head 100 communicates with the first communication hole 61 of the channel holder 30.

Here, the circuit board 80 is described with reference to FIGS. 4, 7, and 9. The circuit board 80 is formed of a printed-circuit board provided with an electronic component, the wiring, or the like (not illustrated). A plurality of wiring openings 83 are provided in the circuit board 80. The wiring opening 83 is a through-hole that penetrates through the circuit board 80 in the third direction Z and the cable 200 connected to the head 100 is inserted into the wiring opening. In the present embodiment, a total of twelve wiring openings 83 are formed at positions facing the twelve second communication holes 72, respectively.

In the circuit board 80, a connection terminal 84 is provided for each of the wiring openings 83. The cable 200 connected to the head 100 is inserted into the first communication hole 61, the second communication hole 72, and the wiring openings 83, and then, one end on the negative direction side in the third direction Z is bent to the circuit board 80 side, and is electrically connected to the connection terminal 84. Accordingly, each of the plurality of heads 100 is electrically connected to the circuit board 80 via the cable 200, which is inserted into each of the wiring openings 83, and the connection terminal 84.

Of the plurality of wiring openings 83 described above, the wiring openings 83 corresponding to the sets of openings 11 of the fixing plate 10 are disposed at intervals in the second direction Y. In other words, as illustrated in FIG. 9, sets formed of the wiring openings 83 corresponding to the sets A to F (refer to FIG. 5) of the openings 11 of the fixing plate 10 are provided in the circuit board 80. The sets of the wiring openings 83 in order from the negative direction side to the positive direction side in the first direction X are referred to as a set a, a set b, a set c, a set d, a set e, and a set f, respectively.

Two wiring openings 83 constituting the set a are disposed at an interval in the second direction Y. The two wiring openings 83 are disposed at an interval in the second direction Y, which means that projection y1 and projection y2, in the second direction Y, of the two wiring openings 83 constituting the set a are not overlapped. The same is true of a case where the three or more wiring openings 83 are included in one set, and the same is true of the sets b to f.

Accordingly, since the wiring openings 83 constituting the sets a to f are disposed at intervals in the second direction Y, wiring provided on the circuit board 80, for example, wiring that connects the connection terminal 84 and the connector 85, can be routed between the wiring openings 83 disposed at intervals in the second direction Y. According to the head unit 2 of the present embodiment, since the wiring openings 83 are disposed at intervals in the second direction Y in the circuit board 80, it is possible to achieve high flexibility of routing of the wiring on the circuit board 80.

Assume that a part of the wiring openings 83 constituting the sets a to f are overlapped in the second direction Y. In this case, a space between the wiring openings 83, a part of which are overlapped in the second direction Y, is very narrow, and thus it is difficult for the wiring provided on the circuit board 80 to be routed.

Such a circuit board 80 is accommodated in the accommodation section 65 of the second holder 59 to which the horizontal channel forming plate 70 is attached. In this state, the first communication hole 61, the second communication hole 72, and the wiring opening 83 communicate with each other and form a series of communication holes. The cable 200 is inserted into the communication holes. Then, one end of the cable 200 is connected to the head 100 accommodated in the head accommodating section 62, and the other end is connected to the connection terminal 84 of the circuit board 80.

An aspect, in which the cable 200 is connected to the connection terminal 84 of the circuit board 80, is described in detail with reference to FIG. 9.

Each of the plurality of cables 200 is fixed to the connection terminal 84 of the circuit board 80 on only one side of the positive direction side (one side in claims) in the first direction X and the negative direction side (the other side in claims) in the first direction X with respect to the wiring opening 83.

In the present embodiment, the plurality of wiring openings 83 are arranged in parallel in the first direction X and form a row. In other words, one row is configured to include the wiring openings 83 having the same position in the second direction Y. Two rows of the wiring openings 83 are arranged in the second direction Y.

Of the two rows of the wiring openings 83, the six wiring openings 83 arranged relatively on the positive direction side in the second direction Y are referred to as a first opening row, and the six wiring openings 83 disposed relatively on the negative direction side in the second direction Y are referred to as second opening row.

The cables 200 inserted into the first opening row of the wiring openings 83 are referred to as a first cable group. In other words, the first cable group means the cables 200 disposed at the same positions in the second direction Y. The cables 200 are disposed at the same positions in the second direction Y, which means that at least a part of the projection in the second direction Y of the cables 200 is overlapped. Similarly, the cables 200 inserted into the second opening row of the wiring openings 83 are referred to as a second cable group.

In the first cable group, all of the cables 200 constituting the group are bent on the positive direction side in the first direction X, and are fixed to the connection terminal 84 provided on the positive direction side (one side in claims) in the first direction X with respect to the wiring openings 83. In the second cable group, all of the cables 200 constituting the group are bent on the negative direction side (the other side in claims) in the first direction X, and are fixed to the connection terminal 84 provided on the negative direction side in the first direction X with respect to the wiring openings 83.

As described above, the first cable group of the cables 200 is fixed to the connection terminal 84 on the positive direction side in the first direction X, thereby making it possible to gather the entirety of the wiring pulled out from the plurality of connection terminals 84 to a connector 85 on the positive direction side in the first direction X. Similarly, in the second cable group of the cables 200, it is possible to gather the entirety of the wiring pulled out from the plurality of connection terminals 84 to a connector 85 on the negative direction side in the first direction X.

Accordingly, since the wiring on the circuit board 80 can be gathered to the connector 85 on one side on the basis of the first cable group and the second cable group, it is possible to simplify the wiring on the circuit board 80.

In addition, only a part of the first cable group and the second cable group are overlapped in the Y direction. In the present embodiment, in the first cable group and the second cable group of the cables 200, only a part of the output side (side connected to the head 100) is overlapped in the Y direction. Only a part of the sets of the openings 11 illustrated in FIG. 5 are overlapped in the Y direction; however, similar to such sets of the openings 11, only a part of the cables 200 are also overlapped in the Y direction. By comparison, as illustrated in FIG. 9, the input side (side connected to the circuit board 80) of the cables 200 are not overlapped in the Y direction.

The cables 200 belonging to the first cable group and the cables 200 belonging to the second cable group are configured to have a part of the output side which is overlapped in the Y direction. Accordingly, a part of the first cable group and the second cable group of the cables 200 are overlapped in the Y direction, thereby making it possible to miniaturize the head unit 2 in the Y direction.

In addition, as described above, the cables 200 of the head 100, which are inserted into the wiring openings 83, have a narrower width on the input side connected to the circuit board 80 than a width on the output side connected to the head 100 (refer to FIG. 12). Hence, an opening width in the second direction Y of the wiring opening 83, into which the cable 200 is inserted, can become narrower than at least the width on the output side of the cable 200.

In other words, the input side of the first cable group and the second cable group of the cables 200 are not overlapped in the Y direction. Hence, the space between the wiring openings 83 is more widened in the second direction Y, then the space can be used as a region in which the wiring is routed, and it is possible to further improve flexibility of routing of the wiring on the circuit board 80.

Accordingly, it is possible to compatibly achieve miniaturization of the head unit 2 in the Y direction, and high flexibility of the routing of the wiring on the circuit board 80.

In the head unit 2 of the present embodiment described above, the ink is supplied from the supply tube 47 to the channel holder 30 accommodating the head 100 in cooperation with the fixing plate 10, and the ink is supplied to the heads 100 through the channel 67 formed in the channel holder 30. Additionally, a print signal from the control device or the like is transmitted to the driver circuit 201 of the heads 100 via the circuit board 80, the piezoelectric actuator 300 is driven based on a drive waveform generated in the driver circuit 201, and then ink is ejected from the nozzle 121.

In addition, in the head unit 2 according to the present embodiment, the openings 11 constituting the sets arranged in the fixing plate 10 are disposed not to be overlapped in the first direction X, but to be overlapped by only a part thereof in the second direction Y. Also, the head 100 is disposed for each opening 11, and the ejection surface is defined by the nozzle plate 120 and the second surface 16 of the fixing plate 10. In this manner, the heads 100 are disposed not to be overlapped in the first direction X, but to be overlapped by only a part thereof in the second direction Y, and thus the long nozzle row is formed by the two heads 100 in the second direction Y. Then, the heads 100 are fixed to the plurality of sets of the openings 11 disposed in the first direction X, thereby making it possible to elongate the nozzle row in the second direction Y and to dispose multiple rows in the first direction X.

Accordingly, the plurality of heads 100 are aligned at positions on and fixed to the fixing plate 10 by which the ejection surface is defined in cooperation with the nozzle plate 120, thereby making it possible to increase the region in which the nozzle rows are disposed in distribution both in the first direction X and the second direction Y, and making it possible to increase a region which can be covered with ink droplets ejected at once.

Since heads 100 are fixed to the one fixing plate 10, it is possible to decrease the size of the head unit 2 in the first direction X and the second direction Y even when the nozzle row 122 is elongated in the second direction Y and multiple rows are disposed in the first direction X. Accordingly, since the size is decreased and it is possible to realize elongation of the nozzle rows 122 and multiple rows, it is possible to dispose the nozzle rows 122 in high density.

Incidentally, in the head unit having a configuration in which a plurality of fixing plates, on which the heads are disposed, are arranged in parallel in the first direction X and the second direction Y, it is possible to elongate the nozzle row 122 in the second direction Y, and to arrange multiple rows in the first direction X. However, there is a need to provide a predetermined space such that no interference with the bottom section of the fixing plate occurs, and thus, the size of the head unit 2 is increased by the amount of the space.

Further, since the heads 100 are fixed to the one fixing plate 10 and the ejection surface is defined, it is possible to dispose the heads 100 with small variations in the ejection surface in the third direction Z and with high accuracy, compared to a configuration in which heads 100 are fixed to a plurality of fixing plates. Further, since the nozzle plate 120 configuring the ejection surface is directly fixed to the fixing plate 10, it is possible to achieve a small paper gap, compared to a configuration in which heads are fixed to a fixing plate through a cover head or the like, which protects a nozzle plate as in the related art. Accordingly, since it is possible to achieve the small variations in the ejection surface and the small paper gap, the head unit 2 can eject the ink with high accuracy.

There is provided the ink jet-type recording apparatus I in which such a head unit 2 is mounted, and thereby the plurality of heads 100 are disposed with high accuracy, and the plurality of heads 100 can be disposed in high density.

In addition, the head unit 2 of the present embodiment includes the reinforcement plate 20 formed to be thicker than the fixing plate 10. The head 100 is inserted into the through-hole 21 of reinforcement plate 20, and the reinforcement plate 20 is not interposed between the head 100 and the fixing plate 10. Hence, it is possible to decrease the size in the third direction Z. In the case where the head 100 is fixed to the opening edge portion of the through-hole 21 of the reinforcement plate 20, the head unit 2 is likely to be increased in size in the third direction Z, by the amount of the thickness of the reinforcement plate 20.

In addition, even when the reinforcement plate 20 is provided, the head 100 is not fixed to the reinforcement plate 20. In other words, the positional accuracy in the third direction Z of the nozzle plates 120 of the respective heads 100 is defined only by the fixing plate 10 without an effect of the reinforcement plate 20. In this manner, the fixing plate 10 is improved in rigidity due to the reinforcement plate 20, and it is possible to perform positioning in the third direction Z of the ejection surface with high accuracy.

Further, since the reinforcement plate 20, which reinforces the head 100, is separate from the fixing plate 10, the fixing plate 10 can be formed to be sufficiently thin. The thin fixing plate 10 is formed, and thereby it is easy to form a shape on a lathe when the fixing plate 10 is disposed on the lathe during manufacturing the head unit 2, and it is easy to align the heads 100 at positions with high accuracy. In addition, even when the fixing plate 10 is thin, it is possible to increase the strength of the fixing plate 10 with the reinforcement plate 20 having a sufficient thickness, and it is possible to maintain the flatness.

In addition, as illustrated in FIGS. 1 and 5, the cap 161 of the negative pressure mechanism 160 provided in the ink jet-type recording apparatus I seals the same set of the openings 11 of the openings 11 formed in the fixing plate 10. In other words, the openings 11 belonging to another set are not disposed between the same set of the openings 11, and thus the cap 161 seals only the same set of the openings 11. Specifically, the cap 161 is formed to have a rectangular shape so as to cover the entirety of the two openings 11 constituting the one set. Such a cap 161 abuts on the second surface 16 of the fixing plate 10 and the openings 11 are sealed by the cap 161.

As described above, the ink is supplied to the heads 100 corresponding to the same set of openings 11, from the liquid supply unit 46 as the common supply source. In the present embodiment, one head 100 has two nozzle rows 122, and two heads 100 correspond to the same set of the openings 11. The ink is supplied from the liquid supply unit 46 to the entire nozzle rows 122 of the two heads 100.

Accordingly, the heads 100 to which the ink is supplied from the common liquid supply unit 46 need to be suctioned and to be subjected to the negative pressure after the entirety of the heads 100 are sealed by the cap 161.

The cap 161 of the present embodiment seals the heads 100 corresponding to the openings 11 belonging to the same set, that is, only the heads 100 to which the ink is supplied from the common liquid supply unit 46. Since the cap 161 may be formed corresponding to the set of the openings 11, it is possible to reduce the size of the cap 161.

In a case where the openings 11 constituting another set are disposed between the openings 11 constituting the specific set, for example, in a case where the openings 11 on the most positive direction side and the openings 11 on the most negative direction side in the first direction X in FIG. 5 constitute one set, the cap 161 is likely to be increased in size. The is because a cap, which can seal the specific set of the openings 11 at once, needs to be formed, in a case where the ink is supplied from the common liquid supply unit 46 to the heads 100 corresponding to the openings 11 constituting the specific set. The fixing plate 10 needs to be increased in size along with the cap, and virtually, the cap is likely to have a size which covers other sets of the openings 11 which do not need to be sealed.

Embodiment 2

In the head unit 2 according to Embodiment 1, the set provided in the fixing plate 10 is configured of two openings 11 adjacent in the first direction X; however, the configuration is not limited to such aspect. In other words, a set may be configured to have a plurality of openings 11 which are not adjacent in the first direction X.

Figure 11:
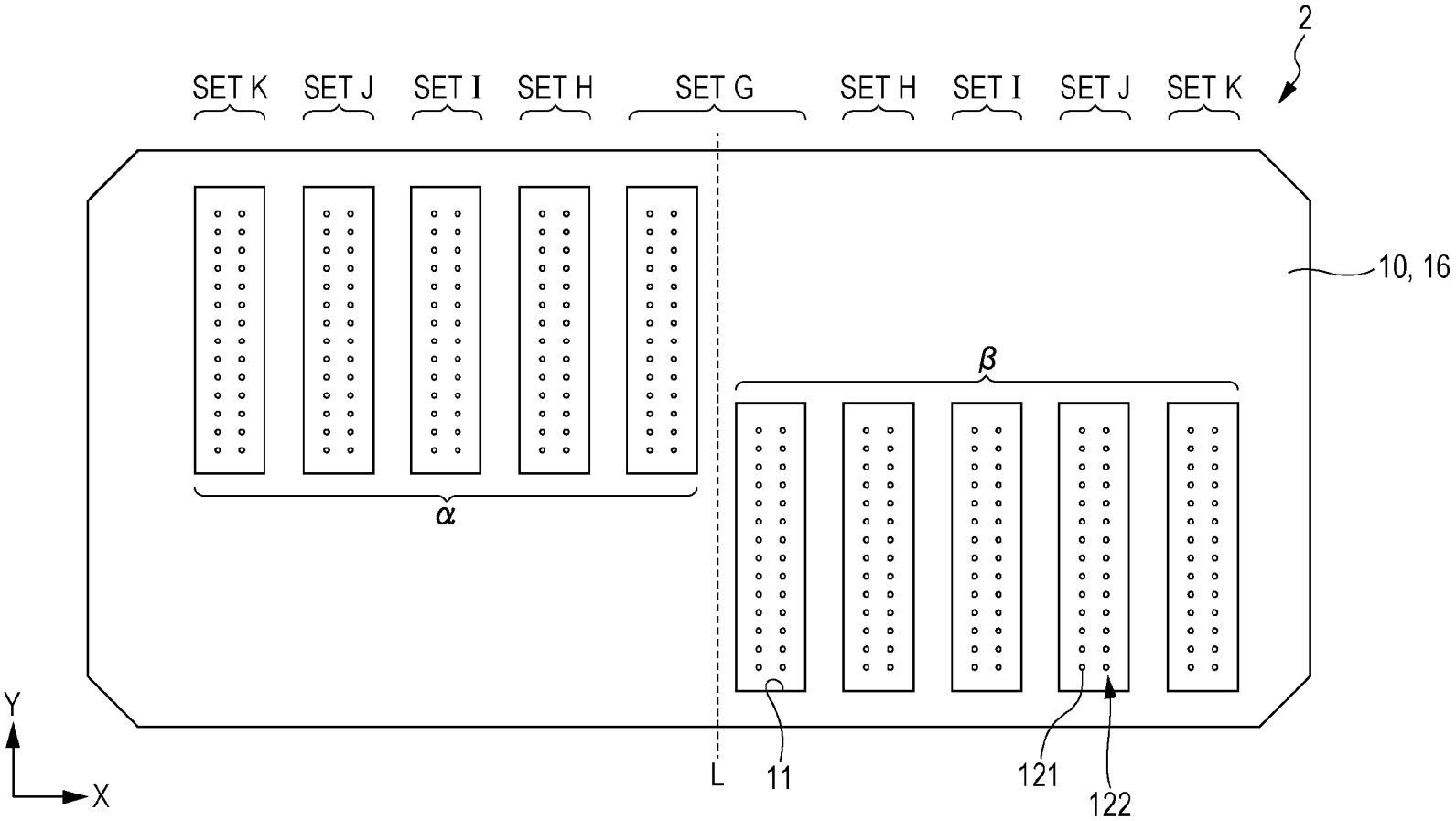
FIG. 11 is a bottom view of the head unit.

FIG. 11 is a bottom view of the head unit 2 according to the present embodiment. FIG. 11 illustrates the fixing plate 10 and the nozzle plate 120 and the channel holder 30 is omitted. The same reference signs are assigned to the same members as in the embodiment described above, and repetitive description is omitted.

As illustrated in FIG. 11, in the fixing plate 10, the plurality of openings 11 having the same position in the second direction Y are arranged in parallel in the first direction X and form rows, and two rows are formed to be shifted in the second direction Y. The two rows are referred to as a first row α and a second row β. The first row α is disposed on the negative direction side in the first direction X from the second row β, and is disposed on the positive direction side in the second direction Y.

The first row α and the second row β are not overlapped in the first direction X. A virtual boundary line L is interposed between the first row α and the second row β, and the openings 11, which are symmetrically disposed, constitute one set. For example, of each of the first row α and the second row β, the openings 11 closest to the boundary line L constitute one set G. Similarly, of each of the first row α and the second row β, the openings 11 second closest to the boundary line L from the set G constitute one set H. Then, the same is true of sets I to K. In the respective sets G to K, the openings 11 are not overlapped in the first direction X, but are overlapped by only a part thereof in the second direction Y.

With the fixing plate 10 according to such an aspect, the present embodiment achieves the same effects as the head unit 2 according to Embodiment 1.

OTHER EMBODIMENTS

Hereinafter, an embodiment of the invention is described; however, the fundamental configuration of the invention is not limited to Embodiments 1 and 2 described above.

For example, in the fixing plate 10 according to Embodiment 1, six sets of twelve openings 11 are provided; however, the configuration is not limited to such aspect. The number of openings 11 is arbitrary, and two or more openings 11 may constitute one set. For example, three or more openings 11 may belong to one set, three or more heads 100, which are fixed to the openings 11, may be arranged in parallel, and the nozzle row 122 may be further elongated.

The channel holder 30 according to Embodiment 1 are configured of the plurality of members; however, the configuration is not limited to such an aspect. A configuration, in which the channel 67 that supplies ink to the head 100 is provided and the head 100 can be accommodated in cooperation with the fixing plate 10, may be employed. In addition, the channel holder 30 may be formed of a single member.

The circuit board 80 according to Embodiment 1 is configured to be accommodated in the channel holder 30; however, the configuration is not limited to such an aspect. In addition, of the plurality of wiring openings 83 formed in the circuit board 80, the wiring openings 83 corresponding to a set of openings 11 of the fixing plate 10 are disposed at intervals in the second direction Y; however, the configuration is not limited to such an aspect, and a part of the wiring openings may be overlapped in the second direction Y.

Each of the first cable group and the second cable group according to Embodiment 1 are collectively connected to the connector 85 on the positive direction side and to the connector 85 on the negative direction side in the first direction X; however, the configuration is not limited to such an aspect. The respective cables 200 may be appropriately connected to the connectors 85.

The cable 200 of the head 100 according to Embodiment 1 is formed to have the narrower width on the input side than the width on the output side; however, the configuration is not limited to such an aspect. The cable may have the same width on the input side and the output side, and may have the wider width on the input side than the width on the output side.

The head unit 2 according to Embodiment 1 includes the reinforcement plate 20; however, the reinforcement plate is not necessary configuration. In other words, a configuration, in which the fixing plate 10 is directly fixed to the channel holder 30 and accommodates the head 100, without the reinforcement plate 20, may be employed. In addition, the reinforcement plate 20 may have the same thickness as the fixing plate 10 or may be thinner than the fixing plate 10.

The through-hole 21 of the reinforcement plate 20 according to Embodiment 1 includes the first inner circumferential surface 23 and the second inner circumferential surface 24; however, the second inner circumferential surface 24 is not necessary configuration. In other words, the reinforcement plate 20 may have a through-hole into which the head 100 can be inserted.

The ink jet-type recording apparatus I according to Embodiment 1 includes the negative pressure mechanism 160; however, the negative pressure mechanism 160 is not necessary configuration.

In the ink jet-type recording apparatus I according to Embodiment 1, an example, in which the head unit 2 is mounted on the carriage 3, and moves in the first direction X (main scanning direction), is described; however, the configuration is not particularly limited thereto. For example, the invention can also be applied to a so-called line-type recording apparatus in which the head unit 2 is fixed, and the printing is performed only by causing the medium S such as paper to move in the second direction Y (sub scanning direction).

Further, the ink jet-type recording apparatus I has the configuration in which the liquid supply unit 46 is mounted in the apparatus main body 4, and the ink is supplied to the head unit 2 via the supply tube 47; however, the configuration is not limited thereto. For example, the head unit 2 together with a liquid supply unit such as an ink cartridge may be mounted on the carriage 3. In addition, the liquid supply unit 46 may not be mounted in the ink jet-type recording apparatus I.

The head 100 according to Embodiment 1 is described to use the thin film-type piezoelectric actuator 300 as the pressure generating unit that causes the pressure in the pressure generating chamber 112 to be changed; however, the configuration is not particularly limited thereto. For example, it is possible to use a thick film-type piezoelectric actuator formed by a method of attaching a green sheet or the like, a longitudinal vibration type of piezoelectric actuator in which a piezoelectric material and an electrode forming material are alternately laminated and are expanded and contracted in an axial direction, or the like. In addition, as the pressure generating unit, it is possible to use an actuator which includes a heating element disposed in a pressure generating chamber, and ejects a liquid droplet from a nozzle opening due to bubbles generated by the heating of the heating element, a so-called electrostatic actuator which generates static electricity between a vibration plate and an electrode, deforms the vibration plate due to an electrostatic force, and ejects a liquid droplet from a nozzle opening, or the like.

Further, the invention is made for, as a target, the wide liquid ejecting head, overall, for example, the invention can also be applied to a recording head such as various types of ink jet-type recording head used in an image recording apparatus such as a printer, a color material ejecting head used in manufacturing a color filter such as a liquid crystal display, an organic EL display, an electrode material ejecting head used to form an electrode, such as a field emission display (FED), a bio-organic material ejecting head used in manufacturing a bio chip, or the like.

Embodiment 3

Figure 14:
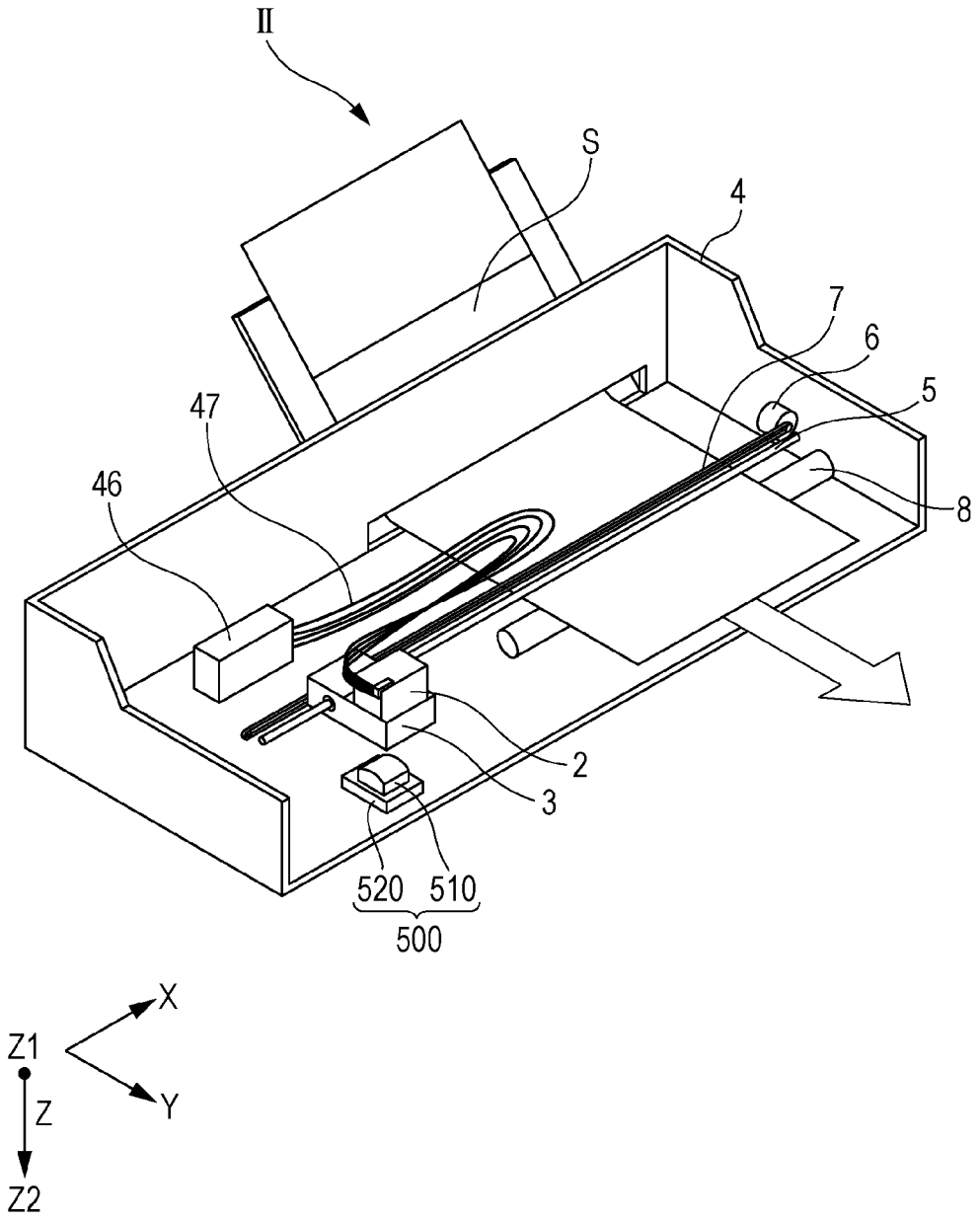
FIG. 14 is a view schematically illustrating a recording apparatus according to Embodiment 3.

FIG. 14 is a view schematically illustrating the ink jet-type recording apparatus as an example of the liquid ejecting apparatus according to Embodiment 3 of the invention. The same reference signs are assigned to the same members as in the embodiment described above, and repetitive description is omitted.

As illustrated in FIG. 14, an ink jet-type recording apparatus II according to the present embodiment includes a wiping unit 500 in a non-printing region. The ink jet-type recording apparatus I according to Embodiment 1 includes the negative pressure mechanism 160 in the non-printing region (refer to FIG. 1). The ink jet-type recording apparatus II according to the present embodiment has the same configuration as of the ink jet-type recording apparatus I according to Embodiment 1 except for the above-mentioned units.

The same reference signs are assigned to the same members as in Embodiment 1 described above, and repetitive description is omitted.

In addition, the present embodiment is described using the same directions (X, Y, and Z) as Embodiment 1. In other words, the movement direction of the carriage 3 is referred to as the first direction X, the direction, in which the medium S is transported, is referred to as the second direction Y, and a direction orthogonal to both the first direction X and the second direction Y is referred to as the third direction Z. Further, in the third direction Z, the head unit 2 side with respect to the medium S is referred to as Z1, and the medium S side with respect to the head unit 2 is referred to as Z2.

The ink jet-type recording apparatus II includes an ink jet-type recording head unit 2 (hereinafter, also simply referred to as a head unit 2). The head unit 2 is mounted on the carriage 3. The carriage 3 is provided to perform a reciprocating movement in the axial direction of the carriage shaft 5 attached to the apparatus main body 4.

In the non-printing region on the end portion of the carriage 3 in the movement direction, the wiping unit 500, which wipes the discharge surface of the head unit 2 that will be described in detail below, is provided. The wiping unit 500 includes a wiping portion 510, and a base 520 to which the wiping portion 510 is fixed. As the wiping portion 510, a plate-shaped blade formed of an elastic material such as rubber or an elastomer, a porous material such as cloth or a sponge, or the like, can be used. In the present embodiment, cloth is used as the wiping portion 510. In addition, in the present embodiment, the base 520 is provided to be movable in the second direction Y. Therefore, the wiping unit 500 moves in the second direction Y and wipes the discharge surface of the head unit 2. Incidentally, in the head unit 2, a plurality of nozzle rows, in which the nozzles, to be described below, are arranged in parallel, are arranged, and the parallel-arrangement direction of the nozzles of the nozzle row is the direction parallel to the second direction Y. Therefore, the wiping portion 510 of the wiping unit 500 wipes the nozzle rows in the parallel-arrangement direction of the nozzles.

Figure 15:
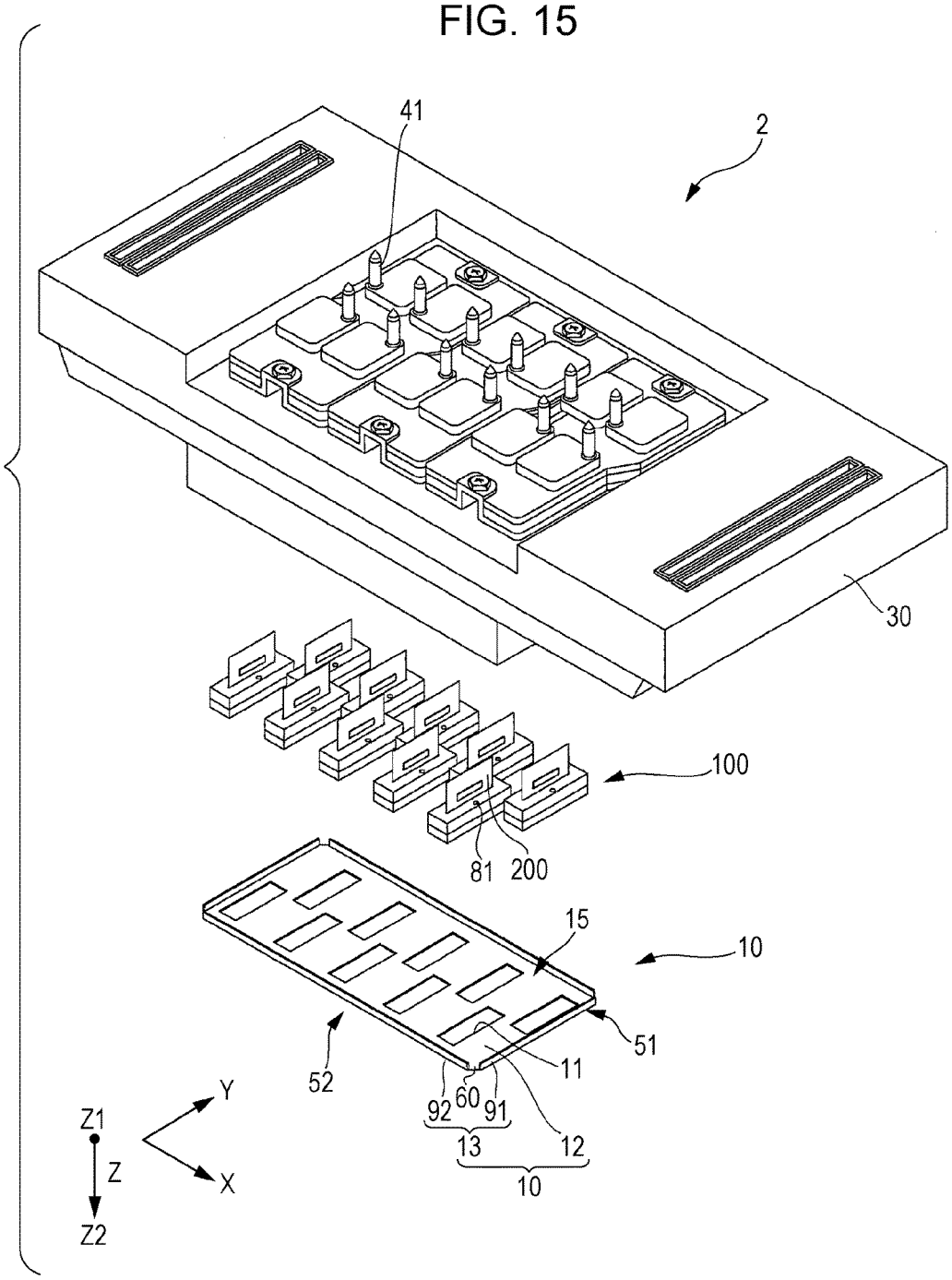
FIG. 15 is an exploded perspective view of a head unit according to Embodiment 3.
Figure 16:
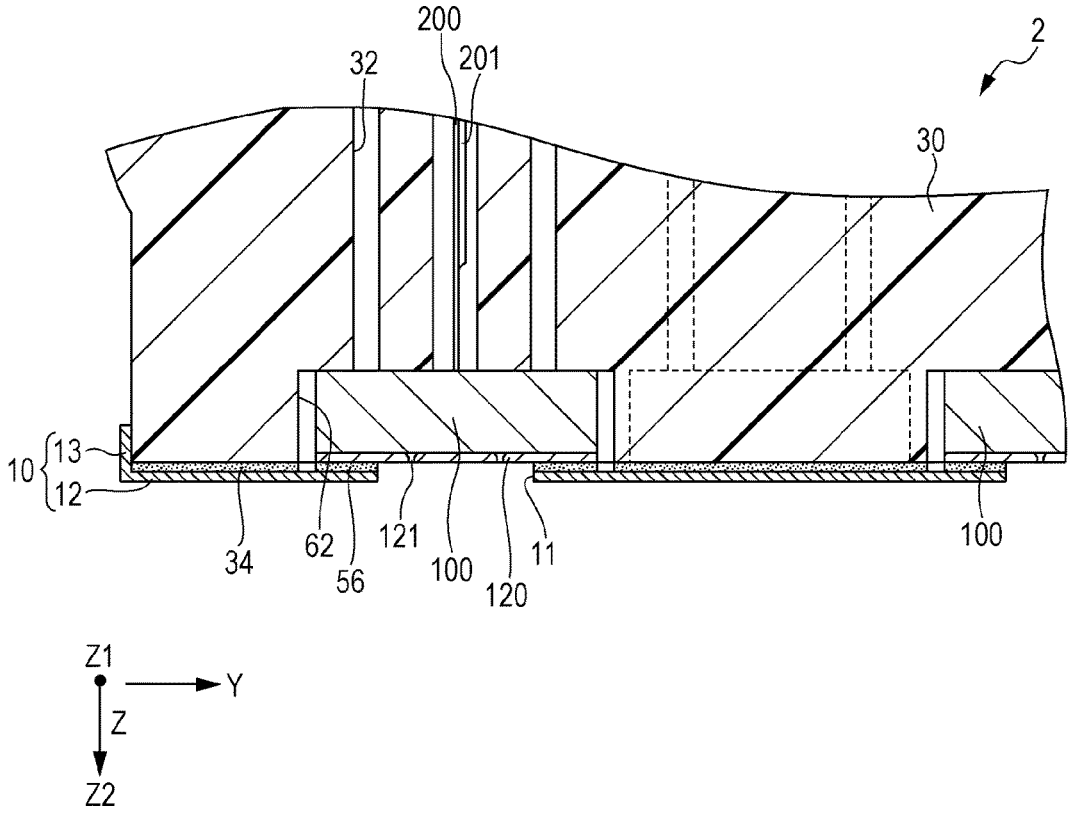
FIG. 16 is a sectional view of main parts of the head unit according to Embodiment 3.

FIG. 15 is an exploded perspective view illustrating the head unit according to Embodiment 3 of the invention. FIG. 16 is a sectional view the head unit. In addition, the perspective view of the head unit 2 of the present embodiment viewed in an oblique direction is the same as the perspective view of the head unit 2 of Embodiment 1 in FIG. 3.

Here, an example of the head unit 2 mounted in the ink jet-type recording apparatus II is described with reference to FIGS. 3, 15, and 16. In the present embodiment, the respective directions of the head unit 2 are described based on a direction when the head unit is mounted in the ink jet-type recording apparatus II, that is, the first direction X, the second direction Y, and the third direction Z. It is needless to mention that disposition of the head unit 2 in the ink jet-type recording apparatus II is not limited to the following description.

As illustrated in FIGS. 15 and 16, the head unit 2 of the present embodiment includes a plurality of ink jet-type heads 100 (hereinafter, also simply referred to as a recording head) that eject an ink droplet from the nozzle 121, the channel holder 30 which holds the plurality of recording heads and is provided with a channel 32 through which the ink is supplied to the head 100, and a fixing plate 10 provided on the nozzles 121 side of the plurality of heads 100.

Further, the head unit 2 of the present embodiment is different from that of Embodiment 1 in that the head unit of the present embodiment does not have the reinforcement plate 20.

The ink supply communication path 81 is opened to a surface of the head 100, and the surface of the head is fixed to the channel holder 30. Then, the ink is supplied from the liquid supply unit 46 though the channel holder 30 to the head.

Further, since the head 100 has the same configuration as the head 100 of Embodiment 1 illustrated in FIGS. 12 and 13, detailed description is omitted.

As illustrated in FIGS. 3 and 15, a plurality of, in the present embodiment, five heads 100 are provided on the channel holder 30 in the first direction X as the parallel-arrangement direction of the nozzle rows 122 and two rows of the heads are arranged in the second direction Y. In other words, a total of 20 nozzle rows 122 are arranged in parallel in the one head unit 2 in the first direction X. The two heads 100 which eject the same ink are disposed to be shifted in the second direction Y from each other, thereby elongating, in the second direction Y, the nozzle rows 122 that eject the same ink by the two recording heads.

Here, as illustrated in FIGS. 15 and 16, the channel holder 30 has, on a surface on Z1 side of the third direction Z, the plurality of connection sections 41 to which the liquid supply unit 46 is connected via the supply tube 47. In the present embodiment, a needle-shaped member projects as the connection section 41. In addition, the plurality of channels 32 are provided inside the channel holder 30, and one end of the channel is opened to the connection section 41, and the other end is opened at a position of the head 100, to which the ink supply communication path 81 is connected, of a surface on Z2 side in the third direction Z. Further, a filter for removing bubbles or a foreign substance contained in the ink in the channel 32 may be provided inside the channel holder 30. In addition, the circuit board or the like to which the cable 200 of the head 100 is connected, may be held inside the channel holder 30. Moreover, the channel 32 may diverge into two or more channels in the channel holder 30.

On the one hand, a head accommodating section 62 that can accommodate the head 100 inside is provided on the surface of the channel holder 30 on Z2 side, to which the channel 32 is opened. The head accommodating section 62 has a recessed shape that is opened to the surface of the channel holder 30 on Z2 side. Such a head accommodating section 62 may be provided for each head 100, or may be provided as a common section to the plurality of heads 100. Here, the head accommodating section 62 is provided individually for each head 100; however, it is possible to increase rigidity of the channel holder 30, and it is possible to improve the flatness of the fixing plate 10 and the nozzle plate 120 by increasing a joined area between the channel holder 30 and the fixing plate 10.

The fixing plate 10 is fixed to the surface of the channel holder 30 on Z2 side, to which the head accommodating section 62 is opened. In the present embodiment, the surface of the channel holder 30 on Z2 side and the fixing plate 10 are joined by an adhesive 34. The fixing plate 10 which will be described in detail below is fixed in a state in which the nozzle rows 122 are exposed also on the nozzle plates 120 of the heads 100, and a portion of the opening, except for the nozzle rows 122, of the head accommodating section 62 on Z2 side is covered by the fixing plate 10. In this manner, it is possible to suppress entering of the ink or a foreign substance between the head 100 and the head accommodating section 62.

Figure 17:
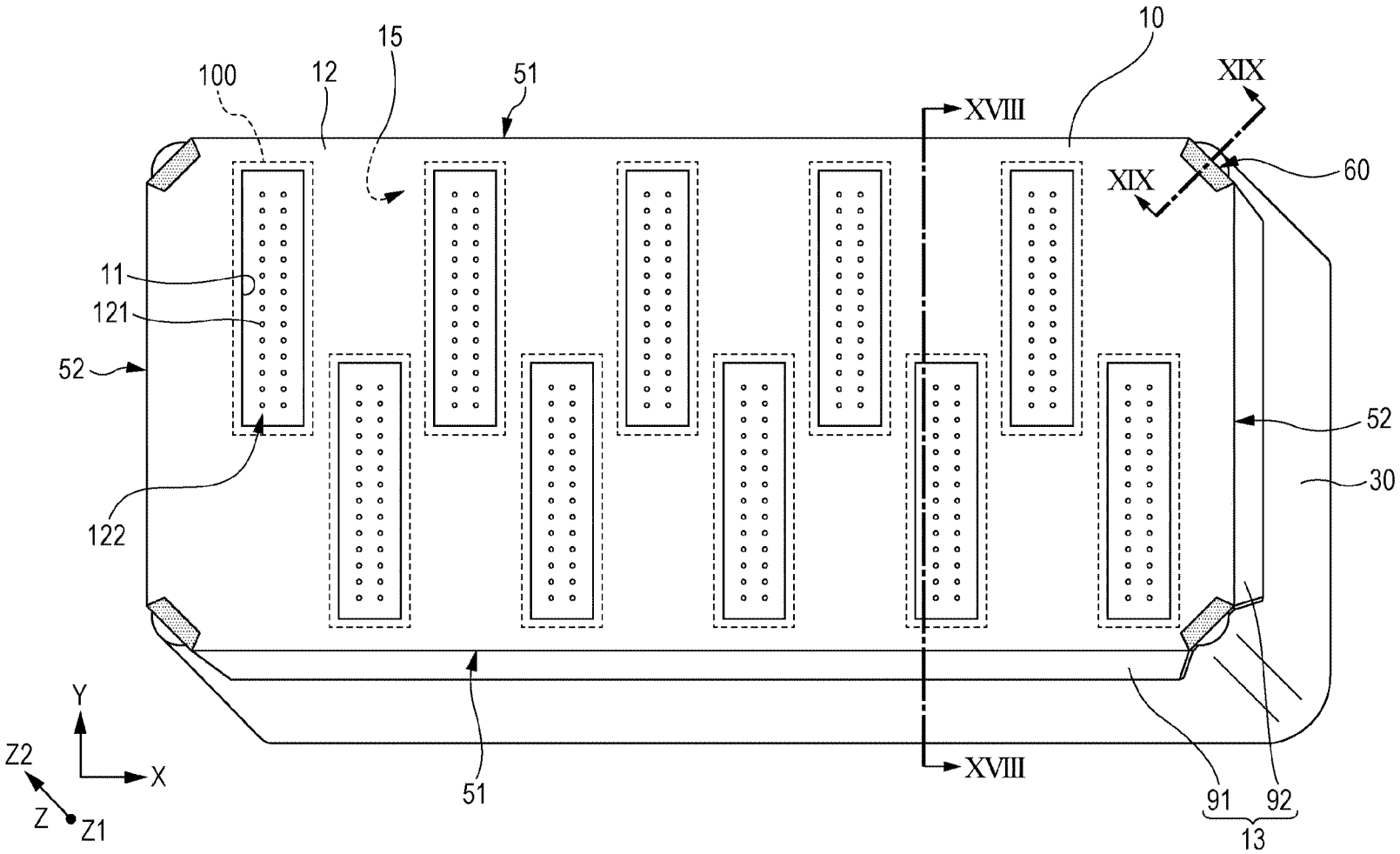
FIG. 17 is a perspective view of main parts of the head unit according to Embodiment 3.
Figure 18:
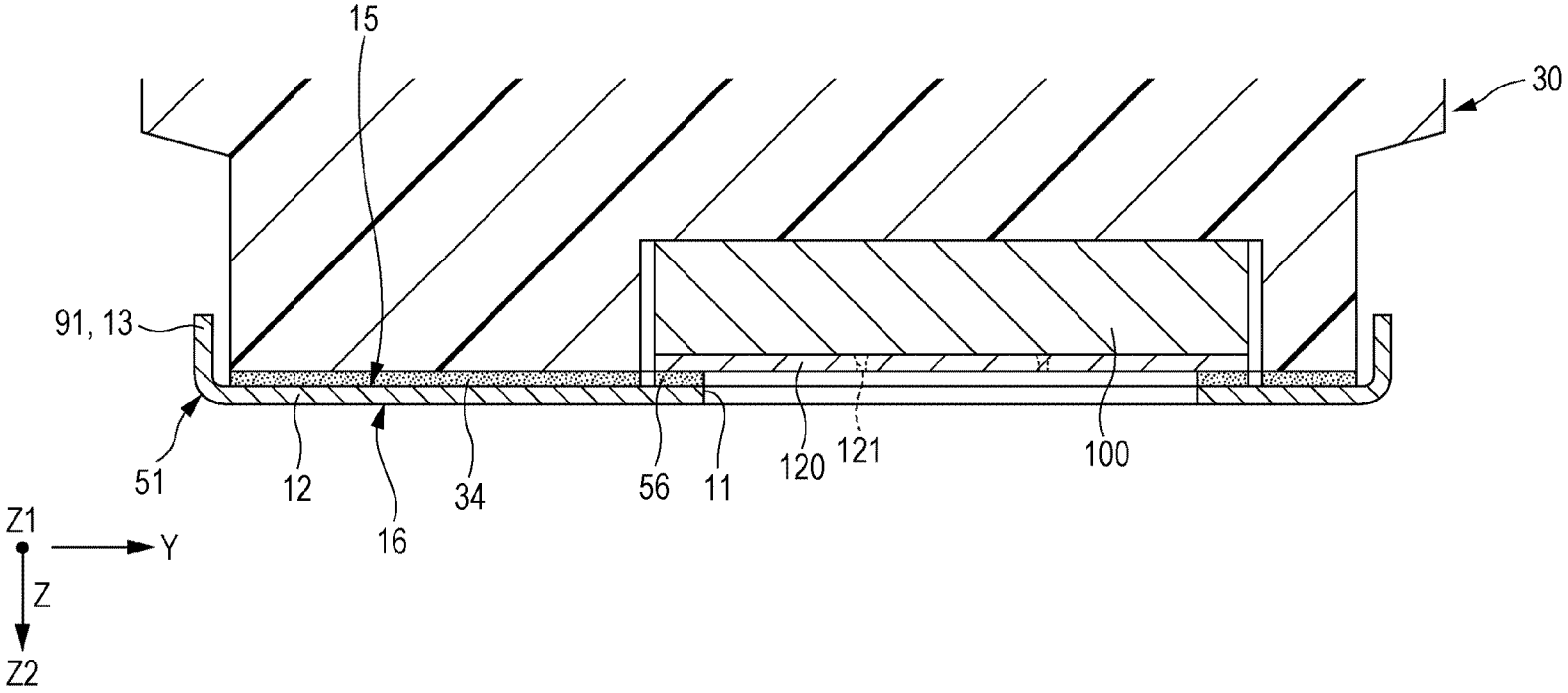
FIG. 18 is a sectional view of main parts of the head unit according to Embodiment 3.
Figure 19:
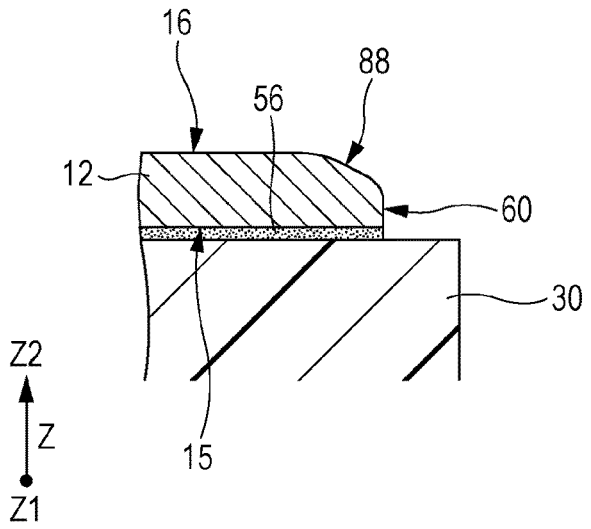
FIG. 19 is a sectional view of main parts of the head unit according to Embodiment 3.

Here, the fixing plate 10 is described with reference to FIGS. 17 to 19. FIG. 17 is a perspective view of main parts of the head unit. FIG. 18 is a sectional view taken along line XVIII-XVIII in FIG. 17. FIG. 19 is a sectional view taken along line XIX-XIX in FIG. 17.

As illustrated in FIGS. 17 to 19, the fixing plate 10 includes the bottom section 12, the edge section 60, and the side surface section 13 which is continuous to the bottom section 12 and is bent with respect to the bottom section 12.

The bottom section 12 has a plate shape and has a shape of which the four corners are chamfered based on a rectangular shape when viewed in a plan view in the third direction Z. In other words, the bottom section 12 has two first edges 51 in the first direction X, and two second edges 52 in the second direction Y. In addition, the bottom section 12 has the first surface 15 to which the head 100 is fixed, and the second surface 16 on the side opposite to the first surface 15. The plurality of openings 11 are provided in the bottom section 12 so as to correspond to the heads 100, respectively. A total of 10 openings 11 are provided for the respective heads 100 such that each of the nozzle rows 122 of the heads 100 is individually exposed. The openings 11 has an opening slightly smaller than the nozzle plate 120 of the head 100, and the first surface 15 of the bottom section 12 is fixed with the nozzle plate 120 on the opening edge portion of the opening 11. Further, the bottom section 12 and the nozzle plate 120 are fixed, for example, by an adhesive 56.

The side surface section 13 extends from the bottom section 12 toward the first surface 15 side. In other words, the side surface section 13 is formed to have a portion continuous to the bottom section 12, which is bent to Z1 side, as the first surface 15 side. Such a side surface section 13 is provided to be continuous from the two first edges 51 in the first direction X and the two second edges 52 in the second direction Y of the bottom section 12. In other words, the side surface section 13 has two first side surface sections 91 provided in the first direction X so as to be continuous to the first edges 51 of the bottom section 12 in the first direction X, and two second side surface sections 92 provided in the second direction Y so as to be continuous to the second edges 52 of the bottom section 12 in the second direction Y. The two first side surface sections 91 and the two second side surface sections 92 are not connected and are discontinuous from each other in a circumferential direction of the bottom section 12. Accordingly, the side surface section 13 is provided, thereby making it possible to increase rigidity of the fixing plate 10, and making it possible to reduce deformation and peeling off of the fixing plate 10 against an external force produced when the medium S comes into contact therewith.

The edge section 60 is an outer circumferential edge section by which the first surface 15 is separated from the second surface 16 of the bottom section 12, and does not contain a portion continuous to the side surface section 13.

In other words, the edge section 60 is the outer circumferential edge section of the bottom section 12, and a portion other than the first edge 51 and the second edge 52 to which the side surface section 13 is continuous, of the bottom section 12. In other words, in the present embodiment, four portions, at which the first side surface sections 91 and the second side surface sections 92 of the bottom section 12 are disconnected, are provided, and the four disconnected portions are the edge section 60. Further, the edge section 60 may be an end surface (surface) by which the first surface 15 is separated from the second surface 16, or may be a portion of a line-contact edge, for example, in a case where at least one of the first surface 15 or the second surface 16 is provided to be inclined, the end surface, by which the first surface 15 is separated from the second surface 16, does not exist, the thickness is gradually decreased, and the first surface 15 and the second surface 16 are brought into line contact with each other.

A rounded portion 88 rounded from the second surface 16 toward the first surface 15 is provided between the bottom section 12 and the edge section 60. In other words, the bottom section 12 is surrounded by the side surface section 13 and the rounded portion 88. Here, the rounded portion 88 is rounded from the second surface 16 toward the first surface 15, which means that the front surface of the rounded portion 88 on the second surface 16 side is positioned on the first surface 15 side than a virtual plane as extension of the second surface 16 in the in-plane direction. Further, in the present embodiment, the rounded portion 88 is a portion provided between the second surface 16 of the bottom section 12 and the edge section 60, and is not provided between the first surface 15 of the bottom section 12 and the edge section 60. In other words, a portion between the first surface 15 of the bottom section 12 and the edge section 60 is not rounded. In this manner, it is possible to have a flat surface on the second surface 16 side of the fixing plate 10, and it is possible to reduce variations in the space between the fixing plate 10 and the channel holder 30, and to reduce variations in joining strength when the channel holder 30 and the fixing plate 10 are joined. It is needless to mention that the rounded portion 88 is not limited thereto, and, for example, may also be provided between the first surface 15 of the bottom section 12 and the edge section 60. In other words, the rounded portion 88 having rounded surfaces on both sides of the first surface 15 side and the second surface 16 side of the bottom section 12 of the fixing plate 10 may be provided. In addition, in the present embodiment, the rounded portion 88 is provided to have the front surface on the second surface 16 side which is curved to form a convex surface. It is needless to mention that the rounded portion 88 is not limited thereto, and may have a flat surface which is inclined with respect to the second surface 16. In other words, the rounded portion 88 may have an angle greater than 90 degrees at a boundary portion between the front surface of the rounded portion 88 and the second surface 16 of the bottom section 12. Here, it is preferable that no edge is formed at the boundary portion between the front surface of the rounded portion 88 and the second surface 16 if possible. Therefore, preferably, the angle at a boundary portion between the front surface of the rounded portion 88 and the second surface 16 is continuously changed so as to form a so-called convex surface. In this manner, forming of an edge at a boundary portion between the front surface of the rounded portion 88 and the second surface 16 is suppressed, and thus, it is possible to reduce occurrence of scratches, wearing away, and damage to the wiping portion 510. Similarly, with the angle between the front surface of the rounded portion 88 on the second surface 16 side and the front surface of the edge section 60, the boundary portion between the front surface of the rounded portion 88 and the front surface (end surface) of the edge section 60 may be positioned on the first surface 15 side from the second surface 16 and the angle at the boundary portion between the front surface of the rounded portion 88 and the front surface (end surface) of the edge section 60 may be greater than 90 degrees.

The first surface 15 of the fixing plate 10 is fixed to the surface of the channel holder 30 on Z2 side in the third direction Z. In addition, the fixing plate 10 covers the opening of the head accommodating section 62 and is fixed with the nozzle plate 120 of the head 100 held in the head accommodating section 62. In this manner, the discharge surface of the head unit 2 is defined by the nozzle plate 120 and the second surface 16 of the fixing plate 10. In other words, the discharge surface of the head unit 2 is positioned facing the medium S during the printing.

Figure 20:
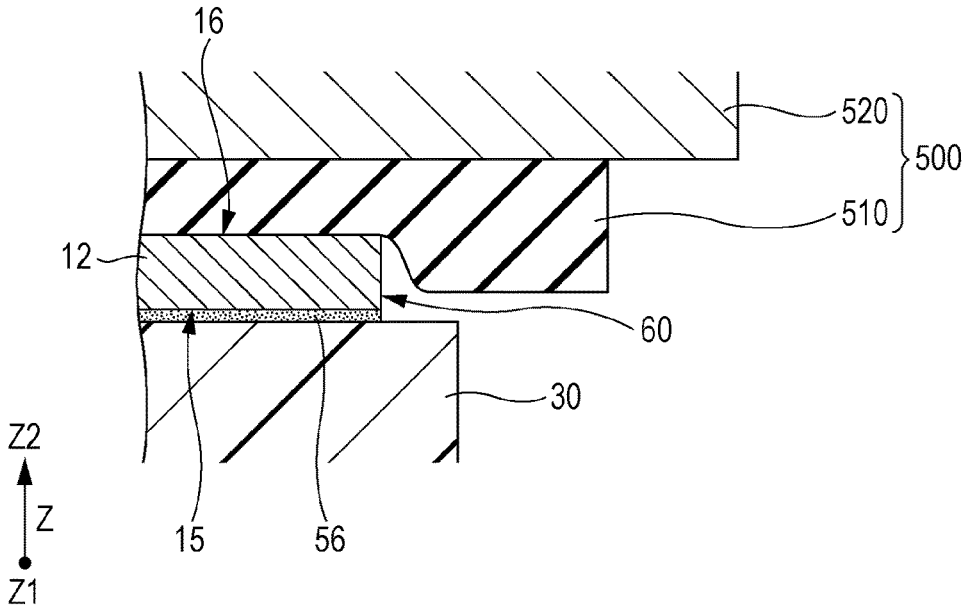
FIG. 20 is a sectional view of main parts of a comparative head unit.
Figure 21:
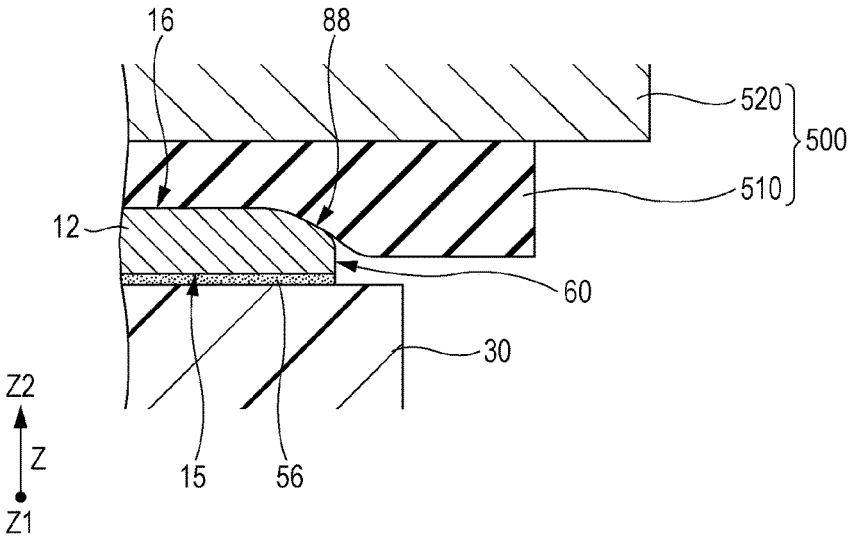
FIG. 21 is a sectional view of main parts of the head unit according to Embodiment 3.

The discharge surface of the head unit 2, that is, the front surface exposed by the openings 11 of the nozzle plate 120 and the second surface 16 of the bottom section 12 of the fixing plate 10 are wiped and cleaned by the wiping unit 500 mounted in the ink jet-type recording apparatus II described above. In the present embodiment, the rounded portion 88 is provided between the bottom section 12 and the edge section 60 of the fixing plate 10, and thereby forming of a sharp edge at the boundary portion between the bottom section 12 and the edge section 60 is suppressed. Thus, it is possible to reduce occurrence of scratches, wearing away, or damage to the wiping portion 510 due to the sharp edge. In other words, the wiping portion 510 performs the wiping in a state of being in contact with the fixing plate 10 and applying pressure to the fixing plate 10 on Z1 side in the third direction Z. Therefore, as illustrated in FIG. 20, in a case where the rounded portion 88 is not provided on the fixing plate 10, a sharp edge is likely to be formed on the boundary portion between the edge section 60 and the second surface 16. Then, the wiping portion 510 is likely to be scratched, worn away, or damaged due to the contact of the wiping portion 510 with the edge of the boundary portion. For example, in a case where the wiping portion 510 is an elastic material such as rubber or an elastomer, the wiping portion 510 is scratched and worn away. In a case where the wiping portion 510 is a porous material such as cloth or a sponge, the wiping portion 510 is caught on the sharp edge of the fixing plate 10 and is damaged. In this respect, in the present embodiment, as illustrated in FIG. 21, the rounded portion 88 is provided on the boundary portion between the edge section 60 and the second surface 16, and thereby angles formed at the boundary portion between the front surface of the rounded portion 88 and the second surface 16, and at the boundary portion between the front surface of the rounded portion 88 and the front surface of the edge section 60 can be more gradual, compared to those in FIG. 20. Hence, it is possible to reduce occurrence of scratches, wearing out, and damage to the surface of the wiping portion 510 with which the fixing plate 10 comes into contact. Further, the angle of the boundary portion between the front surface of the rounded portion 88 and the second surface 16, and the angle of the boundary portion between the front surface of the rounded portion 88 and the front surface of the edge section 60 are greater than 90 degrees as described above, thereby making it possible to have more gradual surface than that in FIG. 20.

Further, the fixing plate 10 is formed by cutting a plate-shaped member formed of a metal material such as stainless steel, in a so-called development view shape, with the side surface section 13 of the fixing plate 10 spread, and then by bending the side surface section 13. Therefore, it is possible to achieve high flatness of the bottom section 12, compared to the case where the side surface section 13 is formed by drawing. Therefore, it is possible to reduce positional variations in the nozzles 121 of the plurality of heads 100 in the third direction Z or variations in the angle with respect to the third direction Z, and it is possible to reduce a shift of the landing position of the ink on the medium S.

Figure 22:
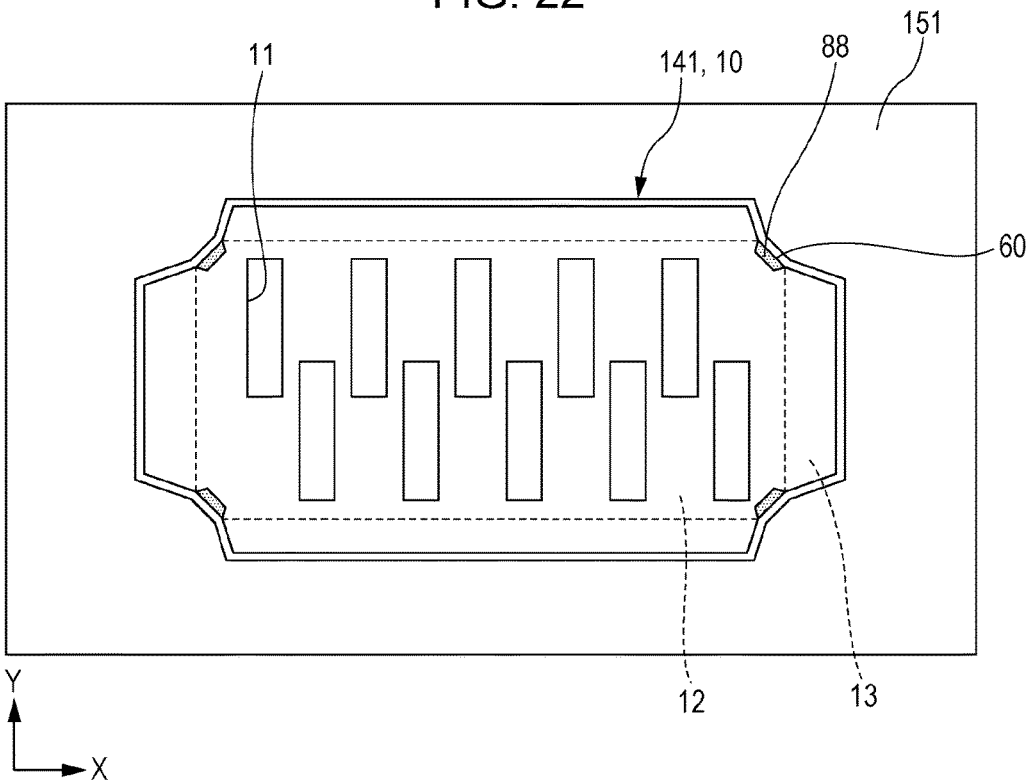
FIG. 22 is a plan view illustrating a method of manufacturing the head unit according to Embodiment 3.

Here, a method of manufacturing the head unit 2 is described with reference to FIGS. 22 to 26. FIGS. 22 to 26 are plan views illustrating the method of manufacturing the head unit, FIG. 22 is a plan view, and FIGS. 23 to 26 are sectional views.

In the present embodiment, a fixing plate forming section 141 which becomes the fixing plate 10 is cut out from a plate-shaped member 151 having a flat plate shape, then, the cut-out fixing plate forming section 141 is bent, and the fixing plate 10 having side surface section 13 is formed. Specifically, as illustrated in FIG. 22, first, openings 11 are formed in the plate-shaped member 151 and the fixing plate forming section 141 which becomes the fixing plate 10 is cut out from a plate-shaped member 151. Here, forming of the openings 11 in the plate-shaped member 151 and cutting out the fixing plate forming section 141 from the plate-shaped member 151 can be performed by punching of press working. In other words, the edge of the openings 11 is punched in the plate-shaped member 151 by the press working, thereby making it possible to form the openings 11. In addition, the edge to become the side surface section 13 of the fixing plate 10, the edge to become the rounded portion 88, and the edge section 60 are punched in the plate-shaped member 151 by the press working, thereby cutting the fixing plate forming section 141 to become the fixing plate 10 from the plate-shaped member 151. Further, with respect to the plate-shaped member 151, the forming of the openings 11 and the cutting the fixing plate forming section 141 may be performed at the same time, that is, may be performed by the press working by once, or may be performed individually by separate process of the press working. Similarly, when the edge of the side surface section 13, and the edge of the rounded portion 88 are punched by the press working, the punching process of the edge of the side surface section 13 by the press working, and the punching process of the edge of the rounded portion 88 by the press working may be performed at the same time, or may be performed as separate processes. Further, the forming of the openings 11 and the cutting the fixing plate forming section 141 from the plate-shaped member 151 are not limited to the press working, and may be performed by laser processing or the like. Here, when the fixing plate 10 is formed by the press working compared to the laser processing, it is possible to perform mass-production with a low cost.

Further, in the present embodiment, when the edge of the rounded portion 88 is punched by the press working in the plate-shaped member 151, the rounded portion 88 is simultaneously formed by the press working. Here, as a method of punching the edge of the rounded portion 88 by the press working, and the forming of the rounded portion 88 at the same time, the following methods are employed.

Figure 23:
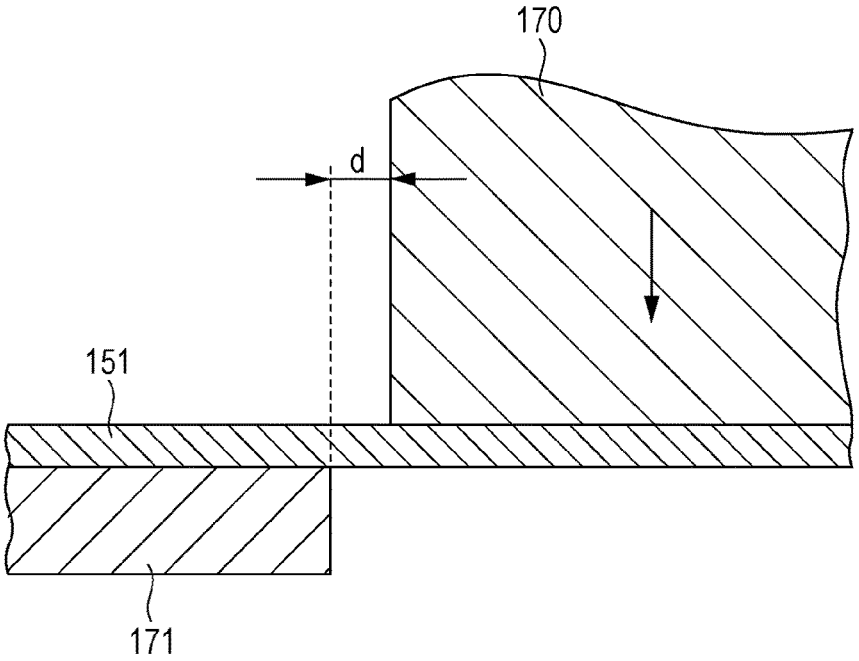
FIG. 23 is a sectional view illustrating a method of manufacturing the head unit according to Embodiment 3.
Figure 24:
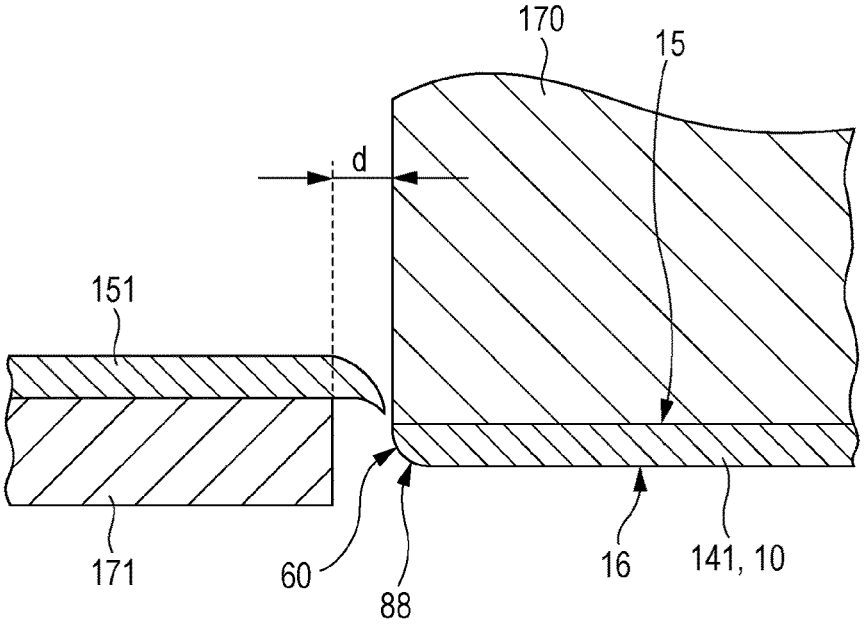
FIG. 24 is a sectional view illustrating a method of manufacturing the head unit according to Embodiment 3.

As illustrated in FIG. 23, the plate-shaped member 151 is mounted on a base 171, and the fixing plate forming section 141 of the plate-shaped member 151 is punched by a punch 170, thereby cutting the edge of the rounded portion 88, as illustrated in FIG. 24. At that time, the edge of the rounded portion 88 is punched with a slightly wide space d between the base 171 and the punch 170, thereby making it possible to form the rounded portion 88 with an undercut on the edge of the fixing plate forming section 141. In other words, the rounded portion 88 can be formed by the press working by being punched on the edge of the rounded portion 88 and an undercut produced when punching is performed. Further, in addition to the method in which the base 171 and the punch 170 have a wide space d, as a method of forming the rounded portion 88, the undercut is also produced by rounding a blade of one or both of the base 171 and the punch 170 and the rounded portion 88 can be formed by the undercut. In addition, the method of forming the rounded portion 88 is not limited to the punching of the press working, and, the rounded portion 88 may be formed by, for example, the surface pressing of the press working. It is needless to mention that the forming of the rounded portion 88 is not limited to the press working, and the rounded portion may be formed by mechanical polishing. In other words, the process of forming the rounded portion 88 may be performed simultaneously with the punching of the edge of the rounded portion 88, or may be performed as a separate process after the edge of the rounded portion 88 is punched.

Figure 25:
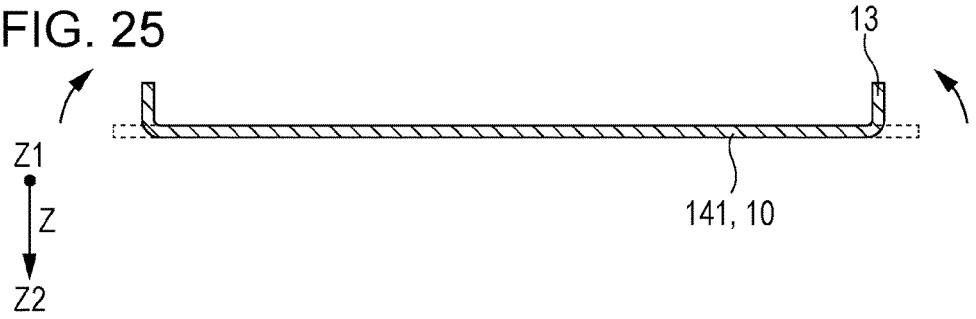
FIG. 25 is a sectional view illustrating a method of manufacturing the head unit according to Embodiment 3.

After the portion which becomes the fixing plate forming section 141 is cut out from the plate-shaped member 151, the side surface section 13 of the fixing plate forming section 141 is bent to the first surface 15 side, thereby making it possible to form the fixing plate 10, as illustrated in FIG. 25. The bending of the side surface section 13 can be performed in bending process by the press working. It is needless to mention that the bending of the side surface section 13 of the fixing plate forming section 141 may be performed simultaneously with the cutting out the fixing plate forming section 141.

Figure 26:
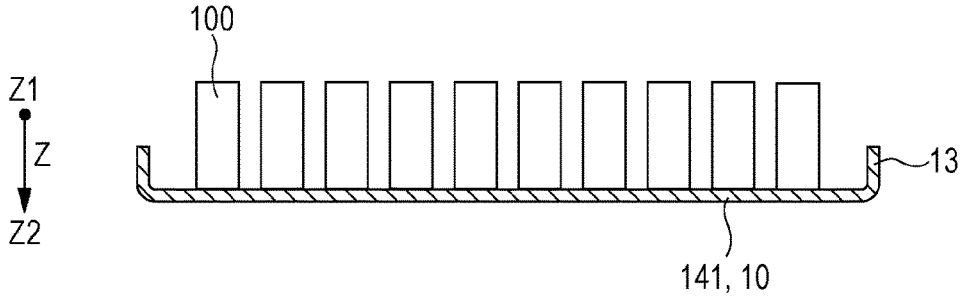
FIG. 26 is a sectional view illustrating a method of manufacturing the head unit according to Embodiment 3.

Next, as illustrated in FIG. 26, relative positions of the plurality of heads 100 are positioned and fixed on the fixing plate 10. Specifically, with positions of the nozzles 121 of the heads 100 as references, the relative positions of the plurality of heads 100 are positioned. In this manner, it is possible to perform relative positioning of the nozzles 121 of the plurality of heads 100 with high accuracy. In addition, since the plurality of heads 100 abut on the first surface 15 of the fixing plate 10 formed of the flat plate and are fixed to the fixing plate 10, only by fixing the plurality of heads 100 to the fixing plate 10, the relative positioning is performed with high accuracy in an ejection direction of the ink droplet of the plurality of heads 100, that is, in the third direction Z. Therefore, there is no need to perform the relative positioning of the plurality of heads 100 in the third direction Z and it is possible to reduce a shift of the landing position of the ink droplet. In addition, since the fixing plate 10, to which the plurality of heads 100 are fixed, is not formed by the drawing in which the side surface section 13 is continuous in a circumferential direction of the bottom section 12, but is configured to have the side surface section 13 that is not continuous along the first edge 51 and the second edge 52 of the bottom section 12, that is, is configured to have the side surface section which is continuous only at the first edge 51 and the second edge 52 having the straight line of the bottom section 12, low stress is applied to the bottom section 12 when the side surface section 13 is bent, compared to the drawing. Therefore, for the fixing plate 10 of the present embodiment, it is possible to improve the flatness of the bottom section 12 compared to the drawing, and thus, it is possible to reduce the positional shift of the plurality of heads 100 in the third direction Z and the angle deviation of the heads with respect to the third direction Z. Therefore, it is possible to reduce the shift of the landing position of the ink droplet ejected from the plurality of heads 100 on the medium S, thereby making it possible to improve print quality.

Accordingly, as illustrated in FIGS. 3 and 15, the fixing plate 10, to which the plurality of heads 100 are fixed, is fixed to the surface of the channel holder 30 on Z2 side. In addition, the plurality of heads 100 are fixed in the head accommodating section 62 of the channel holder 30, thereby making it possible to achieve the head unit 2 of the present embodiment.

Embodiment 4

Figure 27:
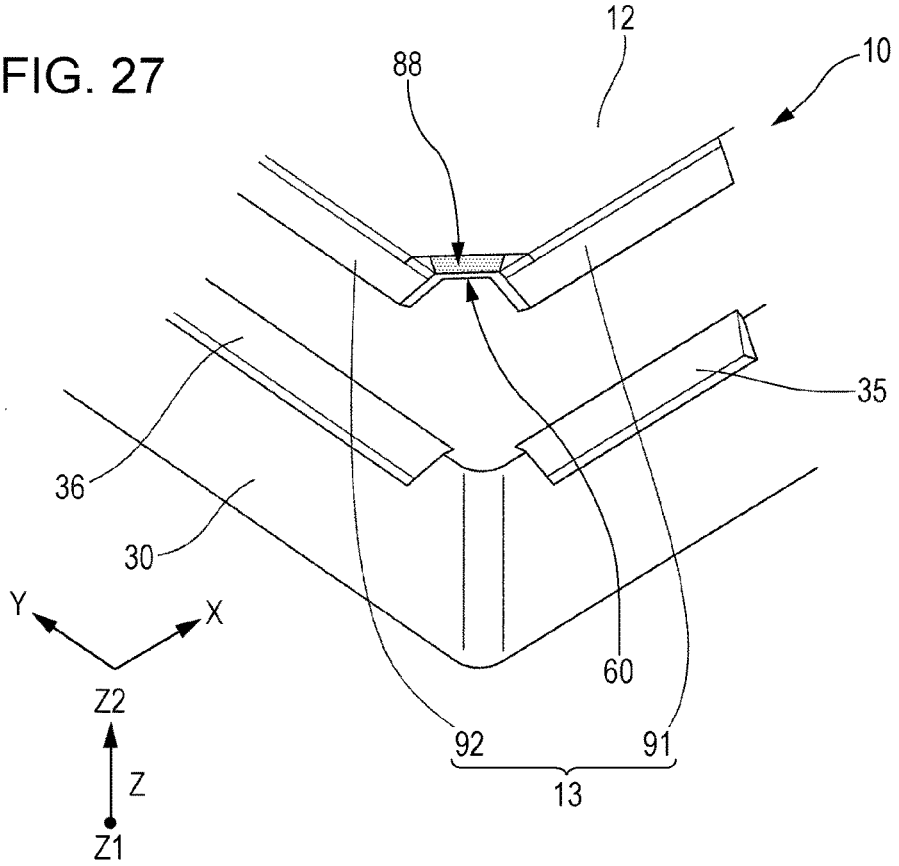
FIG. 27 is a perspective view of main parts of a head unit according to Embodiment 4.
Figure 28:
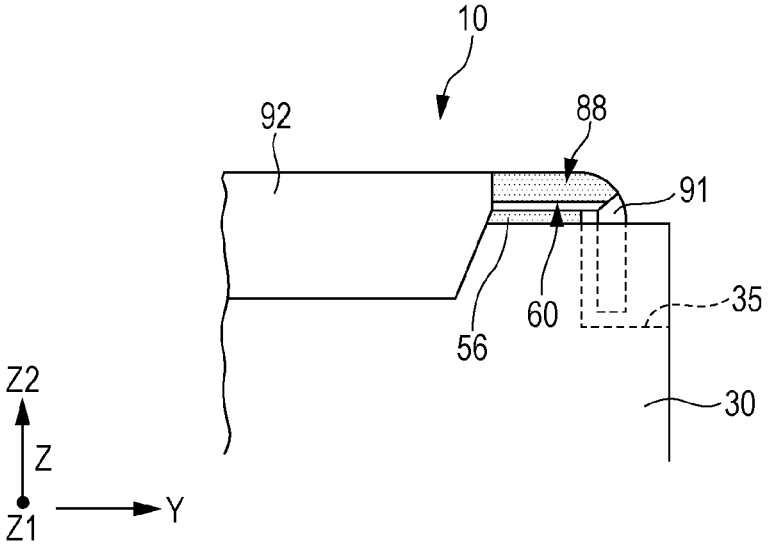
FIG. 28 is a side view of main parts of the head unit according to Embodiment 4.
Figure 29:
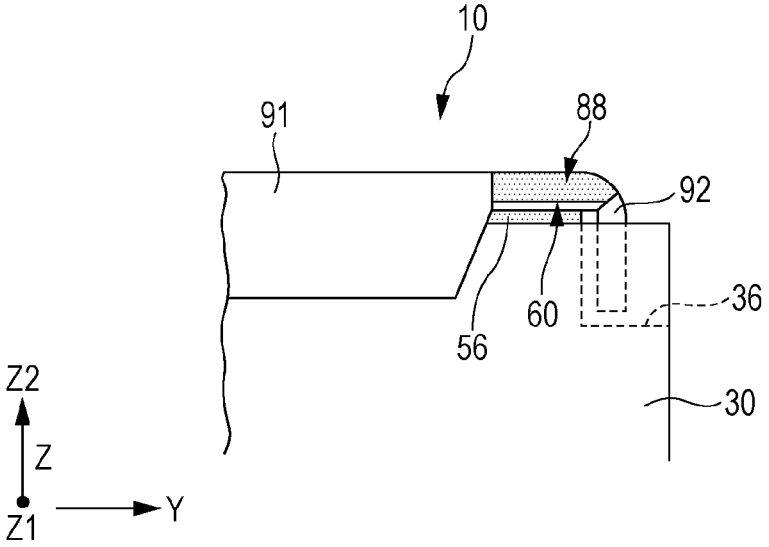
FIG. 29 is a side view of main parts of the head unit according to Embodiment 4.

FIG. 27 is a perspective view of main parts of the head unit according to Embodiment 4 of the invention. FIGS. 28 and 29 are side views of main parts of the head unit. The same reference signs are assigned to the same members as in the embodiment described above, and repetitive description is omitted.

As illustrated in FIGS. 27 to 29, in the present embodiment, the recessed section is formed in the channel holder 30, and the side surface section 13 of the fixing plate 10 is accommodated in the recessed portion. Specifically, the channel holder 30 has a first side recessed portion 35 in which the first side surface section 91 is accommodated, and a second side recessed portion 36 in which the second side surface section 92 of the fixing plate 10 is accommodated.

The first side recessed portion 35 and the second side recessed portion 36 is deeper than the thickness of the first side surface section 91 and the second side surface section 92, and the first side surface section 91 accommodated in the first side recessed portion 35, and the second side surface section 92 accommodated in the second side recessed portion 36, are accommodated, respectively, without projecting in the first direction X and the second direction Y from the side surface of the channel holder 30.

The side surface section 13 of the fixing plate 10 is accommodated in the first side recessed portion 35 and the second side recessed portion 36 of the channel holder 30, almost the entire edge of the side surface section 13 of the fixing plate 10 is positioned in the first side recessed portion 35 and the second side recessed portion 36 of the channel holder 30, and is not exposed to the outside. Hence, when the wiping portion 510 comes into contact with the fixing plate 10, it is possible to reduce occurrence of the scratches, wearing away and damage to the wiping portion 510 due to the edge of the side surface section 13.

Further, in the present embodiment, the first side recessed portion 35 accommodating the first side surface section 91 and the second side recessed portion 36 accommodating the second side surface section 92 are provided; however, the configuration is not limited thereto, and only one of the first side recessed portion 35 or the second side recessed portion 36 may be provided.

Figure 30:
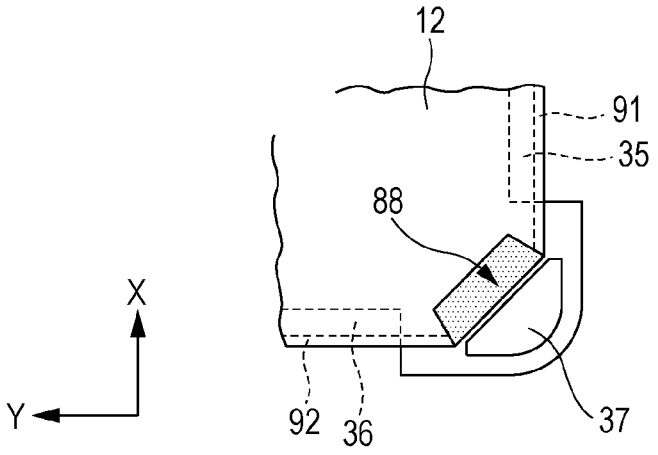
FIG. 30 is a perspective view of main parts illustrating a modification example of the head unit according to Embodiment 4.
Figure 31:
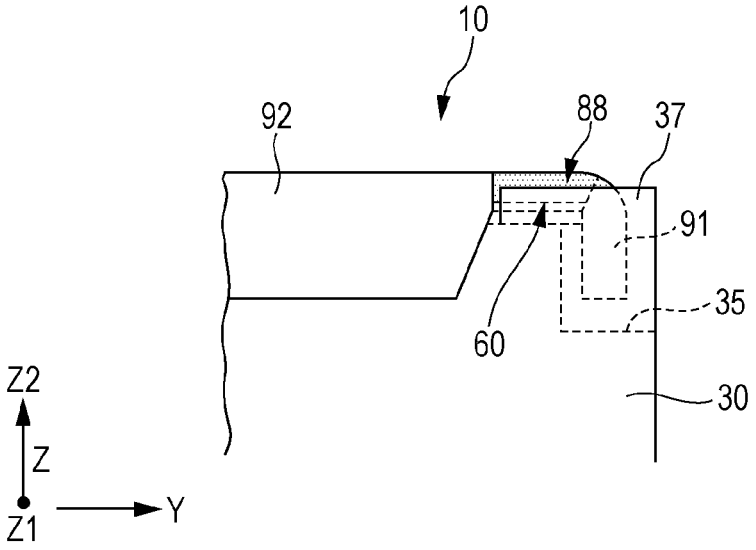
FIG. 31 is a side view of main parts illustrating a modification example of the head unit according to Embodiment 4.

In addition, in the present embodiment, almost entire edge of the side surface section 13 of the fixing plate 10 is accommodated in the first side recessed portion 35 and the second side recessed portion 36 of the channel holder 30; however, the edge positioned on Z1 side of the channel holder 30, of the edge of the side surface section 13, is positioned outside the first side recessed portion 35 and the second side recessed portion 36 and is exposed to the outside. Therefore, as illustrated in FIGS. 30 and 31, the edge projects from the first surface 15 toward the second surface 16 side on the surface of the channel holder 30 on Z2 side, and there may be provided a wall section 37 which covers the edge exposed to the outside on the outer side of the first side recessed portion 35 and the second side recessed portion 36 of the side surface section 13 of the fixing plate 10. Such a wall section 37 is provided so as to cover the edge of the side surface section 13, and thereby it is difficult for the wiping portion 510 to come into contact with the edge of the side surface section 13, and it is possible to further reduce scratches, wearing away, and breaking of the wiping portion 510.

Other Embodiments

As above, an embodiment of the invention is described; however, the fundamental configuration of the invention is not limited to Embodiments 3 and 4 described above.

Figure 32:
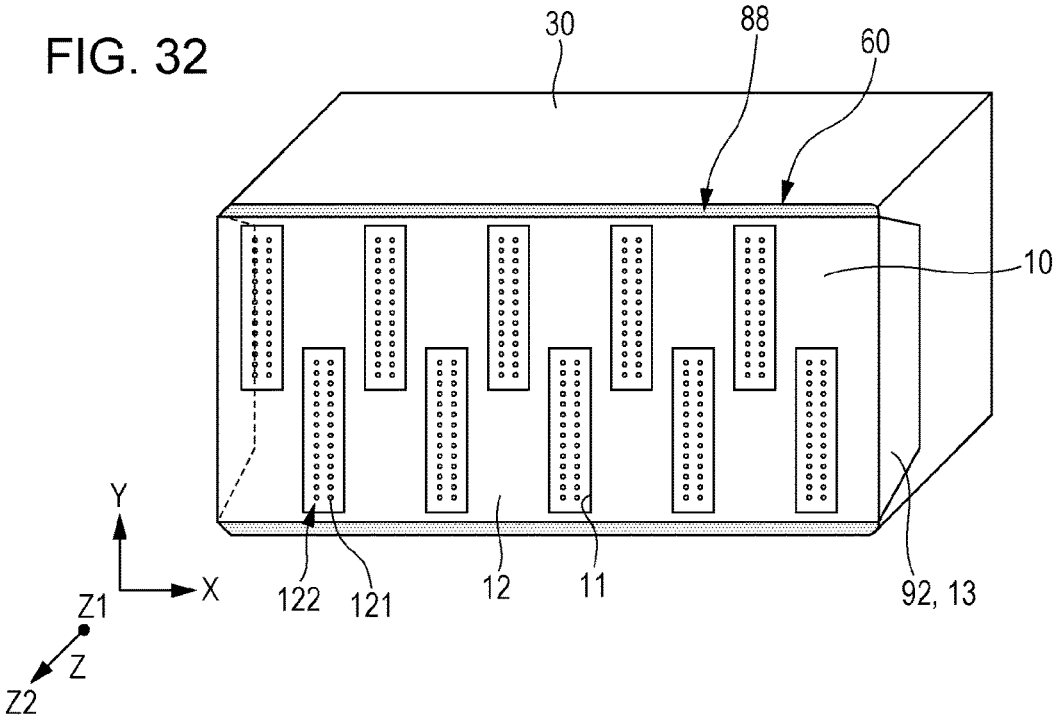
FIG. 32 is a perspective view of main parts illustrating a head unit according to another Embodiment.
Figure 33:
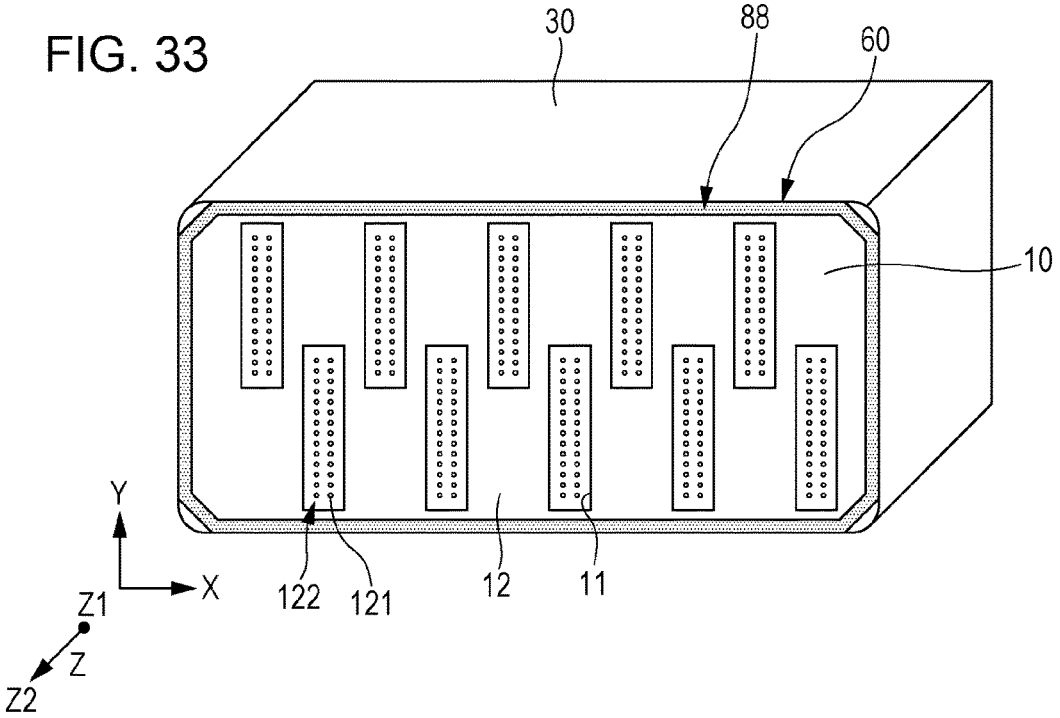
FIG. 33 is a perspective view of main parts illustrating a head unit according to still another Embodiment.

For example, in Embodiments 3 and 4, the case where the side surface section 13 having the first side surface section 91 and the second side surface section 92 is provided as the fixing plate 10 is described; however the configuration is not particularly limited thereto. Here, FIGS. 32 and 33 illustrate another example of the fixing plate 10. Further, FIGS. 32 and 33 are perspective views of main parts illustrating the head unit according to another embodiment.

As illustrated in FIG. 32, the fixing plate 10 is provided with only the second side surface section 92 as the side surface section 13. In this case, the two first edges 51, in the first direction X, which is continuous to the first side surface section 91 of the bottom section 12, become the edge section 60, and the rounded portion 88 is provided between the edge section 60 and the bottom section 12.

In addition, as illustrated in FIG. 33, the fixing plate 10 may not be provided with the side surface section 13. In this case, the entirety of the outer circumference in the circumferential direction of the bottom section 12 becomes the edge section 60, and the rounded portion 88 is provided over the entire outer circumference in the circumferential direction. Accordingly, the fixing plate 10 illustrated in FIGS. 32 and 33, it is possible to reduce occurrence of scratches, wearing away, and damage to the wiping portion 510 by the rounded portion 88.

In addition, in Embodiments 3 and 4 described above, a configuration, in which the two rows of heads 100 provided in parallel in the second direction Y are arranged in the first direction X, is described; however, the number and the disposition of the heads 100 fixed to the fixing plate 10 are not limited to the above description. In addition two or more fixing plates 10 may be provided in the one head unit 2. Here, two or more of the plurality of heads 100 are fixed to the one fixing plate 10.

Further, in Embodiments 3 and 4 described above, the nozzle plate 120 of the head 100 and the fixing plate 10 are fixed to each other; however, the configuration is not limited thereto, and the fixing plate 10 may be fixed to the channel substrate other than the nozzle plate 120 of the head 100. Here, the channel 32 of the channel holder 30 communicates with the nozzle 121 by the channel substrate of the head 100, and in Embodiments 3 and 4 described above, the channel substrate 110 or the like is used as the channel substrate. Incidentally, in Embodiments 3 and 4 described above, since the channel substrate 110 does not have a surface exposed to Z2 side, it is not possible to directly fix the first surface 15 of the fixing plate 10 to the channel substrate 110. For example, in a case where, as a communication plate having a wider area than the nozzle plate 120 provided between the channel substrate 110 and the nozzle plate 120, the communication plate provided with a communication path, through which the pressure generating chamber 112 and the nozzle 121 communicate with each other, is provided, the fixing plate 10 may be fixed to the communication plate. In addition, in a case where another substrate, for example, a compliance substrate or the like is fixed to the surface of the communication plate on the nozzle plate 120 side, the fixing plate 10 may be fixed to the other substrate such as the compliance substrate. In other words, the channel substrate of the head 100, to which the fixing plate 10 is fixed, is a substrate having a surface exposed to the surface of the head 100 on the same Z2 side as the nozzle plate 120.

Further, in Embodiments 3 and 4 described above, an example, in which the fixing plate 10 is fixed to the surface of the channel holder 30 on Z2 side, is described; however, the configuration is not particularly limited thereto, and the fixing plate 10 may be fixed to another portion of the channel holder 30 on the side surface or the like. In addition, the fixing plate 10 may not be fixed to the channel holder 30.

In Embodiments 3 and 4 described above, as the pressure generating unit that causes the pressure in the pressure generating chamber 112 to be changed, the thin film-type piezoelectric actuator 300 is used and is described; however, the configuration is not particularly limited thereto. For example, it is possible to use a thick film-type piezoelectric actuator formed by a method of attaching a green sheet or the like, a longitudinal vibration type of piezoelectric actuator in which a piezoelectric material and an electrode forming material are alternately laminated and are expanded and contracted in an axial direction, or the like. In addition, as the pressure generating unit, it is possible to use an actuator which includes a heating element disposed in a pressure generating chamber, and ejects a liquid droplet from a nozzle opening due to bubbles generated by the heating of the heating element, a so-called electrostatic actuator which generates static electricity between a vibration plate and an electrode, deforms the vibration plate due to an electrostatic force, and ejects a liquid droplet from a nozzle opening, or the like.

Further, the invention is made for, as a target, the liquid ejecting head unit including the wide liquid ejecting head, overall, for example, and thus, the invention can be applied to a head unit including a recording head such as various types of ink jet-type recording head used in an image recording apparatus such as a printer, a color material ejecting head used in manufacturing a color filter such as a liquid crystal display, an electrode material ejecting head used to form an electrode, such as an organic EL display or a field emission display (FED), a bio-organic material ejecting head used in manufacturing a bio chip, or the like.

Embodiment 5

Figure 34:
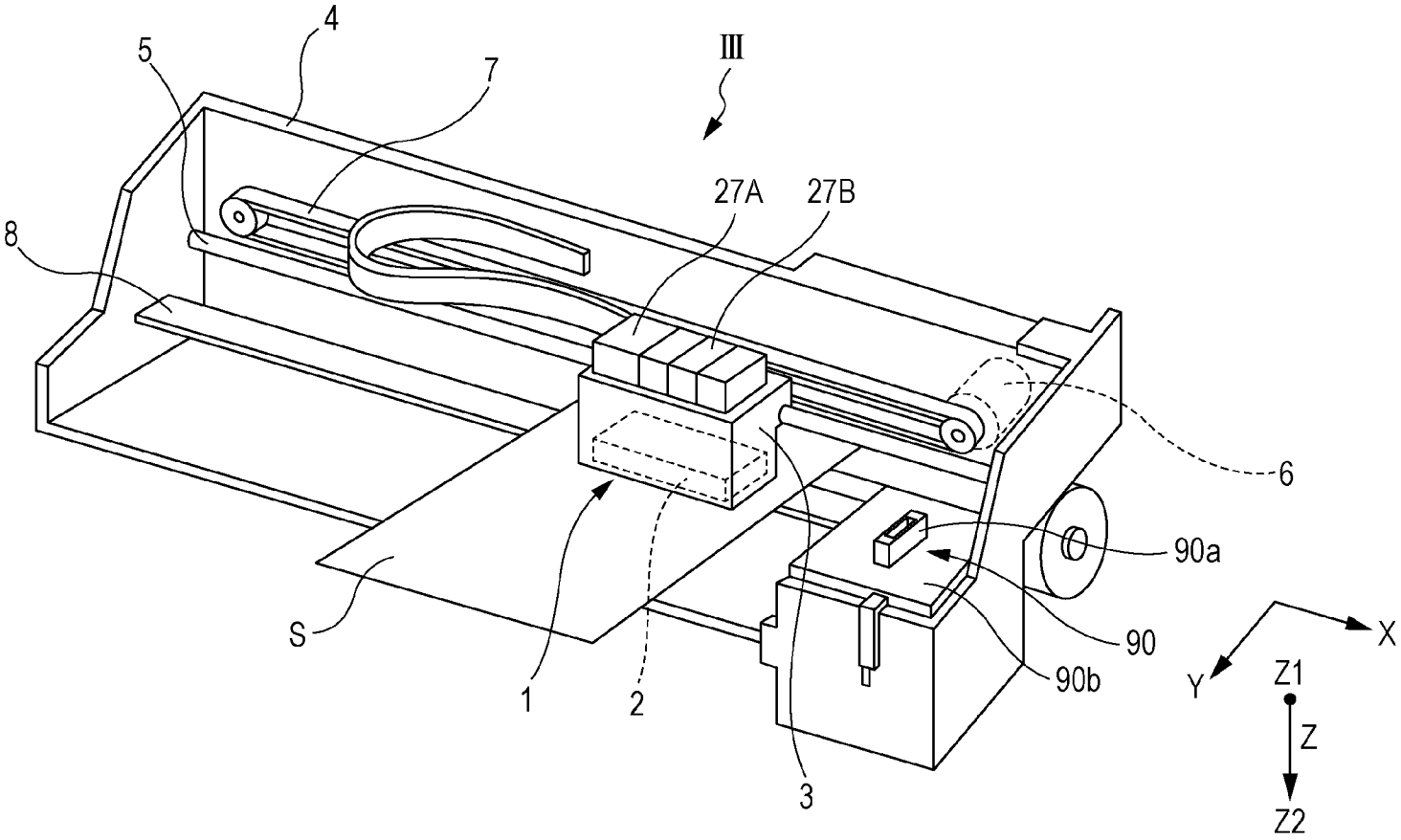
FIG. 34 is a perspective view schematically illustrating a recording apparatus according to Embodiment 5.

FIG. 34 is a perspective view schematically illustrating an ink jet-type recording apparatus as an example of the liquid ejecting apparatus according to Embodiment 5 of the invention. The same reference signs are assigned to the same members as in the embodiment described above, and repetitive description is omitted.

As illustrated in FIG. 34, the ink jet-type recording apparatus III of the present embodiment includes an ink jet-type recording head module 1 (hereinafter, also referred to as a head module 1) that ejects ink as a liquid. The head module 1 includes an ink jet-type recording head unit 2 (hereinafter, also referred to as a head unit 2) that ejects ink, and a carriage 3 that holds the head unit 2. The carriage 3 is provided to perform a reciprocating movement in the axial direction of the carriage shaft 5 attached to the apparatus main body 4. In addition, ink cartridges 27A and 27B are detachably mounted in the head module 1 and configure a liquid supply unit which can supply the ink.

Further, the head module 1 is an example of "liquid ejecting head module", and the head unit 2 is an example of "liquid ejecting head unit", and the carriage 3 is an example of the "frame body".

A drive force of a drive motor 6 is transmitted to the carriage 3 though a plurality of gears (not illustrated) and a timing belt 7, thereby causing the head module 1 to move along the carriage shaft 5. In other words, the carriage shaft 5, the drive motor 6, and the timing belt 7 which cause the head module 1 to perform a relative reciprocating movement with respect to the medium S, configure a carriage mechanism of the present embodiment. On the one hand, the transport roller 8 is provided as a transport unit in the apparatus main body 4 such that the medium S such as paper is transported by the transport roller 8. Further, the transport unit that transports the medium S is not limited to the transport roller, but may be a belt, a drum, or the like. In addition, in the present embodiment, the transport direction of the medium S is referred to as the second direction Y, and the movement direction of the carriage 3 is referred to as the first direction X. In addition, the ejection direction of the ink droplet of the head module 1 is referred to as the third direction Z.

Further, in the present embodiment, a relationship between the respective directions (X, Y, and Z) is orthogonal to each other, but a dispositional relationship of the configurations is not necessarily limited to being orthogonal. Further, in the present embodiment, in the third direction Z, the ink cartridges 27A and 27B side of the head module 1 is referred to as Z1 side, and the medium S side of the head module 1 is referred to as Z2 side.

In addition, in a non-printing region which is an end portion of the carriage 3 in the movement direction, there is provided a capping unit 90 that performs capping of the nozzle surface of the head unit 2. The capping unit 90 is formed of an elastic material such as rubber or an elastomer, and includes a cap 90*a* that covers the nozzles of the head unit 2, and a suction unit 90*b* such as a vacuum pump, which is connected to the cap 90*a*. In the capping unit 90 having such a configuration, the cap 90*a* abuts on the nozzle surface of the head unit 2, and causes the suction unit 90*b* to perform suction operation, then, the pressure inside the cap 90*a* is changed to the negative pressure, and suction operation of suctioning the ink and bubbles inside the head unit 2 from the nozzle is performed. In addition, during non-printing, the nozzles are sealed with the cap 90*a*, and thereby drying of the nozzles may be suppressed.

Further, since the cap 90*a* abuts on the nozzle surface which opens the nozzles at a desired timing and covers the nozzle, the cap 90*a* is provided to be movable in the third direction Z. The movement of the cap 90*a* in the third direction Z is, for example, performed by a driver motor or an electromagnet (not illustrated).

Figure 35:
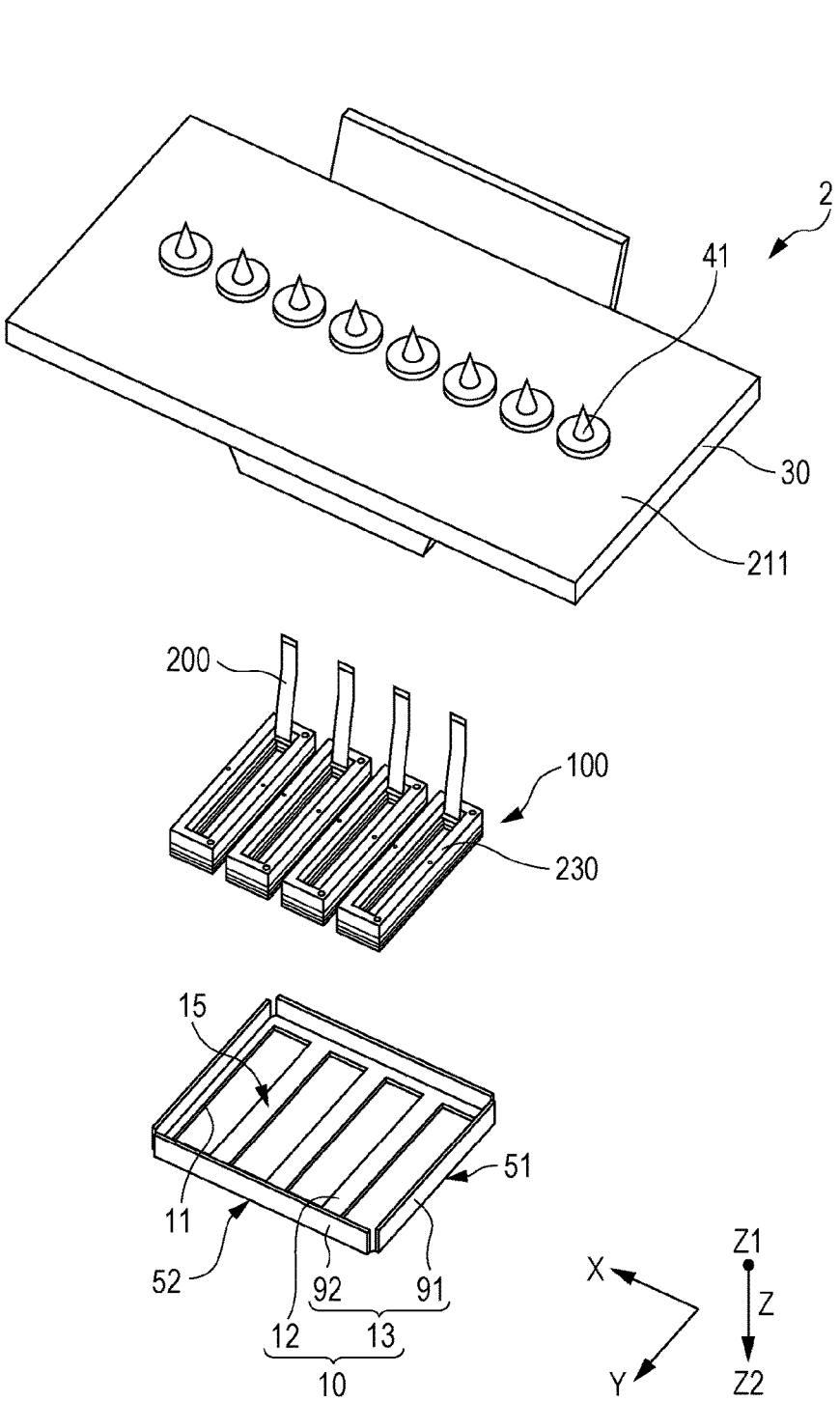
FIG. 35 is an exploded perspective view of a head unit according to Embodiment 5.
Figure 36:
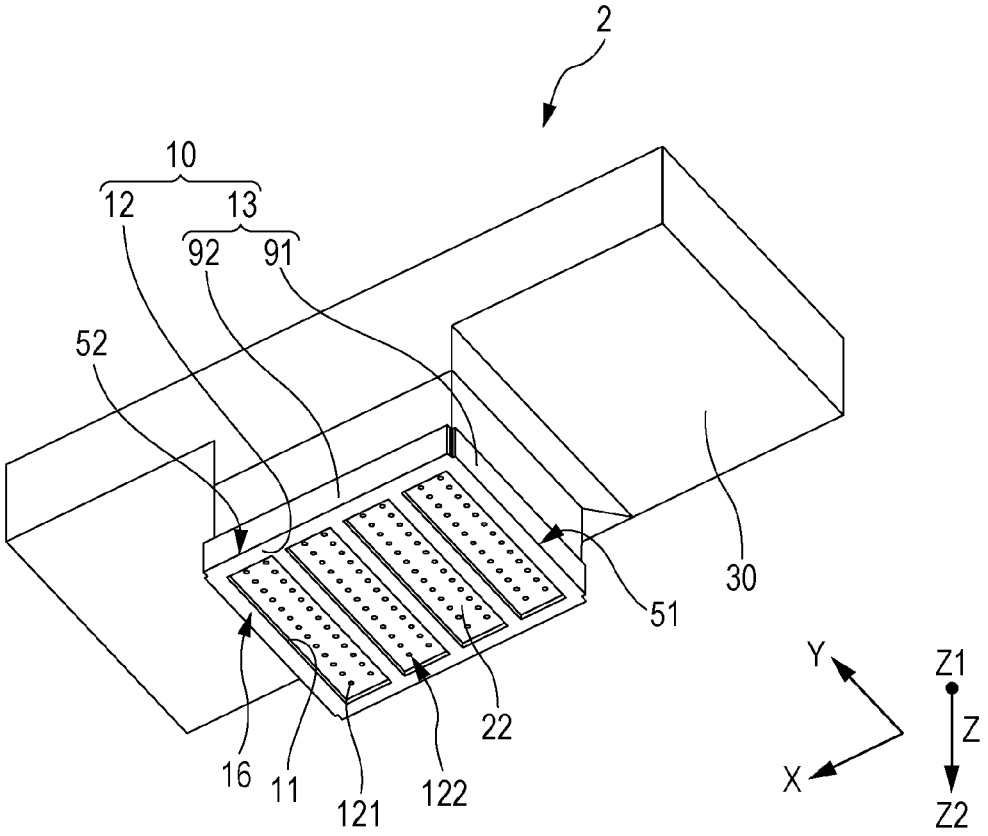
FIG. 36 is a perspective view of the assembled head unit according to Embodiment 5.
Figure 37:
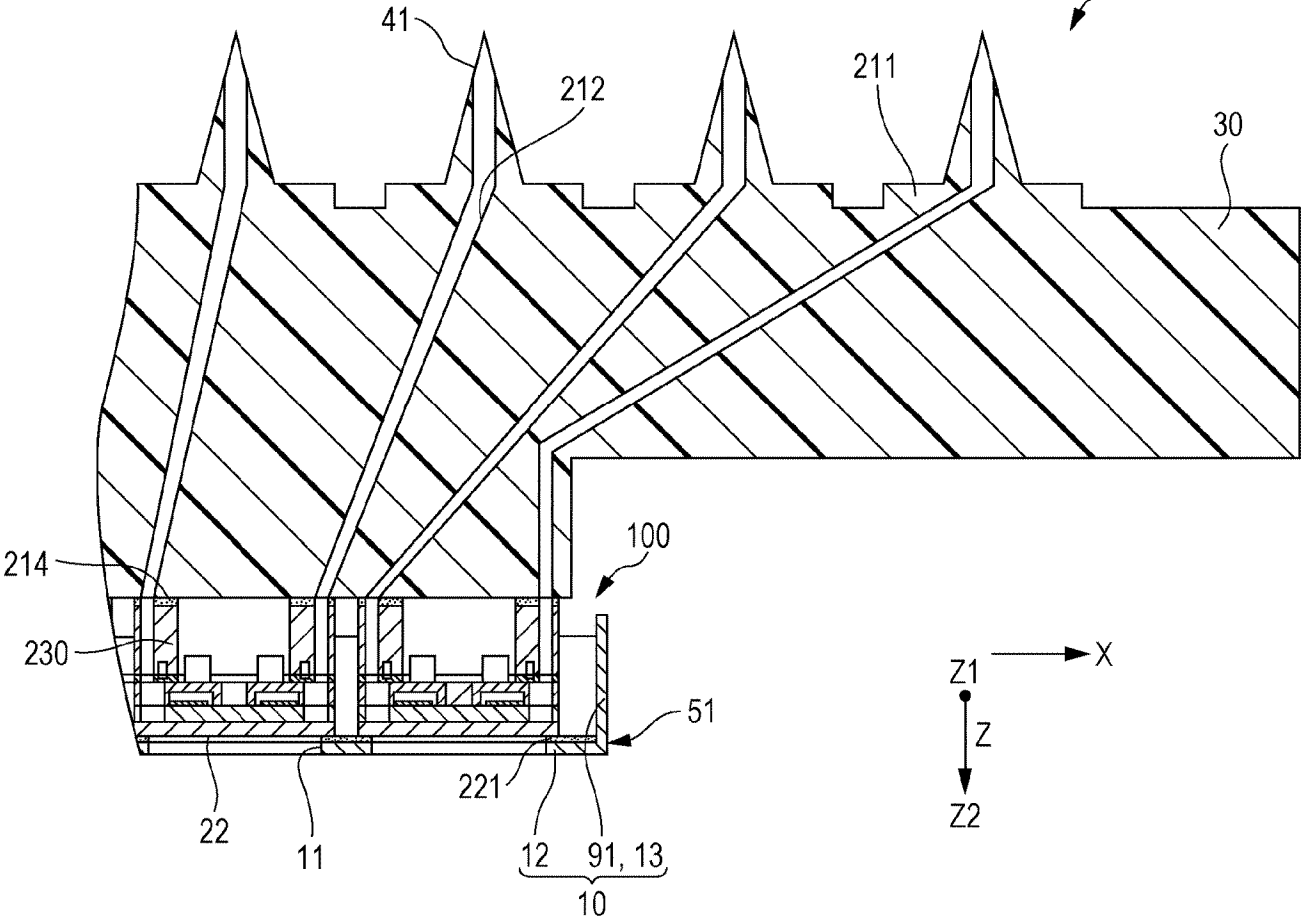
FIG. 37 is a sectional view of main parts of a head unit according to Embodiment 5.

Here, an example of the head unit 2 that configures the head module 1 of the present embodiment is described with reference to FIGS. 35 to 37. Further, FIG. 35 is an exploded perspective view of the head unit according to Embodiment 5. FIG. 36 is a perspective view of the assembled head unit. FIG. 37 is a sectional view of main parts of the head unit. In the present embodiment, the respective directions of the head unit 2 are described based on directions defined when the head unit is mounted in the ink jet-type recording apparatus III, that is, the first direction X, the second direction Y, and the third direction Z. It is needless to mention that the disposition of the head unit 2 in the ink jet-type recording apparatus III is not limited to the following example.

As illustrated in FIGS. 35 to 37, the head unit 2 of the present embodiment includes the plurality of heads 100 that eject the ink, a channel holder 30 holding the plurality of heads 100, and the fixing plate 10 provided on the liquid ejection surface side of the head 100.

Further, the head unit 2 of the present embodiment is different from that of Embodiment 1 in that the head unit of the present embodiment does not have the reinforcement plate 20.

The channel holder 30 has a cartridge mounting section 211 on which the ink cartridges 27A and 27B (refer to FIG. 34) as the liquid supply units are mounted individually. In addition, as illustrated in FIG. 37, the channel holder 30 is provided with a plurality of ink communicating paths 212 of which one end is opened to the cartridge mounting section 211 on Z1 side, and the other end is opened to the surface on Z2 side. Further, at an opening portion of the ink communicating paths 212 of the cartridge mounting section 211, the connection section 41 which is inserted into the ink supply port of the ink cartridges 27A and 27B is fixed through the filter (not illustrated) which is formed in the ink communicating paths 212 so as to remove bubbles or foreign substances in the ink.

The plurality of heads 100 are fixed to the surface of the channel holder 30 on Z2 side. In the present embodiment, four heads 100 are fixed in parallel at predetermined intervals in the first direction X. In the present embodiment, the channel holder 30 and the head 100 are joined through an adhesive 214.

Figure 38:
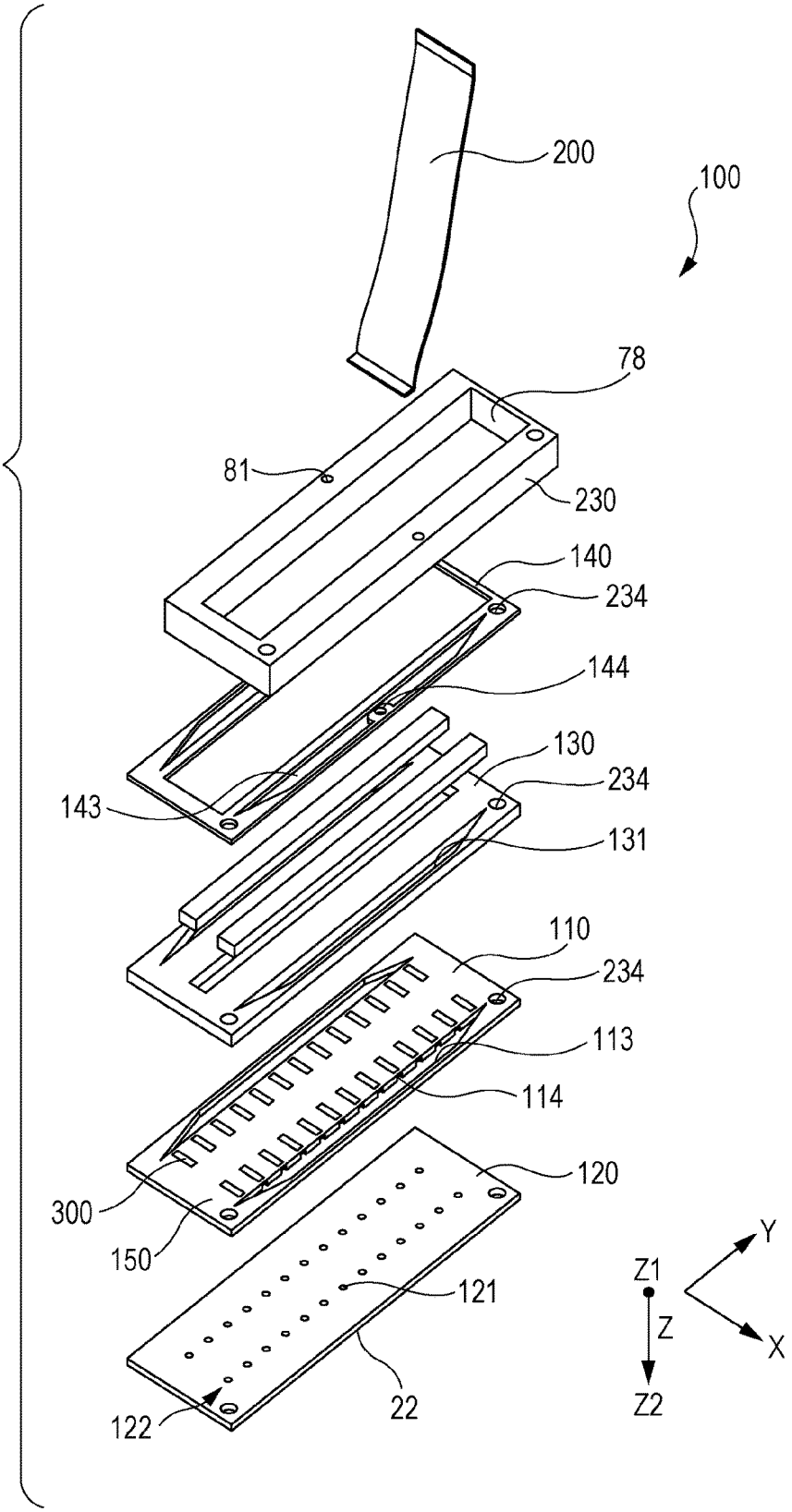
FIG. 38 is an exploded perspective view of a head according to Embodiment 5.
Figure 39:
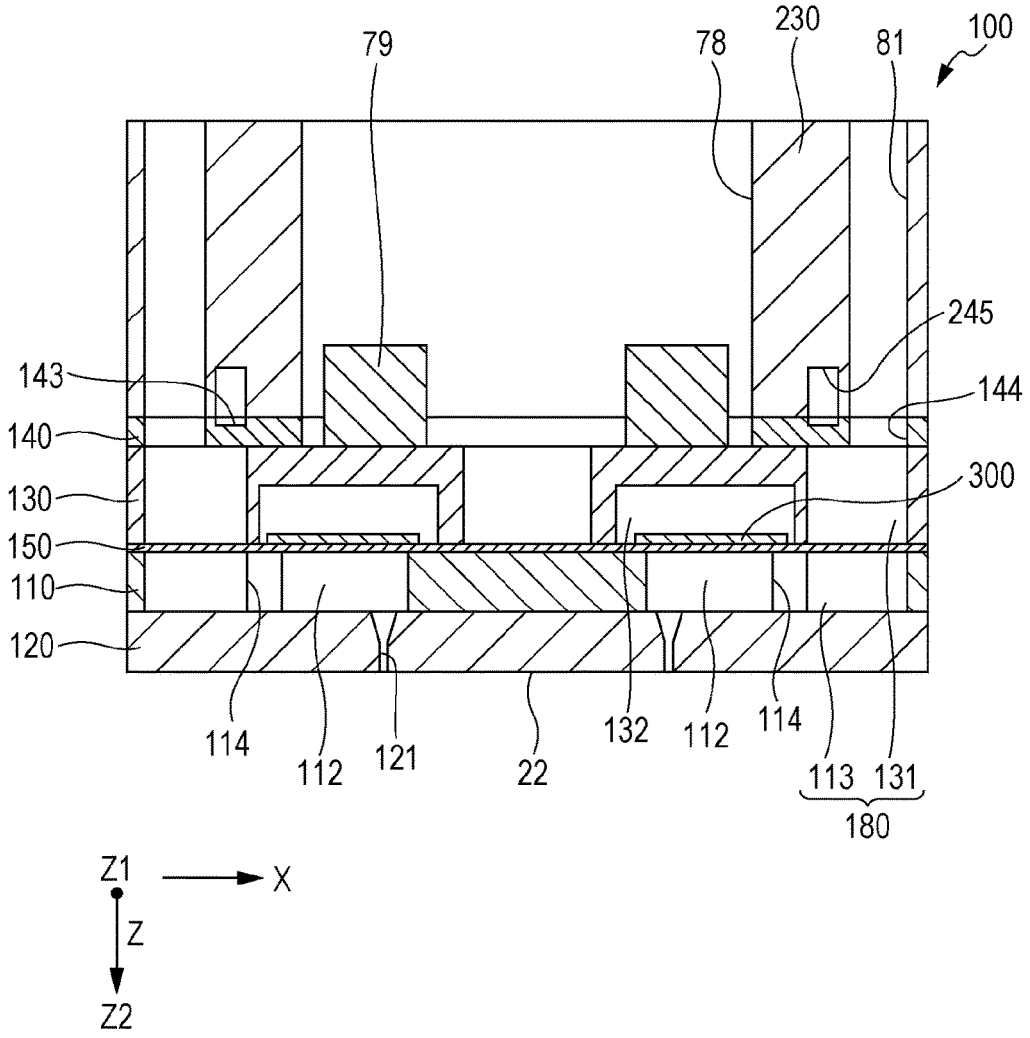
FIG. 39 is a sectional view of the head according to Embodiment 5.

Here, the head 100 mounted in the head unit 2 of the present embodiment is described with reference to FIGS. 38 and 39. FIG. 38 is an exploded perspective view of the head according to Embodiment 5 of the invention. FIG. 39 is a sectional view of the head.

As illustrated in FIGS. 38 and 39, the head 100 of the present embodiment includes the channel substrate 110. In the present embodiment, the channel substrate 110 is formed of the silicon single crystal substrate and the vibration plate 150 is formed on the surface on Z1 side thereof. The pressure generating chambers 112 divided by a plurality of partition walls by anisotropic etching performed on the surface on Z2 side are arranged in the channel substrate 110 in the second direction Y. Two rows of the pressure generating chambers arranged in parallel in the second direction Y are formed in the first direction X. In addition, the communication section 113 is formed on an outer side of each row of the pressure generating chambers 112 in the first direction X. The communication section communicates with the manifold section 131 provided in the protection substrate 130 to be described below, and configures the manifold 180 which becomes the common ink chamber of each of the pressure generating chambers 112. In addition, the communication section 113 communicates with one end portion of each of the pressure generating chambers 112 in a longitudinal direction through the ink supply path 114.

The nozzle plate 120 adheres to the channel substrate 110 on the opening surface side through an adhesive or a heat sealing film, and a nozzle 121 communicating with the ink supply path 114 of each of the pressure generating chamber 112 on the opposite side is drilled through the nozzle plate. In other words, in the present embodiment, two nozzle rows 122, in which the nozzles 121 are arranged in parallel, are provided in the one ink jet-type recording head. Further, in the present embodiment, a surface, on which the nozzles 121 of the nozzle plate 120 are opened and ink droplets are discharged, that is, the surface on Z2 side is referred to as a liquid ejecting surface 22.

Meanwhile, the vibration plate 150 is formed on the channel substrate 110 on Z1 side. As the vibration plate 150, it is possible to use lamination or one single layer of a silicon oxide film and a zirconium oxide film. In addition, the piezoelectric actuator 300 having a first electrode, a piezoelectric layer formed of a ferroelectric ceramic material having an electromechanical transduction effect, and a second electrode, is provided on the vibration plate 150.

The protection substrate 130 having the manifold section 131, which configures at least a part of the manifold 180, is joined on the channel substrate 110 in which such piezoelectric actuator 300 is formed on Z1 side. In the present embodiment, the manifold section 131 is formed to penetrate the protection substrate 130 in the third direction Z as the thickness direction and to be continuous through the plurality of pressure generating chambers 112 in the second direction Y. Then, the manifold section communicates with the communication section 113 of the channel substrate 110 as described above so as to configure the manifold 180 which becomes the common ink chamber of the respective pressure generating chambers 112.

In addition, a piezoelectric actuator holding section 132 is provided in a region facing the piezoelectric actuator 300 of the protection substrate 130 so as to have a space formed to the extent that the piezoelectric actuator holding section does not interfere with motion of the piezoelectric actuator 300. Examples of a material of the protection substrate 130 include glass, ceramic, metal, plastics or the like, and it is preferable that a material having substantially the same coefficient of thermal expansion as the channel substrate 110. In the present embodiment, the protection substrate 130 is formed of the same material of the silicon single crystal substrate as the channel substrate 110.

Further, a driver IC 79 for driving the piezoelectric actuators 300 is provided on the protection substrate 130. Each terminal of the driver IC 79 is connected to a drawn-out wire drawn out from an individual electrode of each of the piezoelectric actuators 300 via a bonding wire (not illustrated). As illustrated in FIG. 38, each terminal of the driver IC 79 is connected to an external device via the cable 200 such as a flexible printer cable (FPC), and various signal such as a print signal is received via the cable 200 from the external device.

In addition, a compliance substrate 140 is joined on such a protection substrate 130. The ink guiding port 144 for supplying ink to the manifold 180 is formed to penetrate the compliance plate in a thickness direction thereof, in a region of the compliance substrate 140, which faces the manifold 180. In addition, a region except for the ink guiding port 144 of the region of the compliance substrate 140, which faces the manifold 180, becomes a flexible section 143 formed to be thin in the thickness direction, and the manifold 180 is sealed by the flexible section 143. Compliance is applied in the manifold 180 by the flexible section 143.

In addition, the head case 230 is provided on the compliance substrate 140 on Z1 side and the head case is provided with an ink supply communication path 81 communicating with the ink guiding port 144. In addition, a recessed section 245 is formed in a region of the head case 230, which faces the flexible section 143, and bending deformation of the flexible section 143 is appropriately performed. In addition, there is provided a driver IC holding section 78 penetrating through the head case 230 in the thickness direction in a region facing the driver IC 79 provided on the protection substrate 130, and the cable 200 communicates with the driver IC holding section 78 and is connected to the driver IC 79.

the plurality of heads 100 are fixed to the one channel holder 30.

In the present embodiment, four heads 100 are arranged in parallel at intervals in the first direction X on the surface of the one channel holder 30 on Z2 side, and the heads are fixed to the channel holder 30 by the adhesive 214. In other words, eight nozzle rows 122 are arranged in the head unit 2 of the present embodiment. Multiple nozzle rows 122 are achieved using the plurality of heads 100, thereby making it possible to prevent yield ratio from lowering, compared to a case where multiple nozzle rows 122 are formed in one head 100. In addition, the plurality of heads 100 are used to achieve multiple nozzle rows 122, thereby making it possible to increase the number of heads 100 which can be formed from one sheet of silicon wafer, and making it possible to decrease wasteful regions of the silicon wafer and to reduce manufacturing costs.

In addition, as illustrated in FIGS. 35 to 37, the four heads 100 held in the channel holder 30 are positioned to be relative to each other and are fixed to fixing plate 10.

The fixing plate 10 has the bottom section 12 fixed to the head 100, and the side surface section 13 continuous to the bottom section 12.

The bottom section 12 is formed of a flat plate shape having a rectangular shape when viewed in a plan view in the third direction Z. In other words, the bottom section 12 has two first edges 51 in the second direction Y, and two second edges 52 in the first direction X. In addition, the bottom section 12 has the first surface 15 to which the head 100 is fixed, and the second surface 16 on the side opposite to the first surface 15. The openings 11 are provided in the bottom section 12 so as to correspond to the heads 100, respectively. The openings 11 are provided for the respective heads 100 such that each of the nozzle rows 122 of the heads 100 is individually exposed. In other words, two nozzle rows 122 are exposed from one opening 11, and the same number of openings 11 as the heads 100, that is, four openings 11 are provided. The openings 11 has an opening slightly smaller than the nozzle plate 120 of the head 100, and the first surface 15 of the bottom section 12 is fixed with the nozzle plate 120 on the liquid ejecting surface 22 side at the opening edge portion of the opening 11. Further, in the present embodiment, the bottom section 12 and the nozzle plate 120 are directly joined by an adhesive 221, but may be indirectly joined via a separate member.

The side surface section 13 extends from the second surface 16 side toward the first surface 15 side of the bottom section 12. In the present embodiment, the side surface section is formed by benign the portion continuous to the bottom section 12 to Z1 side. In other words, the side surface section 13 of the present embodiment is provided to be continuous from the two first edges 51 in the second direction Y and the two second edges 52 in the first direction X of the bottom section 12. In other words, the side surface section 13 has the two first side surface sections 91 provided in the second direction Y, and the two second side surface sections 92 provided in the first direction X. The two first side surface sections 91 and the two second side surface sections 92 are formed not to be connected and are discontinuous from each other at corners of the bottom section 12. Accordingly, the side surface section 13 is provided on the fixing plate 10, thereby making it possible to increase rigidity of the fixing plate 10, and making it possible to reduce deformation and peeling off of the fixing plate 10 against an external force produced when the medium S comes into contact therewith. In addition, since the side surface section 13 is provided on the four sides of the fixing plate 10 such that the four sides of the fixing plate 10 are surrounded by the side surface section 13, it is possible to reduce occurrence of the contact of the medium S with the joined portion between the fixing plate 10 and the head 100, and making it possible to reduce deformation or peeling off of the fixing plate 10.

Further, the fixing plate 10 is formed by cutting a plate-shaped member formed of a metal material such as stainless steel, in a so-called development view shape, with the bottom section 12 and the side surface section 13 spread, and then by bending the side surface section 13. Further, there is no particular limitation to the method of forming the fixing plate 10, and, for example, the fixing plate 10 may be formed by the drawing of the plate-shaped member. Accordingly, in a case where the fixing plate 10 is formed by the drawing, the first side surface section 91 and the second side surface section 92 are continuous to each other in the portions corresponding to the corners of the bottom section 12.

The liquid ejecting surfaces 22 of the one or more heads 100 are fixed to the first surface 15 of the bottom section 12 of the fixing plate 10 by the adhesive 221. In this manner, the nozzle surface is defined by the second surface 16 of the fixing plate 10 and the nozzle plate 120 of the head 100. In other words, the nozzle surface of the head unit 2 is disposed at a position facing the medium S during the printing. When the plurality of heads 100 are fixed to the first surface 15 of the bottom section 12 of the fixing plate 10 by the adhesive 221, it is possible to easily align the height of the liquid ejecting surfaces 22 of the plurality of heads 100 in the third direction Z. Therefore, it is possible to improve print quality.

Figure 40:
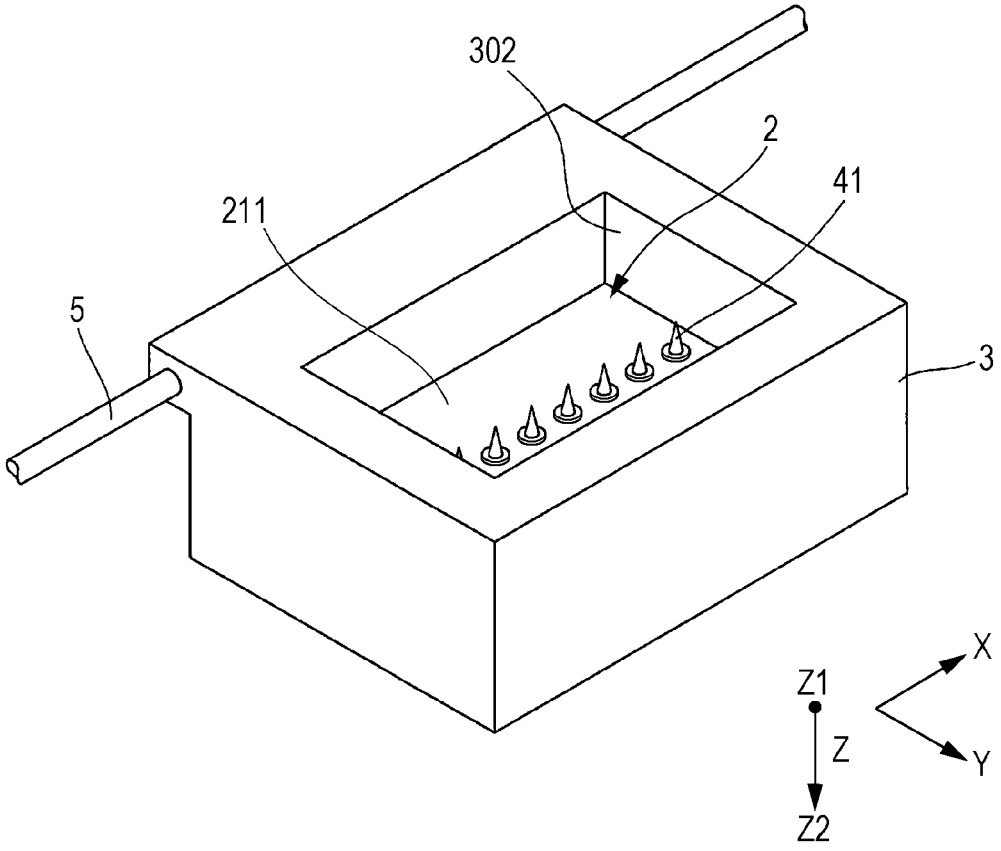
FIG. 40 is a perspective view of a head module according to Embodiment 5.
Figure 41:
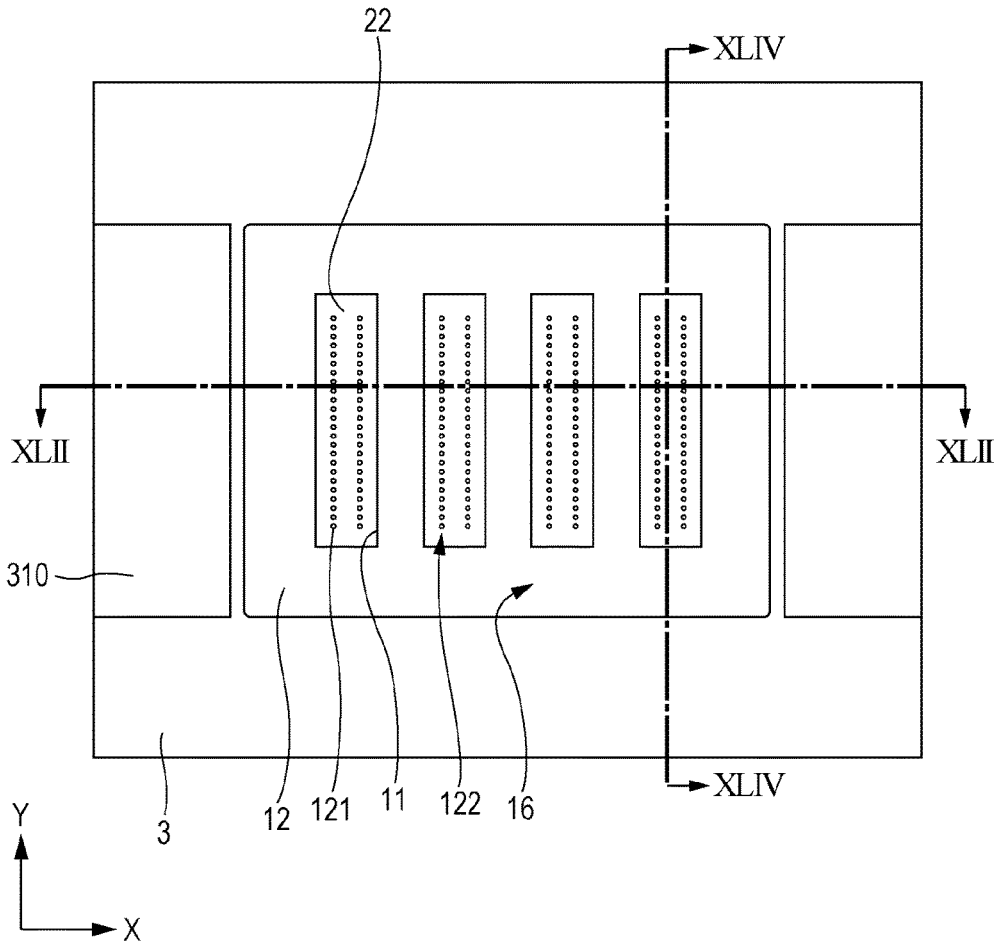
FIG. 41 is a plan view of the head module according to Embodiment 5.
Figure 42:
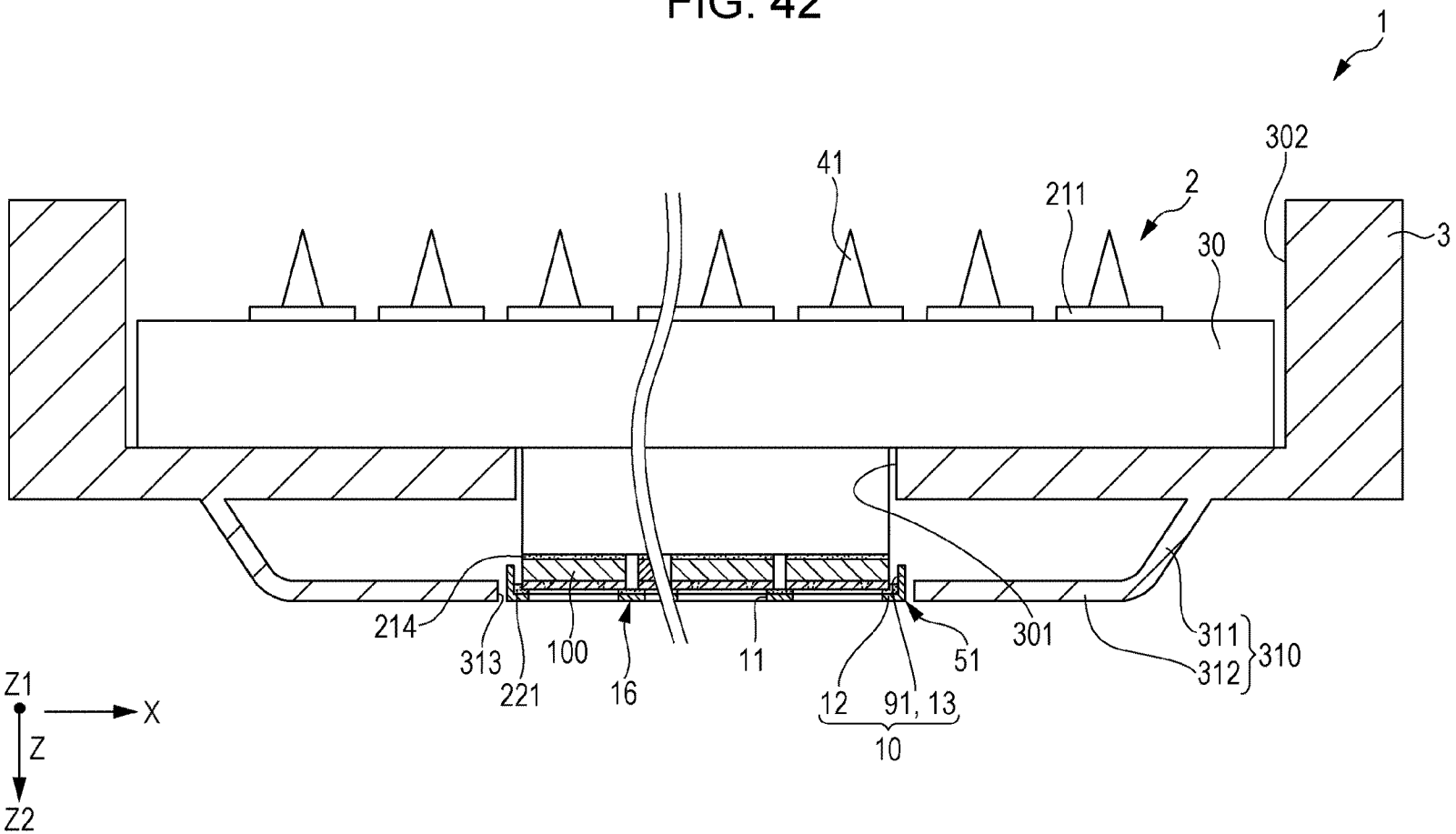
FIG. 42 is a sectional view of the head module according to Embodiment 5.
Figure 43:
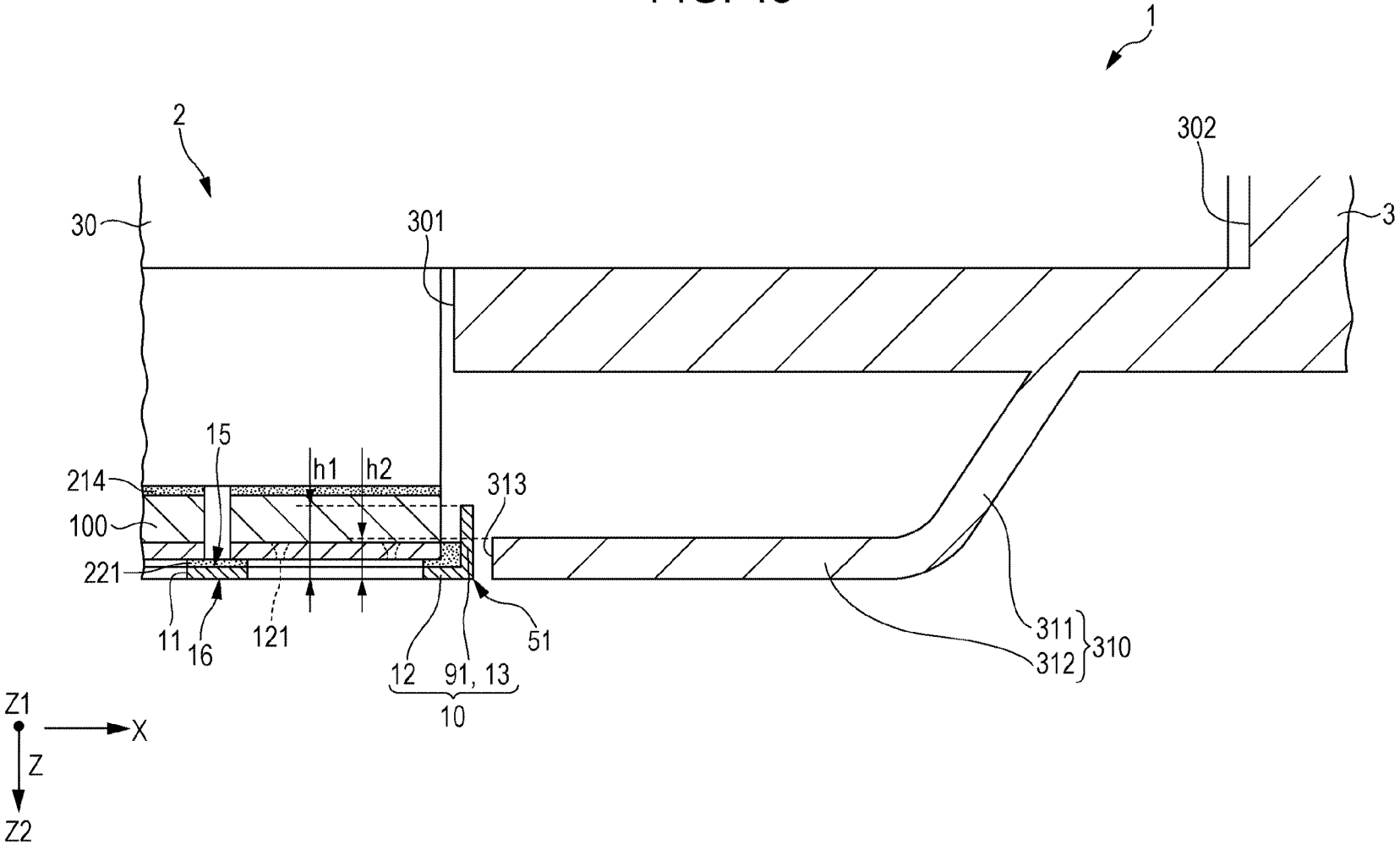
FIG. 43 is an exploded sectional view of main parts of the head module according to Embodiment 5.
Figure 44:
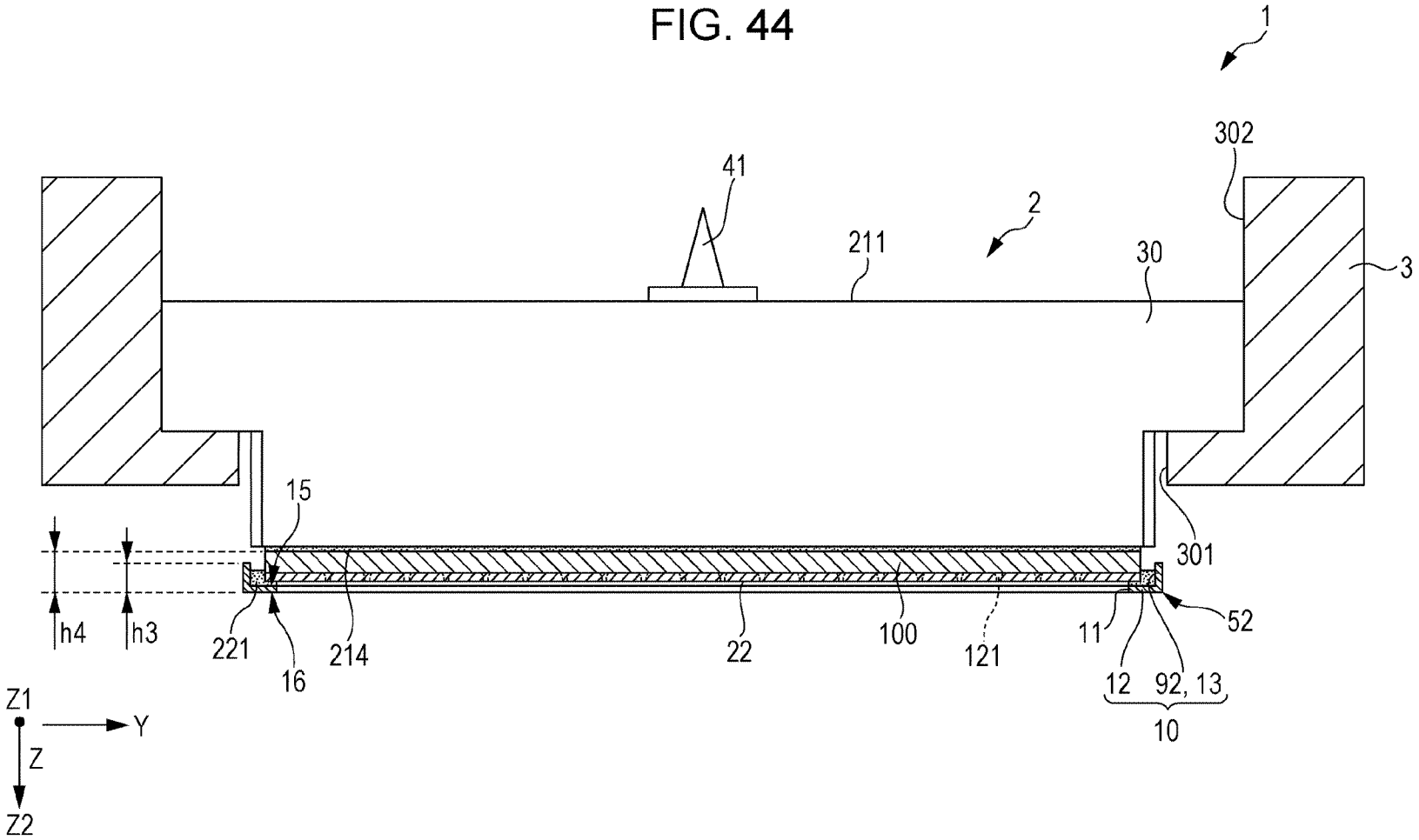
FIG. 44 is a sectional view of the head module according to Embodiment 5.

Such a head unit 2 is held on the carriage 3 as the frame body of the present embodiment, and configures the head module 1. Here, the carriage 3 of the present embodiment is further described with reference to FIGS. 40 to 44. FIG. 40 is a perspective view of the head module according to Embodiment 5 of the invention. FIG. 41 is a plan view of the head module. FIG. 42 is a sectional view taken along line XLII-XLII in FIG. 41. FIG. 43 is an exploded view of the main parts in FIG. 42. FIG. 44 is a sectional view taken along line XLIV-XLIV in FIG. 41.

As illustrated in FIGS. 40 to 44, the carriage 3 as the frame body of the present embodiment has a holding section 302 as a space to hold the head unit 2 inside. The holding section 302 is opened in the surface of the carriage 3 on Z1 side. The ink cartridges 27A and 27B are inserted from an opening of the holding section 302 on Z1 side and are held on the cartridge mounting section 211 of the head unit 2. In addition, a holding hole 301 communicating with the holding section 302 is provided on the surface of the carriage 3 on Z2 side. The holding hole 301 is greater in size than the external size of the head unit 2 on the nozzle surface, and has an opening smaller than the external size of the head unit 2 on Z1 side. In this manner, the head unit 2 is held in the holding section 302 in a state in which the nozzle surface side projects from the holding hole 301 to Z2 side.

A wall section 310 further projecting to Z2 side is provided on the surface of the carriage 3 on Z2 side on which the holding hole 301 is opened. The wall sections 310 have substantially the same width as the width of the head unit 2 in the second direction Y, and are provided on both sides of the head unit 2 in the first direction X. Such wall section 310 is provided to project so as to have the same height as the nozzle surface of the head unit 2 projecting to Z2 side from the surface of the carriage 3 on the Z2 side. Specifically, the wall section 310 extends from the surface of the carriage 3 on Z2 side by being curved such that the front end faces the first side surface section 91 of the head unit 2. In other words, the wall section 310 has a first wall section 311 having a flat-plate shape, which extends straightly toward the side surface of the head unit 2 in the first direction X from the surface of the carriage 3 on Z2 side, that is, in an inclined direction so as to approach the head unit 2 with respect to the third direction Z, and a second wall section 312 having a flat-plate shape, which is continuous to the first wall section 311 and extends straightly in a direction parallel to the first direction X. The first wall section 311 and the second wall section 312 are continuous to each other at a portion, and a front surface of the portion on Z2 side is curved. In this manner, the front surface of the wall section 310 on Z2 side becomes a slope inclined from the head unit 2 toward the outer side in the first direction X. The front end surface of the wall section 310, that is, the end surface on the side opposite to an end portion of the second wall section 312, to which the first wall section 311 is continuous, forms a facing surface 313 disposed to face in a state in which the head unit 2 and the first side surface section 91 are disposed with a space therebetween. In other words, the nozzle surface of the head unit 2, that is, the liquid ejecting surface 22 of the head 100 and the second surface 16 of the fixing plate 10 are exposed between the facing surfaces 313 of the two wall sections 310. In other words, the exposure opening of the carriage 3 which exposes the nozzle surface of the head unit 2 is defined by the facing surface 313 facing the first side surface section 91 of the head unit 2.

Accordingly, the wall sections 310 are provided on both side of the head unit 2 in the first direction X, thereby making it possible to protect the medium S from being directly brought into contact with the side surface of the head unit 2 when the head unit 2 performs reciprocating movement in the first direction X with respect to the medium S.

In addition, in the present embodiment, the front surface of the wall section 310 on Z2 side on the nozzle surface side, and the second surface 16 of the fixing plate 10 of the head unit 2 are provided to be positioned substantially at the same position in the third direction Z. In this manner, when the nozzle surface is wiped by a wiping blade (not illustrated) and the wiping blade is separated from the nozzle surface, it is possible to reduce flying of the ink as mist due to momentum produced when the wiping blade returns to the original state from the elastically deformed state. Hence, it is possible to reduce contamination inside the ink jet-type recording apparatus III due to the mist of ink from the wiping.

Further, a space is formed between the facing surface 313 of the wall section 310 and the first side surface section 91 of the head unit 2, thereby making it possible to position the head unit 2 with respect to the carriage 3. In addition, when the space between the facing surface 313 of the wall section 310 and the first side surface section 91 of the head unit 2 is filled with an adhesive or a bonding agent, it is difficult to attach and detach the head unit 2 to and from the carriage 3, and it is not possible to easily perform the replacement or maintenance of the head unit 2. In the present embodiment, the space is formed between the facing surface 313 of the wall section 310 and the first side surface section 91 of the head unit 2, thereby making it possible to easily perform attachment and detachment of the head unit 2 to and from the carriage 3. Therefore, it is possible to easily perform the replacement or maintenance of the head unit 2.

In the head module 1, in the third direction Z, a height h1 of the first side surface section 91 of the head unit 2 facing the facing surface 313 of the wall section 310 is higher than a height h2 of the facing surface 313. Further, in the present embodiment, the height h1 of the first side surface section 91 and the height h2 of the facing surface 313 mean a position of the end portion on Z1 side in the −Z direction from the second surface 16 of the fixing plate 10. In other words, the height h1 of the first side surface section 91 is higher than the height h2 of the facing surface 313, which means that the end portion of the first side surface section 91 on Z1 side is positioned farther on Z1 side than the end portion of the facing surface 313 on Z1 side, that is, than the surface of the second wall section 312 on Z1 side. Further, in the present embodiment, the height h1 of the first side surface section 91 and the height h2 of the facing surface 313 are the heights in the −Z direction with the second surface 16 of the fixing plate 10 as a reference; however, the position as a reference of the heights h1 and h2 is not limited to the second surface 16. In other words, since the end portion of the first side surface section 91 on Z1 side may be positioned on Z1 side relatively from the end portion of the facing surface 313 on Z1 side, as long as the position as a reference of the heights h1 and h2 is any position at which both the first side surface section 91 and the facing surface 313 are at the same position on Z2 side from the end portion on Z1 side, there is no particular limitation to the reference position.

In addition, in the present embodiment, the second surface 16 of the fixing plate 10 and the front surface of the second wall section 312 of the wall section 310 on Z2 side are disposed at the same position in the third direction Z; there is not particular limitation to the reference position. For example, the second surface 16 of the fixing plate 10 and the front surface of the wall section 310 on Z2 side may be disposed at different positions in the third direction Z. Even in this case, the height h1 of the first side surface section 91 may be higher than the height h2 of the facing surface 313. In other words, the end portion of the first side surface section 91 on Z1 side may be positioned on Z1 side relatively from the end portion of the facing surface 313 on Z1 side. Accordingly, the height h1 of the first side surface section 91 from the second surface 16 in the −Z direction, that is, a length in the third direction Z is designed such that the end portion of the first side surface section 91 on Z1 side is positioned on Z1 side relatively from the end portion of the facing surface 313 on Z1 side, based on a relative position from the second surface 16 of the fixing plate 10 and from the front surface of the wall section 310 on Z2 side in the third direction Z, and a width of the facing surface 313 of the wall section 310 in the third direction Z, that is, a thickness on the front end portion of the wall section 310 in the third direction Z.

Figure 45:
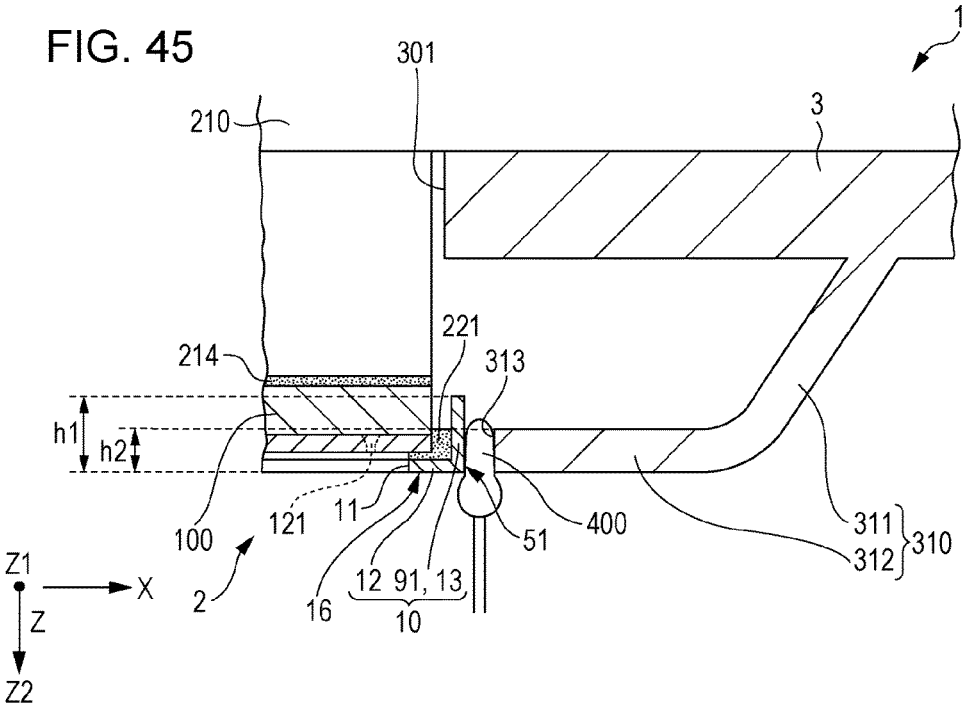
FIG. 45 is an exploded sectional view of main parts of the head module according to Embodiment 5.

The first side surface section 91 and the facing surface 313 are disposed in the state of having a space therebetween, as described above. Therefore, lint produced from the medium S or the like is likely to attach and to be concentrated in the gap between the first side surface section 91 and the facing surface 313. Mist formed when the ink is ejected, or ink collected when the nozzle surface is wiped, are attached and stored on the concentrated lint, and then, there is a concern that the stored ink will fall to the medium S at an unexpected timing, and the medium S will be contaminated. Therefore, as illustrated in FIG. 45, a fiber member 400 such as a cotton swab or cloth is inserted between the first side surface section 91 and the facing surface 313 at a predetermined timing, and the fiber member 400 moves along the surface of the first side surface section 91 in the second direction Y, thereby cleaning is performed by removing the lint attached in the gap and the ink attached to the lint. When the cleaning of the gap is performed by the fiber member 400, in the present embodiment, the height h1 of the first side surface section 91 is higher than the height h2 of the facing surface 313. Therefore, it is possible to reduce occurrence of fiber member 400 being caught on the end portion of the first side surface section 91 on Z1 side. In this manner, it is possible to reduce the deformation of the fixing plate 10 or the peeling off of the fixing plate 10 from the head unit 2.

Figure 46:
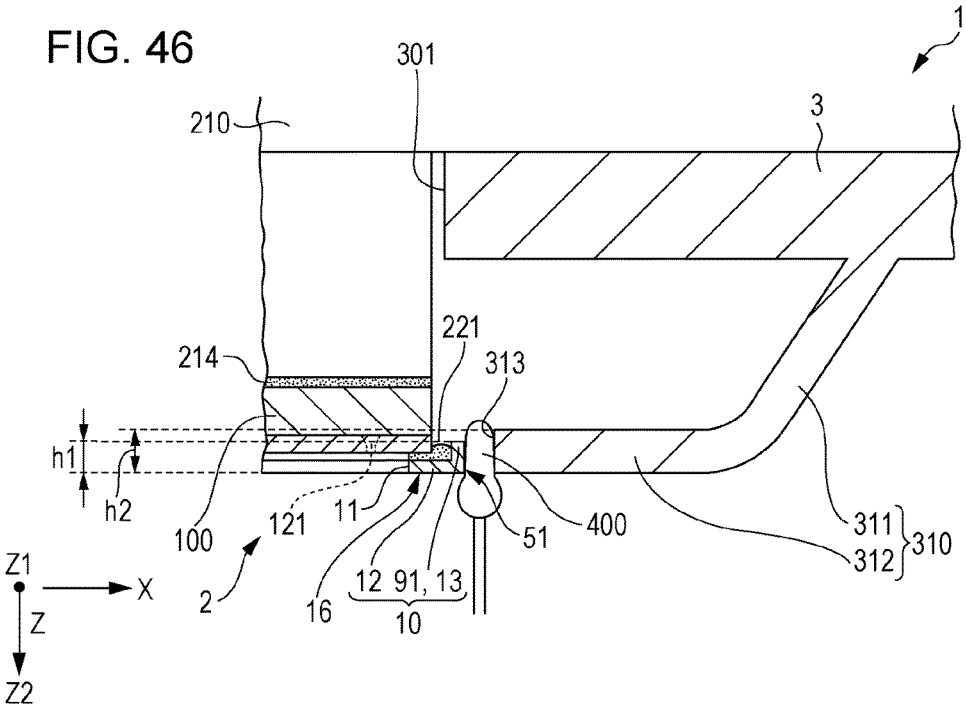
FIG. 46 is an exploded sectional view of main parts of a comparative example of the head module according to Embodiment 5.
Figure 47:
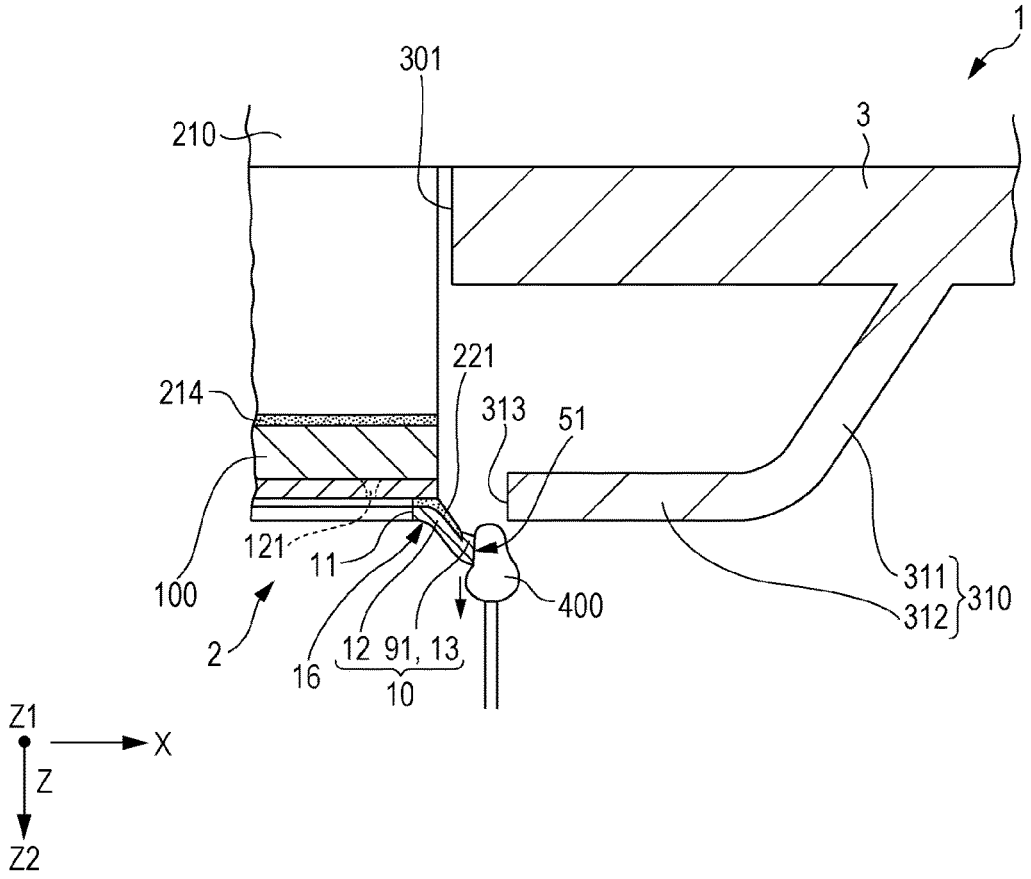
FIG. 47 is an exploded sectional view of main parts of another comparative example of the head module according to Embodiment 5.

By comparison, as illustrated in FIG. 46, in a case where the height h1 of the first side surface section 91 of the fixing plate 10 is lower than the height h2 of the facing surface 313, the fiber member 400 is likely to be caught on the end portion of the first side surface section 91 on Z1 side, and the fixing plate 10 is likely to be deformed or peeled off when the fiber member 400 is inserted into the gap between the first side surface section 91 and the facing surface 313, and then the fiber member 400 is pulled out, as illustrated in FIG. 47. When the fixing plate 10 is deformed or peeled off, an orientation of the nozzle plate 120 fixed to the fixing plate 10 is changed, and defects such as a shift of the landing position of the ink or being caught on the medium S are produced. Therefore, the head unit 2 needs to be replaced. In the present embodiment, the height h1 of the first side surface section 91 is set to be higher than the height h2 of the facing surface 313, thereby making it possible to reduce occurrence of the fiber member 400 being caught on the end portion of the first side surface section 91 on Z1 side during the cleaning, and making it possible to reduce the deformation or peeling off of the fixing plate 10. Hence, it is possible to reduce the replacement of the head unit 2 due to the breaking of the fixing plate 10 during the cleaning and making it possible to reduce costs.

In addition, it is possible to reduce occurrence of a period during which printing is not performed due to the replacement of the head unit 2, and it is possible to reduce the downtime. Further, when the head unit 2 is replaced, the color is likely to be changed from the printing before the replacement, and it is difficult to replace with the head unit 2 with the same color; however, the replacement of the head unit 2 is reduced, thereby making it possible to maintain a constant print quality and to perform stable printing.

Incidentally, since only the gap between the first side surface section 91 and the facing surface 313 can be cleaned by the fiber member 400, there is no need to insert the fiber member 400 to Z1 side farther from the gap between the first side surface section 91 and the facing surface 313. This is because a relatively wide space is provided to Z1 side farther from the gap between the first side surface section 91 and the facing surface 313, and concentration of lint or remaining of ink is unlikely to occur even when lint enters the space. Hence, the height h1 of the first side surface section 91 is higher than the height h2 of the facing surface 313 as in the present embodiment, then, it is possible to reduce the deformation or peeling off of the fixing plate 10 due to the fiber member 400 during the cleaning, and it is possible to reliably clean the gap by removing concentrated lint or ink.

In the present embodiment, the wall section 310 is provided only on both sides of the head unit 2 in the first direction X, but are not provided on both sides of the head unit 2 in the second direction Y. Therefore, a part of the side surfaces on both sides of the head unit 2 in the second direction Y are exposed in the second direction Y. In the present embodiment, a part of the second side surface section 92 of the head unit 2, a head case 230, and the channel holder 30 on Z2 side are exposed to the side surface in the second direction Y.

Here, a height h3 of the second side surface section 92 of the fixing plate 10 is lower than a height h4 of the fixing surface between channel holder 30 and the head 100. Further, similar to the heights h1 and h2, the height h3 of the second side surface section 92 and the height h4 of the fixing surface between the channel holder 30 and the head 100 are obtained at a position of the end portion on Z1 side in the –Z direction from the second surface 16 of the fixing plate 10, in the present embodiment. In other words, the height h3 of the second side surface section 92 is lower than the height h4 of the fixing surface between the channel holder 30 and the head 100, which means that the end portion of the second side surface section 92 on Z1 side is positioned on Z2 side from the fixing surface between the channel holder 30 and the head 100. In addition, the fixing surface between the channel holder 30 and the head 100, which defines the height h4, is a surface on which the surface of the channel holder 30 on Z1 side and the surface of the head case 230 of the head 100 on Z2 side are fixed to each other. Incidentally, in the present embodiment, the adhesive 214 is provided on the fixing surface between the channel holder 30 and the head 100 in which fixing is performed by the adhesive. Therefore, in the present embodiment, the fixing surface between the channel holder 30 and the head 100, which defines the height h4 for defining the height h3 of the second side surface section 92, is the surface of the head case 230 of the head 100 on Z1 side. In addition, in a case where the fixing surface between the channel holder 30 and the head 100 is provided over positions different in the third direction Z, the fixing surface defining the height h4 is a portion of a side surface side of the second side surface section 92 in the second direction Y, of the fixing surface between the channel holder 30 and the head 100.

In other words, the fixing surface may be provided at positions different in the third direction Z in a portion other than the side surface in the second direction Y, that is, a position higher than h4 or a position lower than h4.

Figure 48:
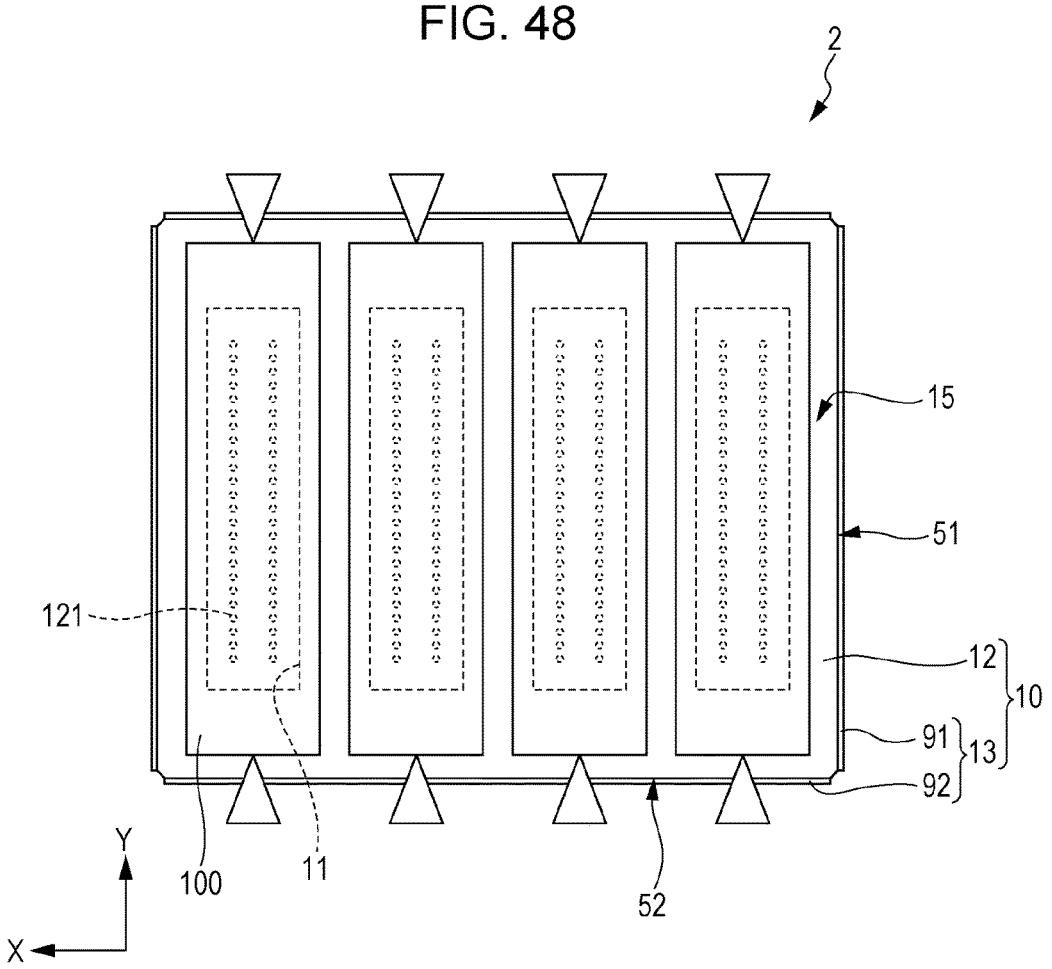
FIG. 48 is a plan view illustrating a method of manufacturing the head unit according to Embodiment 5.

Accordingly, the height h3 of the second side surface section 92 of the fixing plate 10 is set to be lower than the height h4 of the fixing surface between the channel holder 30 and the head 100, the second side surface section 92 does not cover the entirety of the side surface of the head 100 in the second direction Y, and it is possible to expose the side surface of the head 100 in the second direction Y. Hence, when the plurality of heads 100 are relatively positioned and fixed to the fixing plate 10, it is easy to grip and to position the head 100 from both side surfaces in the second direction Y. Here, a method of manufacturing the head unit, particularly, a method of positioning and fixing the fixing plate and the head, is described with reference to FIG. 48. FIG. 48 is a plan view illustrating a method of manufacturing the head unit. As illustrated in FIG. 48, the head 100 is caused to move by being held by a jig or the like on both side surfaces in the second direction Y with respect to the fixing plate 10, the relative positions of the plurality of heads 100 are positioned in the first direction X and the second direction Y, and the first surface 15 of the fixing plate 10 and the liquid ejecting surface 22 of the head 100 are joined. In the present embodiment, since the height h3 of the second side surface section 92 is lower than the height h4 of the fixing surface as the surface of the head 100 on Z1 side, it is possible to position the heads 100 with high accuracy, while the jig holding both side surfaces of the head 100 in the second direction Y does not interfere with the second side surface section 92. Incidentally, in a case where the side surface of the head 100 in the first direction X is held by the jig, there is a need to form a gap between the heads 100 adjacent in the first direction X such that the jig is inserted into the gap, and thus, the head unit 2 is likely to be increased in size in the first direction X. In addition, a gap between the nozzle rows of the adjacent heads 100 is increased, thereby prolonging a period of time from the landing of the ink droplets ejected from one head 100 to the landing of the ink droplets ejected from the other head 100. Thus, there is a concern that the print quality will be lowered. In the present embodiment, both side surfaces of the head 100 in the second direction Y are held by the jig, thereby narrowing a gap between the adjacent heads 100 in the first direction X. Then, it is possible to achieve miniaturization and to improve print quality. Further, both side surfaces of the head 100 in the second direction Y are held by the jig, and the height h1 of the first side surface section 91 provided on both sides of the head 100 in the first direction X is higher than the height h4 of the fixing surface of the head 100 on Z1 side. Both side surfaces of the head 100 in the first direction X may be covered with the first side surface section 91.

Figure 49:
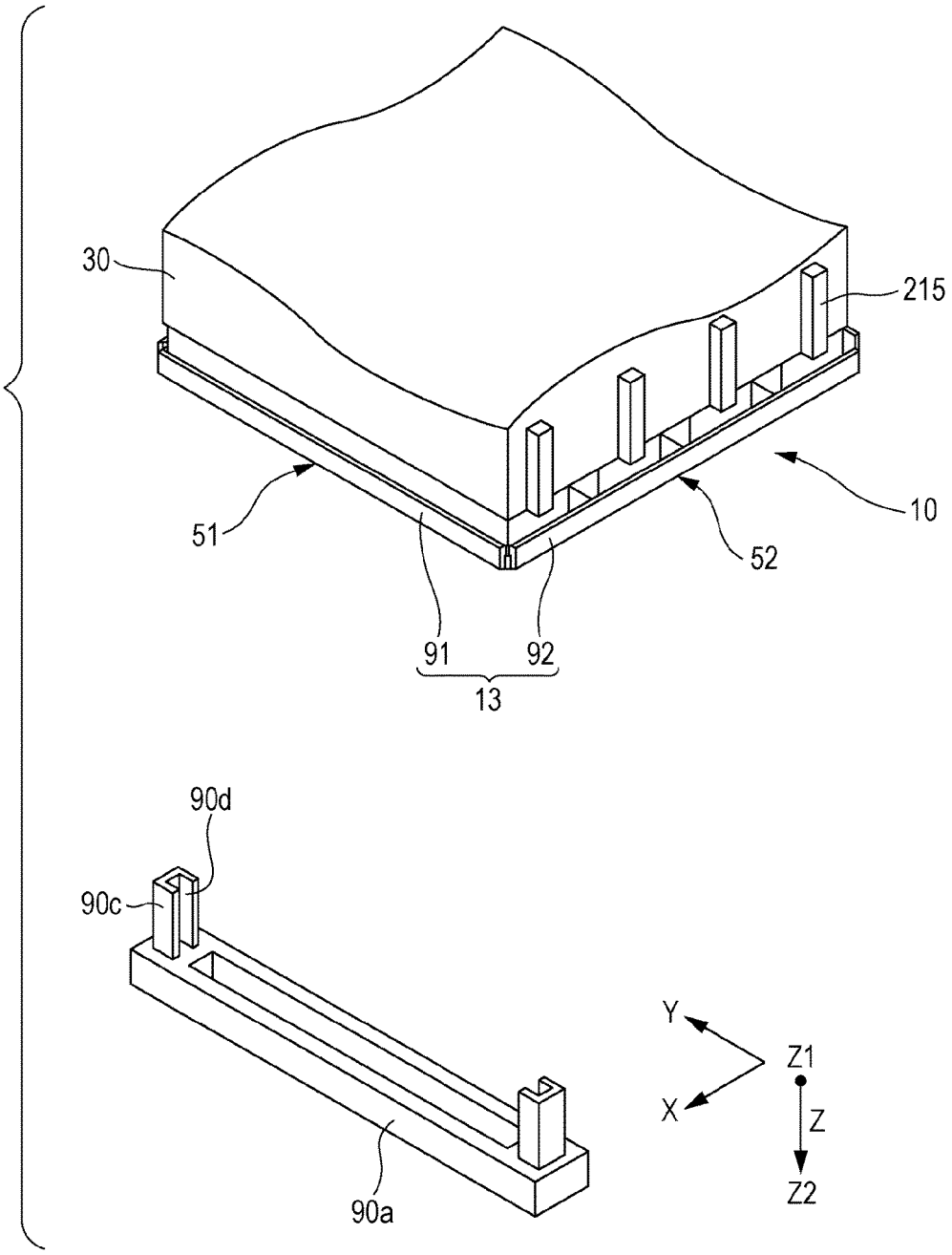
FIG. 49 is a perspective view of the head module and a cap according to Embodiment 5.
Figure 50:
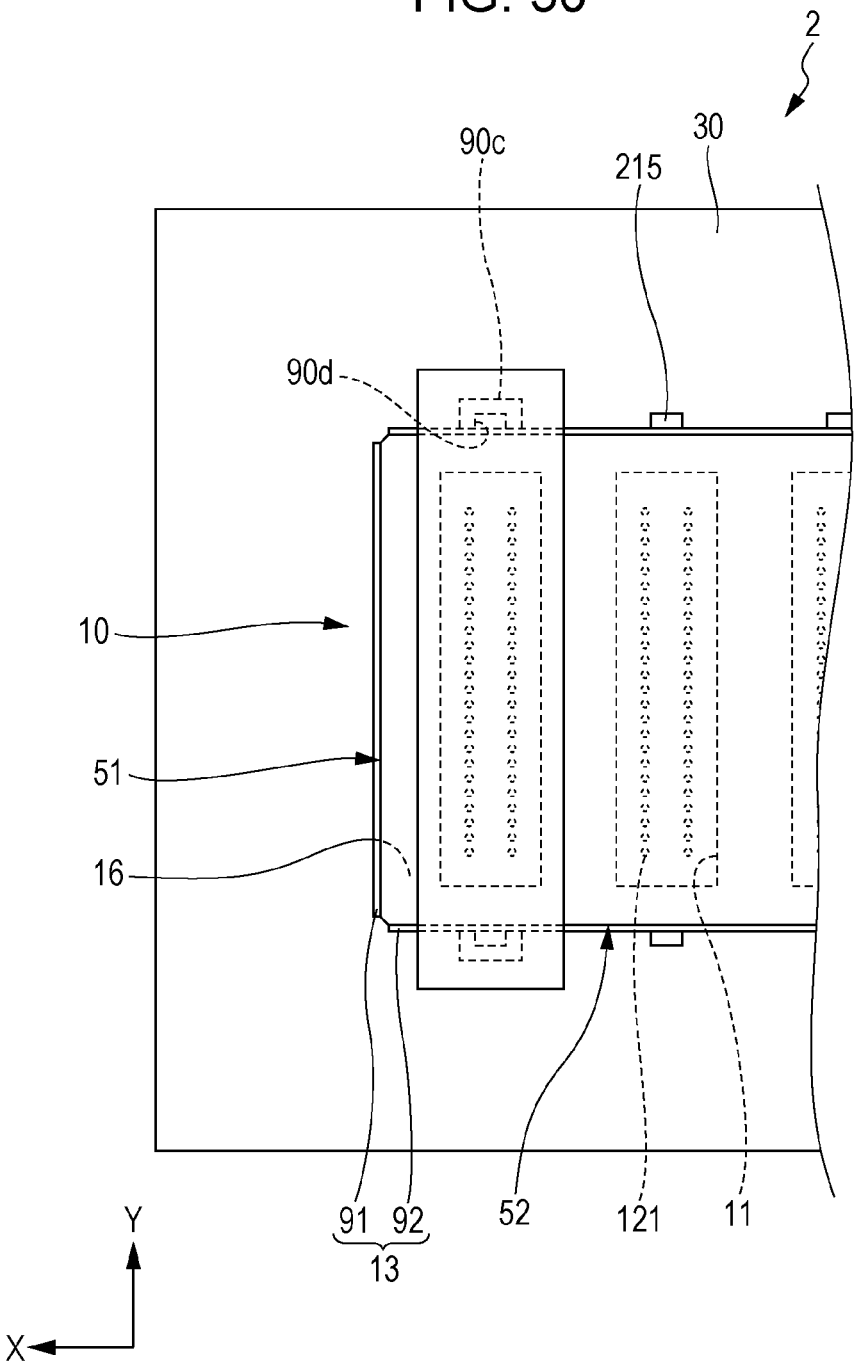
FIG. 50 is a plan view of the head module and the cap according to Embodiment 5.

Further, as illustrated in FIGS. 49 and 50, guide sections 215 for positioning the cap 90*a* are provided on both side surfaces of the channel holder 30 in the second direction Y so as to project to the outer side in the second direction Y. FIG. 49 is a perspective view of the head module and a cap. FIG. 50 is a plan view of the head module and the cap.

As illustrated in FIGS. 49 and 50, the cap 90*a* has a size sufficient to cover the two nozzle rows 122 of the head 100. Accordingly, the cap 90*a* is provided to have the size sufficient to cover the two nozzle rows 122 of the head 100, thereby making it possible to reduce consumption of wasteful ink suctioned by the cap 90*a*. In other words, when the cap 90*a* has a large size, the amount of ink suctioned by the large-sized cap is increased and thus, wasteful consumption of ink is increased. Therefore, the cap 90*a* needs to be as small as possible, to be positioned with respect to the two nozzle rows 122 of the one head 100, and to abut on the nozzle surface.

Such a cap 90*a* is provided with a positioning section 90*c* that projects to Z1 side in the third direction Z on both sides in the second direction Y. The positioning section 90*c* is provided with a positioning groove 90*d* that is opened on to the inner side in the second direction Y in parallel with third direction Z.

Figure 51:
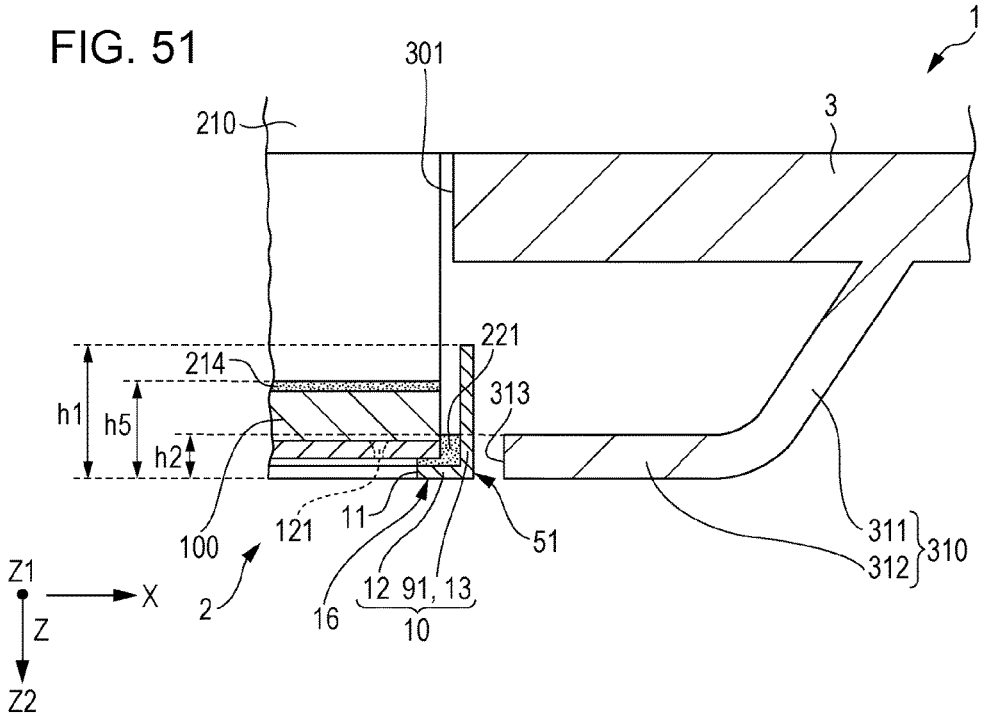
FIG. 51 is an exploded sectional view illustrating a modification example of the head module according to Embodiment 5.
Figure 52:
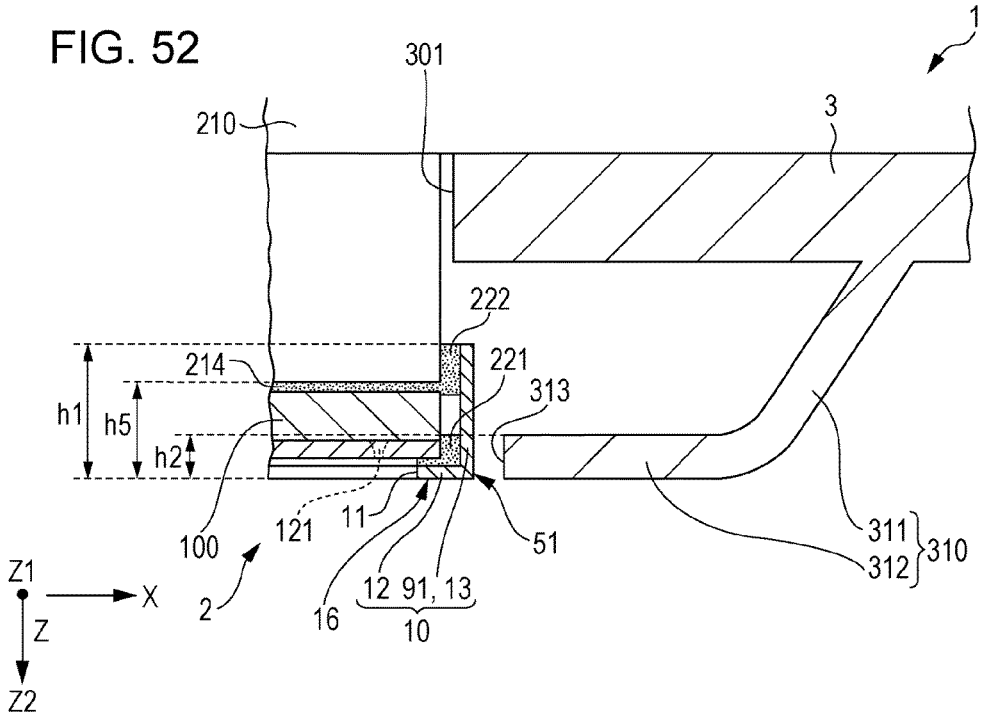
FIG. 52 is an exploded sectional view illustrating another modification example of the head module according to Embodiment 5.

In addition, the guide section 215 which is fitted in the positioning groove 90*d* of the cap 90*a* is provided on both side surfaces of the channel holder 30 in the second direction Y so as to project to the outer side in the second direction Y. In other words, the guide section 215 is provided to project further to the outer side from the fixing plate 10 in the second direction Y. In the present embodiment, such guide sections 215 are provided on both sides in the second direction Y for each head 100, in which a pair of guide sections are provided by one on one side. The positioning sections 90*c* provided on both sides in the second direction Y come into contact with the side surfaces of the channel holder 30 in the second direction Y, and the cap 90*a* is positioned in the second direction Y. In addition, the positioning groove 90*d* of the positioning section 90*c* is fitted with the guide sections 215 of the channel holder 30, the outer side surface of the guide section 215 in the first direction X abuts on the inner side surface of the positioning groove 90*d*, and then, the cap 90*a* is positioned in the first direction X with the movement in the first direction X regulated. Accordingly, the cap 90*a* is guided to abut on the nozzle surface of the head module 1 in a state of being positioned with respect to the channel holder 30 in the first direction X and the second direction Y. Accordingly, the cap 90*a* is positioned by the guide sections 215 of the channel holder 30, and thereby the cap 90*a* can reliably cover the two nozzle rows 122 of the head 100. In addition, the cap 90*a* is positioned by the guide sections 215 of the channel holder 30, thereby making it possible to reduce a positional shift or breaking of the head 100 in the first direction X and the second direction Y, compared to a case where the head 100 is provided with a guide section, and the cap 90*a* is positioned by abutting on the guide section provided on the head 100. In other words, when the cap 90*a* is positioned by abutting on the side surface of the head 100 in the second direction Y, there is a concern that the head is broken such as a positional shift of the head 100 in the first direction X and the second direction Y, or peeling off of the head 100 from the channel holder 30, due to an impact or pressure produced during the positioning. In the present embodiment, the cap 90*a* is positioned by the guide sections 215 of the channel holder 30, thereby making possible to reduce the impact or pressure which is produced during the positioning the cap 90*a* and which is directly applied to the head 100, and making it possible to reduce the positional shift or the breaking of the head 100. Incidentally, it is preferable that the guide section 215 of the channel holder 30 is provided at a position as close to the nozzle surface as possible. In this manner, it is possible to position the cap 90*a* with respect to the nozzle rows 122 via the guide sections 215 with high accuracy. In the present embodiment, the height h3 of the second side surface section 92 is set to be lower than the height h4 of the fixing surface of the head 100, that is, the surface of the head 100 on Z1 side, and thereby the guide section 215 can be provided to reach the surface of the channel holder 30 on Z2 side. Hence, it is possible to position the cap 90*a* with respect to the nozzle rows 122 via the guide sections 215 with high accuracy. Incidentally, when the height h1 of the first side surface section 91 and the height h3 of the second side surface section 92 are satisfied with a condition that the height h1 of the first side surface section 91 is higher than the height h2 of the facing surface 313, and the height h3 of the second side surface section 92 is lower than the height h4 of the fixing surface, h1 and h3 may have the same height, or any one may have higher position. Further, in the present embodiment, the height h1 of the first side surface section 91 is higher than the height h2 of the facing surface 313; however, the configuration is not particularly limited thereto. Here, a modification example of the first side surface section 91 is illustrated in FIGS. 51 and 52. FIGS. 51 and 52 are sectional views of main parts of the head module.

As illustrated in FIG. 51, the height h1 of the first side surface section 91 is set to be higher than a height h5 of the fixing surface between the channel holder 30 and the head 100. Further, as described above, the height means the height of the end portion on Z1 side in the third direction Z from the second surface 16 of the fixing plate 10. In addition, the fixing surface between the channel holder 30 and the head 100, which defines the height h5 for defining the height h1 of the first side surface section 91, is the surface on Z2 side to which the head 100 of the channel holder 30 is fixed. Incidentally, in a case where the channel holder 30 and the head 100 are fixed without using the adhesive 214, or in a case where the adhesive 214 is formed to be very thin, the height h4 of the fixing surface between the channel holder 30 and the head 100 for defining the height h3 illustrated in FIG. 44 described above can have substantially the same height as the height h5 of the fixing surface between the channel holder 30 and the head 100 for defining the height h1 illustrated in FIG. 51. In addition, also in the configuration illustrated in FIG. 51, in a case where the fixing surface between the channel holder 30 and the head 100 is provided over positions different in the third direction Z, the fixing surface defining the height h5 means a portion exposed on a side surface side of the first side surface section 91 in the first direction X, of the fixing surface between the channel holder 30 and the head 100.

The height h1 of the first side surface section 91 is set to be higher than the height h5 of the fixing surface between the channel holder 30 and the head 100, thereby making it possible to reduce occurrence of the fiber member 400 being caught on the end portion of the first side surface section 91. In addition, the height h1 of the first side surface section 91 is set to be higher than the height h5 of the fixing surface between the channel holder 30 and the head 100, thereby making it possible to cover the portion to which the channel holder 30 and the head 100 are fixed, that is, the adhesive 214 by the first side surface section 91. Therefore, it is possible to reduce the ink which is attached to the adhesive 214, and it is possible to reduce lowering of joint strength of the adhesive 214.

in addition, it is possible to reduce occurrence of direct contact of the medium S or the like with the side surface of the head 100 in the first direction X, or with the adhesive 214 by the first side surface section 91, and it is possible to reduce occurrence of peeling off of the head 100 from the channel holder 30. Incidentally, even when the height h1 of the first side surface section 91 is set to be higher than the height h5 of the fixing surface between the channel holder 30 and the head 100, as described above, the height h3 of the second side surface section 92 is set to be lower than the height h4 of the fixing surface between the channel holder 30 and the head 100, thereby making it possible to position the fixing plate 10 and the head 100 with high accuracy, and making it possible to provide the guide sections 215 that guides the cap 90*a*. In other words, the height h3 of the second side surface section 92 is set to be lower than the height h4 of the fixing surface between the channel holder 30 and the head 100, thereby making it possible to set the height h1 of the first side surface section 91 without limitation. Here, when the height h1 of the first side surface section 91 is too high, interference with the channel holder 30 is likely to occur, and it is likely to increase costs. Therefore, the height h1 of the first side surface section 91 is set at a position higher than h5, and preferably is set to be as low as possible regarding the interference with the channel holder 30 and the costs.

In addition, as illustrated in FIG. 52, in a case where the height h1 of the first side surface section 91 is higher than the height h5 of the fixing surface between the channel holder 30 and the head 100, the first side surface section 91 and the channel holder 30 may be joined with the adhesive 222 therebetween. In this manner, it is possible to further improve strength of the first side surface section 91, and to reduce deformation or peeling off of the first side surface section 91 due to the fiber member 400, and it is possible to reduce deformation or breaking due to abutting on the medium S. As described above, also in the case where the height h1 of the first side surface section 91 of the fixing plate 10 is lower than the height h5 of the fixing surface between the channel holder 30 and the head 100, it is preferable that the first side surface section 91 of the fixing plate 10 and the head 100 are joined by the adhesive. In this manner, it is possible to increase strength of the first side surface section 91 and it is possible to reduce deformation or peeling off due to the fiber member 400. It is needless to mention that, in the configuration illustrated in FIG. 52, it is also possible to further increase strength when the first side surface section 91 and the head 100 are joined by the adhesive.

Embodiment 6

Figure 53:
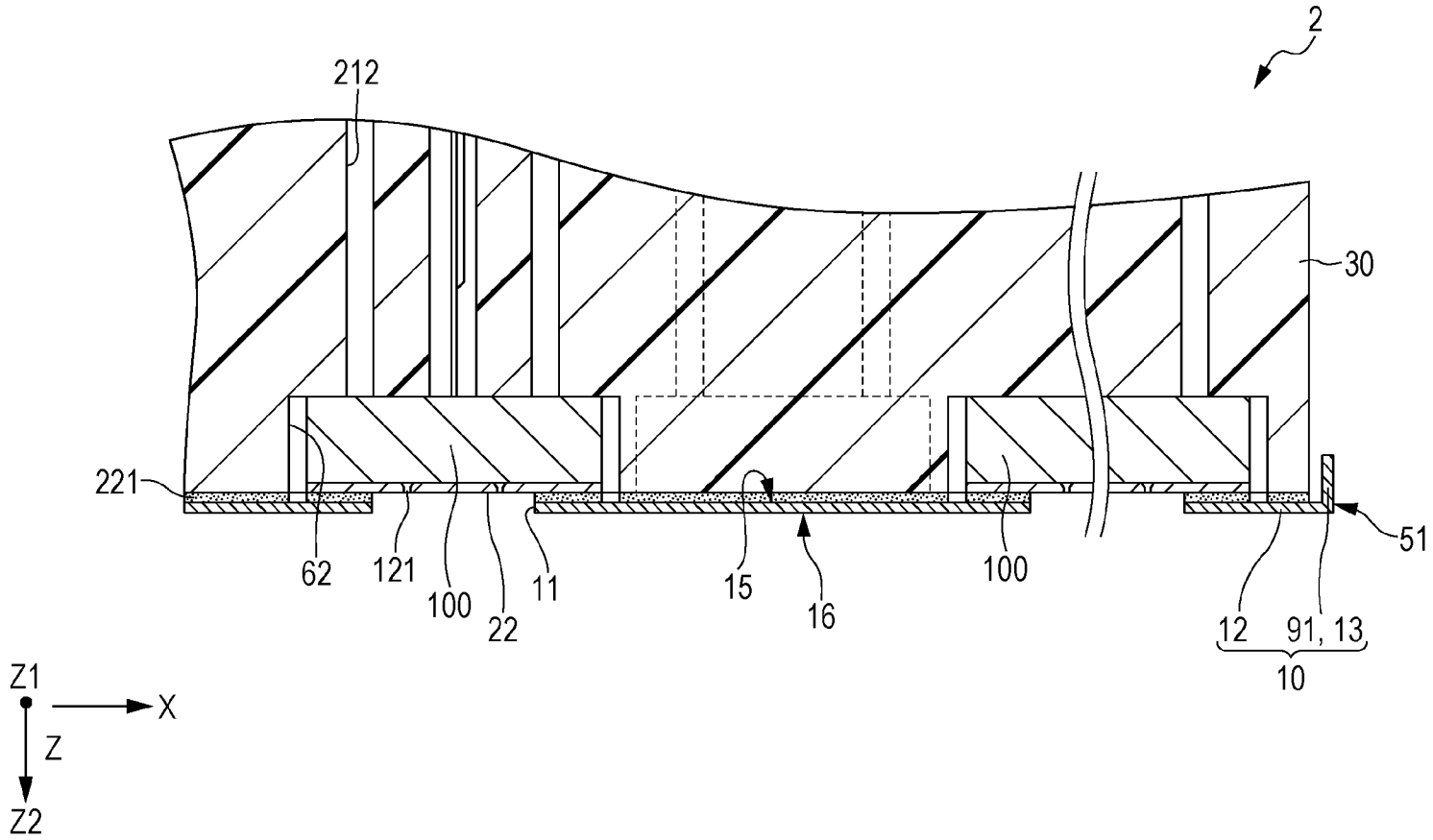
FIG. 53 is a sectional view of a head unit according to Embodiment 6.
Figure 54:
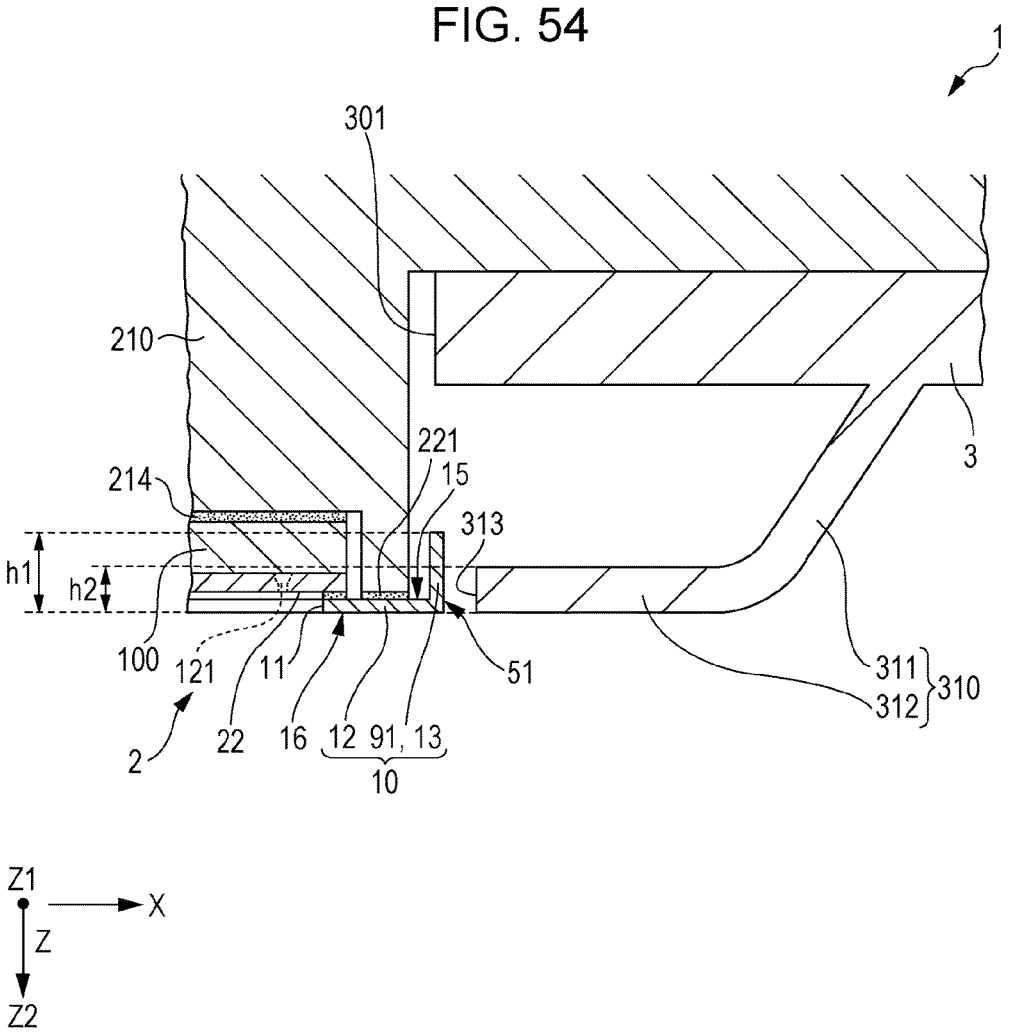
FIG. 54 is an exploded sectional view of main parts of a head module according to Embodiment 6.

FIG. 53 is a sectional view of the head unit according to Embodiment 6 of the invention. FIG. 54 is a sectional view of main parts of the head module. In addition, the perspective view of the head unit 2 of the present embodiment viewed in an oblique direction is the same as the perspective view of the head unit 2 of Embodiment 1 in FIG. 3. The exploded perspective view of the head unit 2 of the present embodiment is the same as the exploded perspective view of the head unit of Embodiment 3 in FIG. 15.

Further, the same reference signs are assigned to the same members as in the embodiment described above, and repetitive description is omitted.

As illustrated in FIGS. 53 and 54, the head unit 2 of the present embodiment includes the channel holder 30, the plurality of heads 100, and the fixing plate 10 (refer to FIG. 15).

Further, the head unit 2 of the present embodiment is different from that of Embodiment 1 in that the head unit of the present embodiment does not have the reinforcement plate 20.

The head accommodating section 62 that can accommodate the head 100 inside is provided on the surface of the channel holder 30 on Z2 side. The head accommodating section 62 has a recessed shape that is opened to the surface of the channel holder 30 on Z2 side. In addition, in the present embodiment, the head accommodating section 62 is provided individually for each head 100. It is needless to mention that the head accommodating section 62 may be provided over the plurality of heads 100. Here, the head accommodating section 62 is individually provided for each head 100, and, in this manner, it is possible to increase rigidity of the channel holder 30. The joint area between the channel holder 30 and the fixing plate 10 is increased, and it is possible to improve flatness of the fixing plate 10 and the nozzle plate 120.

The head 100 is accommodated in the head accommodating section 62 of the channel holder 30. Here, two rows of five heads 100 of the present embodiment are provided in which the heads 100 are arranged in the first direction X as the parallel-arrangement direction of the nozzle rows 122 and two rows of the heads are arranged in the second direction Y. In other words, a total of 20 nozzle rows 122 are arranged in the one head unit 2 in the first direction X. The two heads 100 which eject the same ink are disposed to be shifted in the second direction Y from each other, thereby elongating, in the second direction Y, the nozzle rows 122 that eject the same ink by the two recording heads 100.

In addition, the fixing plate 10 is fixed to the surface of the channel holder 30 on Z2 side, to which the head accommodating section 62 is opened. Similar to Embodiment 5 described above, the fixing plate 10 has the bottom section 12 and the side surface section 13 having the first side surface section 91 and the second side surface section 92.

As illustrated in FIG. 54, the head unit 2 is mounted on the carriage 3 as a frame body and configures the head module 1. Here, similar to Embodiment 5 described above, the height h1 of the first side surface section 91 of the fixing plate 10 is higher than the height h2 of the facing surface 313. However, as illustrated in FIG. 51, the height h1 of the first side surface section 91 does not need to be higher than the height h5 of the fixing surface between the channel holder 30 and the head 100. In other words, in the present embodiment, since the fixing surface between the channel holder 30 and the head 100 is disposed in the head accommodating section 62, the side surface of the head 100 in the first direction X or the adhesive 214 of the fixing surface is protected by the channel holder 30.

In addition, although not illustrated in the drawings, similar to Embodiment 5 described above, the height h3 of the second side surface section 92 is set to be lower than the height h4 of the fixing surface between the channel holder 30 and the head 100. In this manner, similar to Embodiment 5 described above, it is possible to position the plurality of heads 100 with respect to the fixing plate 10, and it is possible to achieve miniaturization of the head unit 2 and to improve the print quality. In addition, the height h3 of the second side surface section 92 is set to be lower than the height h4 of the fixing surface between the channel holder 30 and the head 100, thereby making it possible to provide the guide sections 215 at a position as close to the nozzle surface as possible on the side surface of the channel holder 30 in the second direction Y, and it is possible to position the cap 90*a* with respect to the nozzle surface with high accuracy.

Other Embodiments

As above, embodiments of the invention are described; however, the fundamental configuration of the invention is not limited to Embodiments 5 and 6 described above.

Figure 55:
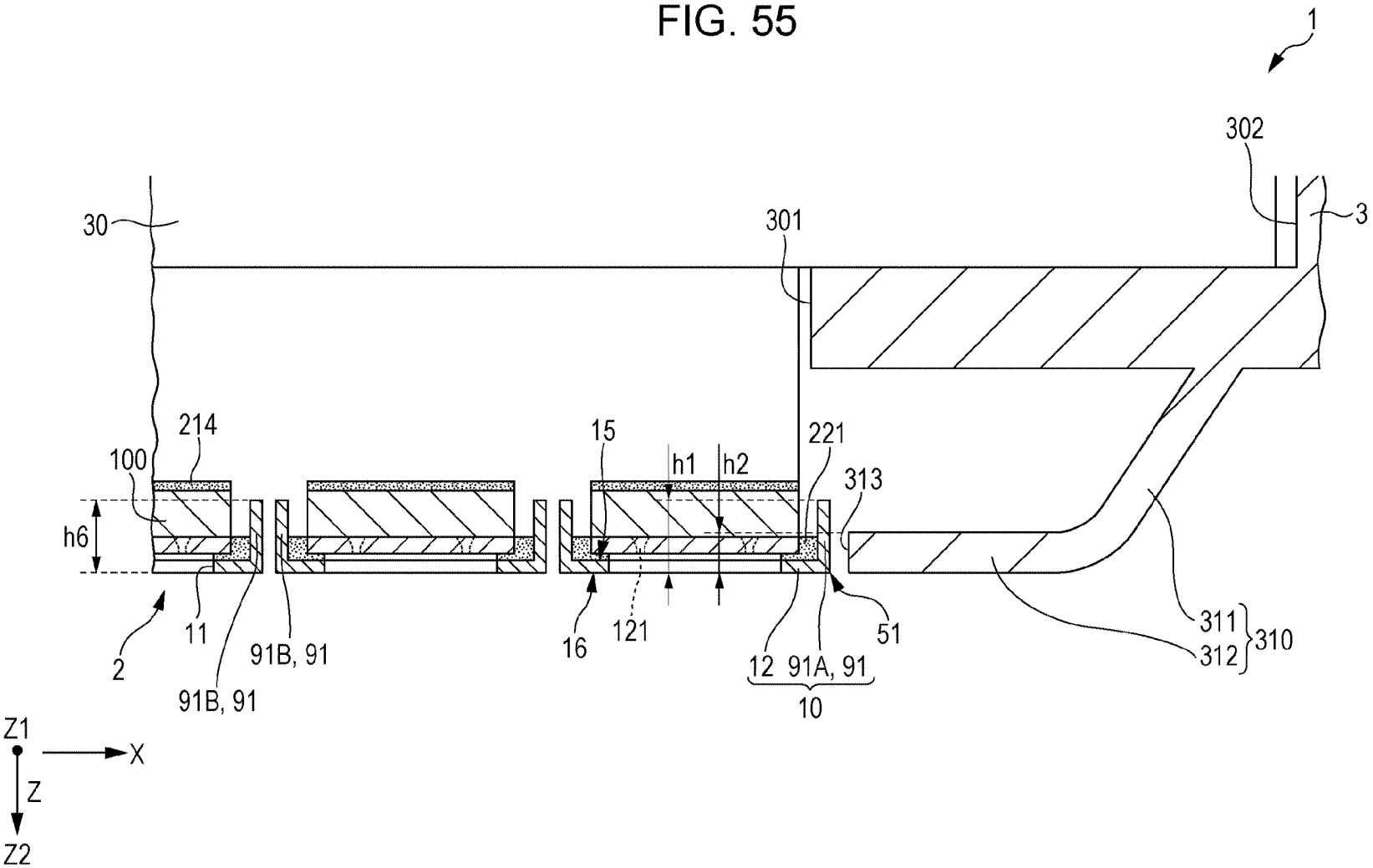
FIG. 55 is an exploded sectional view illustrating a modification example of a head module according to another Embodiment.
Figure 56:
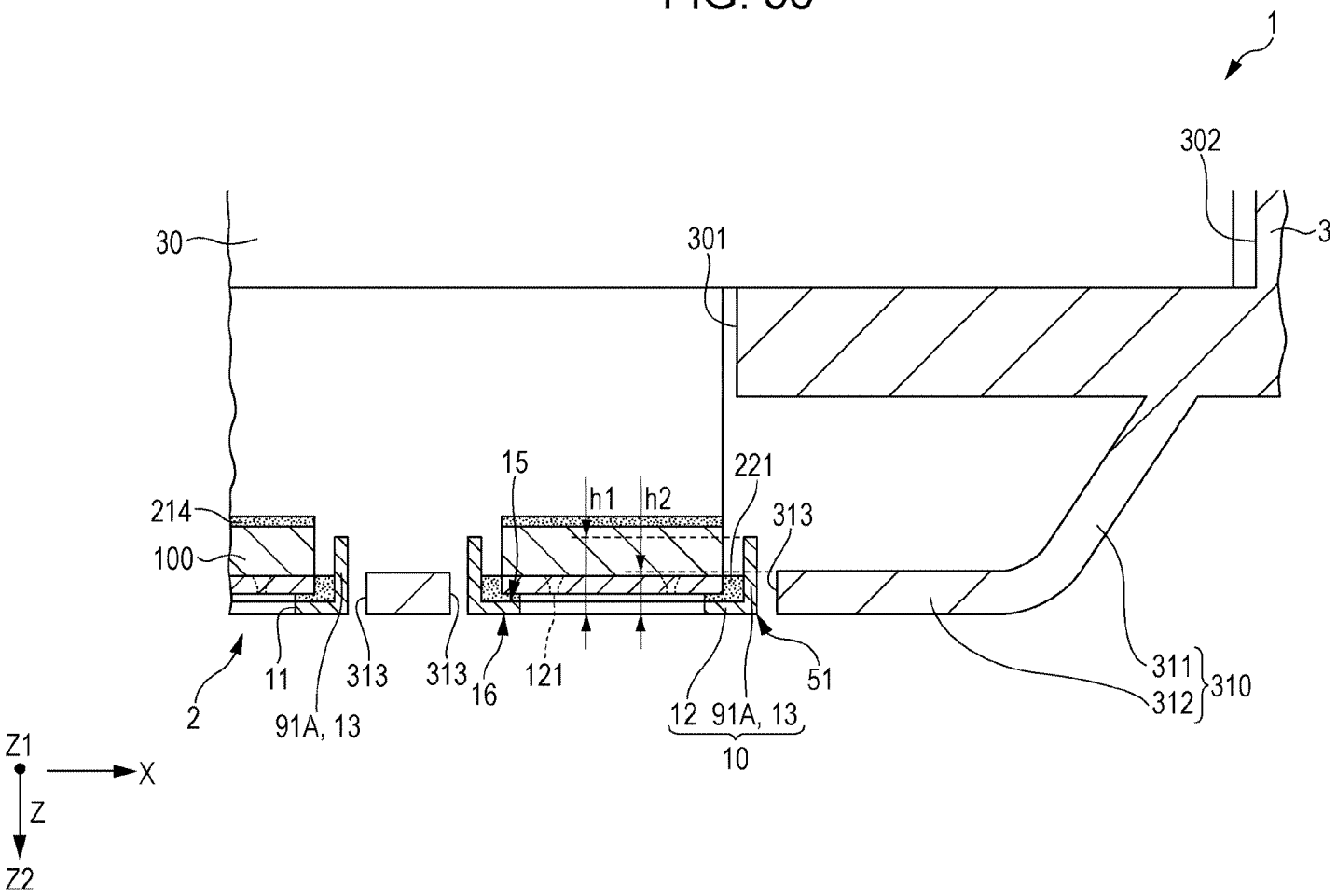
FIG. 56 is an exploded sectional view illustrating a modification example of a head module according to still another Embodiment.

For example, in Embodiments 5 and 6 described above, one common fixing plate 10 is provided with respect to the plurality of head units 2; however, the configuration is not limited thereto, and the fixing plate 10 may be provided for each head unit 2 or for each head group which is configured of the plurality of head units 2. Such a configuration is illustrated in FIGS. 55 and 56. FIGS. 55 and 56 are sectional views of main parts of the head module as a modification example of the fixing plate according to another embodiment of the invention.

As illustrated in FIG. 55, the fixing plate 10 is individually provided for each head unit 2. Such a fixing plate 10 includes the bottom section 12 and the side surface section 13 having the first side surface section 91 and the second side surface section 92. In the first direction X, two first side surface sections 91 of the fixing plate 10 of the head unit 2 provided on the wall section 310 side are formed of a first side surface section 91A facing the facing surface 313, and a first side surface section 91B which does not face the facing surface 313. In addition, the two first side surface sections 91 of the fixing plate 10 of head unit 2 provided on the side opposite to the wall section 310 of the head unit 2 both belong to the first side surface section 91B which does not face the facing surface 313.

In such a configuration, the height h1 of the first side surface section 91A facing the facing surface 313 may be set at a position higher than the height h2 of the facing surface 313. In other words, a height h6 of the first side surface section 91B which does not face the facing surface 313 may be at a position lower than the height h2 of the facing surface 313. Here, as illustrated in FIG. 55, in a case where the first side surface sections 91B, which do not face the facing surface 313, are provided to face each other in the first direction X, the heights h6 of the first side surface sections 91B facing each other are set to be the same and, in this manner, when the gap is cleaned by the fiber member 400, the fiber member 400 is unlikely to be caught on the end portion of the first side surface section 91B and it is possible to reduce deformation or peeling off of the fixing plate 10. In addition, the height h6 of the first side surface section 91B is set to be the same as the height h1 of the first side surface section 91A, thereby it is possible to reduce restriction on an orientation of the fixing plate 10 with respect to the channel holder 30, and it is possible to simplify an assembly process.

In addition, as illustrated in FIG. 56, also in a case where the fixing plate 10 is provided for each head unit 2, or in a case where the carriage 3 is positioned between two fixing plates 10, that is, in a case where the facing surface 313 of the carriage 3 is provided to face the two first side surface sections 91, two first side surface sections 91 correspond to first side surface section 91A in FIG. 55. Hence, the height h1 of the two first side surface sections 91 may be higher than the height h2 of the facing surfaces 313, respectively. Incidentally, in a case where the heights h2 of the facing surfaces 313 facing the two first side surface sections 91, respectively, are different, similar to Embodiments 5 and 6 described above, it is possible to reduce deformation and peeling off of the fixing plate 10 due to the fiber member 400 during cleaning, when the height h1 of the first side surface section 91 is higher than the height h2 of the facing surface 313 which actually faces the first side surface section.

Further, in Embodiments 5 and 6 described above, the nozzle plate 120 of the head unit 2 and the fixing plate 10 are fixed to each other; however, the configuration is not limited thereto, and the fixing plate 10 may be fixed to the channel substrate other than the nozzle plate 120 of the head unit 2. Here, the nozzle 121 communicates with the ink communicating paths 212 as the channel of the channel holder 30 by the channel substrate of the head unit 2, and in Embodiments 5 and 6 described above, the channel substrate 110 or the like is used as the channel substrate. Incidentally, in Embodiments 5 and 6 described above, since the channel substrate 110 does not have a surface exposed to Z2 side, it is not possible to directly fix the first surface 15 of the fixing plate 10 to the channel substrate 110. For example, in a case where, as a communication plate having a wider area than the nozzle plate 120 provided between the channel substrate 110 and the nozzle plate 120, the communication plate provided with a communication path, through which the pressure generating chamber 112 and the nozzle 121 communicate with each other, is provided, the fixing plate 10 may be fixed to the communication plate. In addition, in a case where another substrate, for example, a compliance substrate or the like is fixed to the surface of the communication plate on the nozzle plate 120 side, the fixing plate 10 may be fixed to the other substrate such as the compliance substrate. In other words, the channel substrate of the head unit 2, to which the fixing plate 10 is fixed, is a substrate having a surface exposed to the surface of the head unit 2 on the same Z2 side as the nozzle plate 120.

Further, the head unit 2 in Embodiments 5 and 6 described above may be the head unit 2 in Embodiments 1 to 4 described above. The head unit 2 in Embodiments 5 and 6 is the head unit 2 in Embodiments 1 to 4, and thereby the head module 1 in Embodiments 5 and 6 can receive the effects achieved by the head unit 2 in Embodiments 1 to 4.

Further, in Embodiments 5 and 6 described above, the thin film-type piezoelectric actuator 300 is described as the pressure generating unit that causes the pressure in the pressure generating chamber 112 to be changed; however, the configuration is not particularly limited thereto. For example, it is possible to use a thick film-type piezoelectric actuator formed by a method of attaching a green sheet or the like, a longitudinal vibration type of piezoelectric actuator in which a piezoelectric material and an electrode forming material are alternately laminated and are expanded and contracted in an axial direction, or the like. In addition, as the pressure generating unit, it is possible to use an actuator which includes a heating element disposed in a pressure generating chamber, and ejects a liquid droplet from a nozzle due to bubbles generated by the heating of the heating element, a so-called electrostatic actuator which generates static electricity between a vibration plate and an electrode, deforms the vibration plate due to an electrostatic force, and ejects a liquid droplet from a nozzle, or the like.

In addition, in an example described above, the ink jet-type recording apparatus III has a configuration in which the ink cartridges 27A and 27B as the liquid supply unit are mounted on the head module 1; however, the configuration is not particularly limited thereto, and, for example, a liquid storage unit such as an ink tank may be fixed to the apparatus main body 4, and the liquid storage unit and the head module 1 may be connected via a supply tube such as a tube. In addition, the liquid storage unit may not be mounted on the ink jet-type recording apparatus.

In addition, in the ink jet-type recording apparatus III described above, one cap 90*a*, which covers two nozzle rows 122 of one head 100, is provided for one head module 1; however, the configuration is not limited thereto, and the same number of caps 90*a* and heads 100, that is, in an example described above, four caps and heads may be provided. In addition, one cap 90*a* may be provided to have a size sufficient to cover the nozzle rows 122 of the two or more heads 100 at once.

Further, in the ink jet-type recording apparatus III described above, the head module 1 performs a reciprocating movement in the first direction X; however, the configuration is not particularly limited thereto, and, for example, the invention can also be applied to a so-called line-type recording apparatus in which the head module 1 is fixed to the apparatus main body 4, and the printing is performed only by causing the medium S to move in the second direction Y.

Further, as an example, a head module and an ink jet-type recording apparatus which have an ink jet-type recording head unit that discharges ink as a liquid ejecting head are described; however, the invention can be applied to, as a target, a liquid ejecting head module having a wide liquid ejecting head and an liquid ejecting apparatus, overall. Examples of a liquid ejecting head include, for example, a recording head such as various types of ink jet-type recording head used in an image recording apparatus such as a printer, a color material ejecting head used in manufacturing a color filter such as a liquid crystal display, an organic EL display, an electrode material ejecting head used to form an electrode, such as a field emission display (FED), a bio-organic material ejecting head used in manufacturing a bio chip, or the like.

What is claimed is:

1. A liquid ejecting head unit comprising:

a fixing plate provided with a plurality of openings;

a plurality of heads, each of which is provided for each of the openings;

a reinforcement plate that is stacked on the fixing plate and is provided with a plurality of through-holes into which the heads are inserted; and a channel holder that is provided with a plurality of channels and that accommodates the plurality of heads in cooperation with the fixing plate, wherein each of the plurality of heads has a nozzle plate provided with a nozzle row having a plurality of nozzles, and a channel substrate provided with a channel through which the channel of the channel holder communicates with the nozzle, wherein the head is fixed to a first surface of the fixing plate, wherein the nozzle plate and a second surface of the fixing plate defines an ejection surface, wherein the fixing plate has a plurality of sets, each of which has a plurality of openings, and wherein the adjacent openings of the plurality of openings constituting each of the sets are disposed to be partly overlapped in a Y direction in which the nozzle rows longitudinally extend, and the openings are disposed not to be overlapped in an X direction orthogonal to the Y direction, the openings aligning a plurality of nozzles of one nozzle row associated with one of the plurality of openings to overlap with a plurality of nozzles of another nozzle row associated an adjacent opening of the set in the Y direction, the one nozzle row and the another nozzle row forming an elongate nozzle row.

2. The liquid ejecting head unit according to claim 1, wherein the channel holder has a guide section that projects in the Y direction, and that guides a cap which covers the nozzles, the guide section being provided to project further to the fixing plate in the Y direction.

3. The liquid ejecting head unit according to claim 1, further comprising:

a circuit board provided with a plurality of wiring openings, wherein each of the plurality of heads is electrically connected to the circuit board via a cable inserted into each of the wiring openings, and wherein the wiring openings corresponding to the set of openings of the fixing plate are disposed at a distance from each other in the Y direction.

4. The liquid ejecting head unit according to claim 3, wherein each of the plurality of cables are fixed to the circuit board on only one of one side and the other side in the X direction with respect to the wiring opening, wherein the plurality of cables includes a first cable group that passes through the wiring openings at the same position in the Y direction, and that is fixed to the circuit board on the one side, and a second cable group that passes through the wiring openings at the same position in the Y direction, and that is fixed to the circuit board on the other side, and wherein the first cable group and the second cable group is partly overlapped in the Y direction.

5. The liquid ejecting head unit according to claim 3, wherein a width of the cable on an input side that is connected to the circuit board is narrower than a width of the cable on an output side that is connected to the head.

6. The liquid ejecting head unit according to claim 1, wherein the reinforcement plate.

7. The liquid ejecting head unit according to claim 6, wherein the through-hole of the reinforcement plate has a first inner circumferential surface with a first space as a space from the head, and a second inner circumferential surface with a second space as a space from the head, which is wider than the first space, and wherein an adhesive is provided to be in contact with the second inner circumferential surface.

8. The liquid ejecting head unit according to claim 1, wherein the fixing plate has a bottom section formed of the first surface and the second surface, and a rounded section that is rounded from the second surface toward the first surface.

9. The liquid ejecting head unit according to claim 8, wherein the fixing plate has a side surface section extending from the bottom section, and wherein the bottom section is surrounded by the side surface section and the rounded section.

10. The liquid ejecting head unit according to claim 9, wherein the channel holder has a recessed section in which the side surface section is accommodated.

11. The liquid ejecting head unit according to claim 8, wherein the channel holder has a wall section that projects from the first surface to the second surface, and that projects outward from the bottom section of the fixing plate in an in-plane direction of the second surface.

12. A liquid ejecting head module comprising:

the liquid ejecting head unit according to claim 1; and a frame body provided with an exposure opening through which the ejecting surface is exposed, wherein the fixing plate has a bottom section formed of the first surface and the second surface, and a side surface section extending from the second surface side toward the first surface side of the bottom section, wherein the head is fixed to the first surface of the fixing plate, on the second surface side from the channel substrate, wherein the exposure opening is defined by a facing surface facing the side surface section, wherein the frame body exposes the second surface of the fixing plate in a state in which the facing surface and the fixing plate are separated by a gap therebetween, and wherein a height of the side surface section is higher than a height of the facing surface of the frame body.

13. A liquid ejecting head module comprising:

a liquid ejecting head unit having a liquid ejecting surface from which a liquid is ejected; and a frame body provided with an exposure opening through which the liquid ejecting surface is exposed, wherein the liquid ejecting head unit includes:

a fixing plate that has a bottom section having a first surface and a second surface, and a side surface section extending from the second surface side toward the first surface side of the bottom section, and that is provided with an opening in the bottom section, a head, a reinforcement plate that is stacked on the fixing plate and is provided with a through-holes into which the head is inserted, and a channel holder that is provided with a channel and that supplies a liquid to the head, wherein the head includes:

a nozzle plate provided with a nozzle row, and a channel substrate that is stacked on the nozzle plate, and is provided with a channel communicating with the channel of the channel holder, wherein the head is fixed to the first surface of the fixing plate, on the second surface side from the channel substrate, wherein the nozzle plate and a second surface of the fixing plate defines an ejection surface, wherein the exposure opening is defined by a facing surface of the frame body facing the side surface section, wherein the frame body exposes the second surface of the fixing plate in a state in which the facing surface and the fixing plate are separated by a gap therebetween, and wherein a height of the side surface section of the fixing plate is higher than a height of the facing surface of the frame body.

14. The liquid ejecting head module according to claim 12, wherein the height of the side surface section is higher than the height of a fixing surface between the channel holder and the head.

15. The liquid ejecting head module according to claim 12, wherein the side surface section of the fixing plate is joined to the channel holder.

16. The liquid ejecting head module according to claim 12, wherein the bottom section is surrounded on four sides by first side surface sections in the Y direction, and second surface sections in the X direction of the side surface section, and wherein a height of the first side surface section is higher than the height of the facing surface, and a height of the second side surface section is higher than a height of a fixing surface between the head and the channel holder.

17. The liquid ejecting head module according to claim 16, wherein the channel holder has a guide section that projects outward in the Y direction from the second side surface section, and that guides a cap which covers the nozzles.

18. The liquid ejecting head module according to claim 12, wherein the liquid ejecting head unit has the liquid ejecting head unit according to claim 1.

19. The liquid ejecting apparatus according to claim 18, further comprising:

a cap that seals the same set of openings of the plurality of openings of the fixing plate; and a negative pressure mechanism that causes a pressure in the cap to be changed to a negative pressure, wherein the heads corresponding to the set of openings in the fixing plate, of the plurality of heads, are supplied with a liquid from a common supply source, and wherein the plurality of sets of openings in the fixing plate are not overlapped to one another in the X direction.

20. A method of manufacturing a liquid ejecting head unit that includes a fixing plate provided with a plurality of openings, a plurality of heads, each of which is provided for each of the openings, a reinforcement plate that is stacked on the fixing plate and is provided with a plurality of through-holes into which the heads are inserted, and a channel holder that is provided with a plurality of channels and that accommodates the plurality of heads in cooperation with the fixing plate, wherein the fixing plate has a bottom section formed of a first surface and a second surface and a rounded section that is rounded from the second surface toward the first surface, wherein each of the heads has a nozzle plate provided with a nozzle row having a plurality of nozzles from which a liquid is ejected and a channel substrate provided with a channel through which the channel of the channel holder communicates with the nozzle, and wherein the head is fixed to the first surface of the bottom section of the fixing plate, and the head has a discharge surface defined by the second surface of the fixing plate and the nozzle plate, the method of manufacturing a liquid ejecting head unit comprising:

providing the opening in a plate-shaped member;

cutting an edge, which becomes the side surface sections of the fixing plate, from the plate-shaped member;

cutting an edge, which becomes the rounded portion, from the plate-shaped member;

forming the rounded portion on the plate-shaped member;

following forming the rounded portion, bending a region of the plate-shaped member, which becomes the side surface sections, and forming the fixing plate with the rounded portion disposed between adjacent side surface sections;

fixing the plurality of heads to the first surface of the fixing plate; and fixing the fixing plate, to which the plurality of heads are fixed, to the channel holder.

* * * * *